US007653332B2

(12) United States Patent
Ehara et al.

(10) Patent No.: US 7,653,332 B2
(45) Date of Patent: Jan. 26, 2010

(54) IMAGE FORMING APPARATUS HAVING ENHANCED CONTROLLING METHOD FOR REDUCING DEVIATION OF SUPERIMPOSED IMAGES

(75) Inventors: Yasuhisa Ehara, Kamakura (JP); Kazuhiko Kobayashi, Tokyo (JP); Joh Ebara, Kamakura (JP); Noriaki Funamoto, Machida (JP); Seiichi Handa, Tokyo (JP); Yuji Matsuda, Inagi (JP); Kouji Amanai, Yokohama (JP); Toshiyuki Uchida, Kawasaki (JP); Keisuke Sugiyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 11/790,825

(22) Filed: Apr. 27, 2007

(65) Prior Publication Data

US 2007/0258729 A1 Nov. 8, 2007

(30) Foreign Application Priority Data

Apr. 28, 2006 (JP) ..... 2006-125185
Nov. 10, 2006 (JP) ..... 2006-304782

(51) Int. Cl.
*G03G 15/00* (2006.01)

(52) U.S. Cl. ..... 399/167; 399/49

(58) Field of Classification Search ..... 399/159, 399/162, 165, 167, 301, 312, 313, 49
See application file for complete search history.

(56) References Cited

U.S. PATENT DOCUMENTS 7,376,375 B2 * 5/2008 Kobayashi et al. ..... 399/301
2007/0140736 A1 6/2007 Ehara et al.

FOREIGN PATENT DOCUMENTS

| | | |
|---|---|---|
| JP | 63-286864 | 11/1988 |
| JP | 09-146329 | 6/1997 |
| JP | 10-003188 | 1/1998 |
| JP | 10-078734 | 3/1998 |
| JP | 2000-284561 | 10/2000 |
| JP | 2004-029675 | 1/2004 |
| JP | 2004-074643 | 3/2004 |
| JP | 2005-202432 | 7/2005 |
| JP | 2007-316580 | * 12/2007 |

OTHER PUBLICATIONS

U.S. Appl. No. 11/635,550, Ehara.

* cited by examiner

*Primary Examiner*—Hoan H Tran
(74) *Attorney, Agent, or Firm*—Harness, Dickey & Pierce, P.L.C.

(57) ABSTRACT

An image forming apparatus includes: image detectors to detect conditions of images, respectively, formed on a transfer member; sensors to detect rotational displacements of latent image carriers, respectively; and a controller to perform at least phase adjustment control and image-to-image displacement control before performing image forming operations on image carriers, respectively. Image-to-image displacement control includes adjusting image forming timing on the image carriers based upon conditions of a detection image (including images transferred from the image carrier) detected by the image detectors, respectively. Speed-variation detection control includes detecting a condition of a speed-variation detection image (including an image transferred from each of image carriers) via the image detectors, and determining speed variation of the image carriers, respectively, per one revolution based upon outputs of the image detectors and the sensors. Phase adjustment control includes determining phase adjustments for the image carriers, respectively, based on the corresponding speed-variations.

16 Claims, 30 Drawing Sheets

| FIG. 24A |
| --- |
| FIG. 24B |

IMAGE FORMING APPARATUS HAVING ENHANCED CONTROLLING METHOD FOR REDUCING DEVIATION OF SUPERIMPOSED IMAGES

PRIORITY STATEMENT

The present patent application claims priority under 35 U.S.C. §119 upon Japanese Patent Application No. 2006-125185 filed on Apr. 28, 2006 and No. 2006-304782 filed on Nov. 10, 2006, in the Japan Patent Office, the entire contents of each of which is incorporated herein in its entirety by reference.

TECHNICAL FIELD

The present disclosure generally relates to an image forming apparatus, and more particularly to an image forming apparatus having a plurality of image carriers for superimposingly transferring a plurality of images to a transfer member such as intermediate transfer belt and recording medium.

BACKGROUND

An image forming apparatus using electrophotography may include a plurality of image carriers (e.g., photoconductor) and a transfer member (e.g., transfer belt) facing the image carriers, in which the transfer member may travel in an endless manner in one direction.

In such image forming apparatus, toner images having different color may be formed on each of the image carriers.

Such toner images may be superimposingly transferred onto the transfer member, and further transferred onto a recording medium (e.g., transfer sheet), by which a full-color toner image may be formed on the recording medium.

In such configuration, toner images may not be correctly superimposed on the recording sheet in a sub-scanning direction of image forming direction by several factors in some cases.

Such factors may include a deviation of light-path in an optical unit from a normal path due to a temperature change, relative positional changes of the image carriers due to an external force, for example.

If toner images may not be superimposed correctly on a recording medium when forming a fine/precise image by superimposing a plurality of color toner images, image dots having different color may not be superimposed correctly on the recording medium, by which a resultant image may have a blurred portion, which may not be acceptable as fine/precise image.

Furthermore, if such incorrect superimposing may occur when forming a character image on a non-white sheet, a white area may occur around the character image.

Furthermore, if such incorrect superimposing may occur when forming an image having a plurality of colored areas on a sheet, a white area may occur at a border of different colored areas or an unintended color image area may occur at a border of different colored areas.

Furthermore, if such incorrect superimposing may occur when forming an image having a plurality of colored areas on a sheet, unintended stripe images may occur on a sheet, and cause uneven concentration on an image, which is printed on the sheet.

Such phenomenon may unfavorably degrade an image quality to be formed on the recording medium.

Such drawback that toner images may not be correctly superimposed on the recording sheet in a sub-scanning direction of image forming direction may be reduced or suppressed by adjusting a writing timing of an optical unit of an image forming apparatus.

Hereinafter such drawbacks may be referred to "superimposing-deviation of images" or "superimposing-deviation," as required, for the simplicity of expression.

An adjustment of writing timing of the optical unit may be conducted as below.

At first, a toner image may be formed on each of the image carriers (e.g., photoconductor) at a given timing, and then transferred onto to a surface of a transfer member such as transfer belt as detection images.

Such detection images may be used to detect an image-to-image positional deviation between toner images, to be formed on the transfer member.

A photosensor may sense the detection images and transmits a signal, corresponding to each of the detection image, to a controller of the image forming apparatus. The controller may judge a detection timing of the detection image based on the signal.

The controller may compute a relative image-to-image positional deviation value between each of the toner images based on the signal.

Based on computation by the controller, the controller may set a starting timing for writing a latent image on each of the image carriers (e.g., photoconductor) independently, by which a superimposing-deviation of images may be suppressed.

The above-mentioned image forming apparatus may employ a direct transfer method, which transfers toner images from image carriers to a recording medium, which may be transported by a transport belt.

The above-mentioned image forming apparatus may also employ an intermediate transfer method, which transfers toner images from image carriers to a transfer belt, and further to a recording medium.

In both of such configurations, adjusting a writing timing of an optical unit may reduce a superimposing-deviation of images.

Toner images may not be correctly superimposed on the recording medium by the above-mentioned factors such as a deviation of light-path in an optical unit due to a temperature change, and relative positional changes of the image carriers due to an external force, for example. In addition to such factors, other factors may cause an incorrect superimposing of toner images.

Other factors may include an eccentricity of image carrier, an eccentricity of drive-force transmitting member (e.g., gear) that rotates with image carrier, and an eccentricity of a coupling member that is connected to image carrier, for example.

Specifically, if the image carrier or drive-force transmitting member may have an eccentricity, the image carrier may have two areas (e.g., first and second areas) on the surface of the image carrier with respect to a diameter direction of the image carrier.

For example, the first area of the image carrier may rotate with a relatively faster speed due to the eccentricity, and the second area of the image carrier may rotate with a relatively slower speed due to the eccentricity, wherein such first and second areas may be distanced each other with 180-degree with respect to a diameter direction of the image carrier, for example.

In such a case, first image dots formed on the first area of the image carrier may be transferred to a transfer member at a timing earlier than an optimal timing, and second image dots formed on the second area of the image carrier may be transferred to the transfer member at a timing later than an optimal timing.

If such phenomenon may occur, first image dots formed on one image carrier may be superimposed on second image dots formed on another image carrier. Similarly, second image dots formed on one image carrier may be superimposed with first image dots formed on another image carrier.

Such phenomenon may cause incorrect superimposing of toner images having different colors in a sub-scanning direction.

The above-mentioned adjusting control work may adjust an optical writing position for each photoconductor in a sub-scanning direction in one image, but may not adjust a speed variation in one photoconductor, by which "superimposing-deviation of images" may not be suppressed or reduced.

In another image forming apparatus, a controller may conduct a speed-variation detection control and a phase adjustment control for toner images to reduce an incorrect superimposing of toner images.

The speed-variation detection control may be conducted by detecting a deviation of surface speed of an image carrier (e.g. photoconductor), which may occur when conducting an image forming operation.

The phase adjustment control may be conducted by adjusting a phase of each image carrier based on the speed-variation detection control.

In case of speed-variation detection control, a plurality of toner images may be formed with a given pitch each other on a surface of one image carrier in a surface moving direction of one image carrier.

Such plurality of toner images may be then transferred to a transfer member (e.g., transfer belt) as speed-variation detection image, and a photosensor may detect each of the toner images included in the speed-variation detection image.

Based on a detection result by the photosensor, a pitch of toner images included in the speed-variation detection image per one revolution of one the image carrier (e.g., photoconductor) may be computed.

Based on the computed pitch, a speed variation per one revolution of one image carrier may be determined.

Furthermore, another photosensor may detect a marking placed on a gear, which may drive the image carrier, to detect a timing that the image carrier comes to a given rotational angle.

With such process, the controller of the image forming apparatus may compute a difference between a first timing when the image carrier comes to the given rotational angle and a second timing when the surface speed of image carrier becomes a maximum or minimum speed.

Such speed-variation detection control process may be conducted for each of the image carriers.

After conducting such speed-variation detection control, a phase adjustment control may be conducted to adjust a phase of image carriers.

Specifically, a photosensor may detect a marking placed on a given position of a gear, which rotates the image carrier.

A plurality of photosensors may be used to detect a marking placed on a given position of gears, which drives respective image carriers.

With such process, a timing when each of the image carriers is disposed at a given rotational angle may be detected.

Based on a comparison of a timing for such given rotational angle and a timing detected by speed-variation detection control process for each of image carriers, a plurality of drive motors, which respectively drives each of the image carriers, is driven by changing a driving time period temporarily to adjust a phase of image carriers.

With such phase adjustment of image carriers, image dots that may come to a transfer position at a timing earlier than an optimal timing, or image dots that may come to a transfer position at a timing later than an optimal timing, may come to a transfer position at an optimal timing. With such controlling, a superimposing-deviation of images may be reduced.

Furthermore, if a pitch between adjacent image carriers may be set to a value, which is equal to a length obtained by multiplying a circumference length of image carrier with an integral number (e.g., one, two, three), each of the image carriers may rotate for an integral number (e.g., one, two, three) during a time when one toner image is transferred from one image carrier to a sheet at one transfer position and then moved to a next transfer position on a next image carrier.

Accordingly, under such configuration, by adjusting a phase difference of image carriers to substantially "zero" level, image dots may be better transferred to a transfer member at each transfer position.

On one hand, if a pitch between adjacent image carriers may not be set to a value, which is equal to a length obtained by multiplying a circumference length of image carrier with an integral number (e.g., one, two, three), each of the image carriers may not rotate for an integral number (e.g., one, two, three) during a time when one toner image is transferred from one image carrier to a sheet at one transfer position and is moved to a next transfer position on a next image carrier. In such a case, a different phase may be set for each of the image carriers respectively, by which image dots may be transferred to a transfer member from each of the image carriers at each transfer position, defined by the transfer member and the each of the image carriers.

In addition to the above-explained method using a phase adjustment control, which may adjust a phase relationship of each of photoconductors having a speed variation in each of photoconductors, for suppressing superimposing-deviation of images due to an eccentricity of each photoconductor, another method (namely, adjusting a driving speed of a drive motor) may be used for suppressing superimposing-deviation of images due to an eccentricity of each photoconductor.

In such another method, the drive motor may be driven in a pattern, which may be an opposite phase relationship with a speed variation pattern, in which a speed variation of photoconductors may be suppressed by adjusting a driving speed of drive motor.

SUMMARY

An embodiment of the present invention provides an image forming apparatus comprising: latent image carriers; a transfer member to receive sequentially developed images from the image carriers while moving in a given direction there past; image detectors to detect conditions of images, respectively, formed on the transfer member; sensors to detect rotational displacements of the image carriers, respectively; and a controller. Such a controller can do at least the following: perform image-to-image displacement control by doing at least the following, forming a detection image on the transfer member, the detection image including images transferred from the image carriers, and detecting a condition of the detection image via the image detectors, and adjusting image forming timing on the image carriers, respectively; perform speed-variation detection control by doing at least the following, forming a speed-variation detection image on the transfer member, the speed-variation detection image including an image transferred from each of image carriers, detecting a condition of the speed-variation detection image via the image detectors, and determining speed variation of the image carriers, respectively, per one revolution based upon outputs of the image detectors and the sensors; and perform phase adjustment control by at least determining phase adjustments for the image carriers, respectively, based on the corresponding speed-variations. Such a controller further is operable to perform at least the phase adjustment control and the image-to-image displacement control before performing image forming operations on the image carriers, respectively.

An embodiment of the present invention provides an image forming apparatus comprising: latent image carriers; drivers to rotate the image carriers, respectively; a transfer member to receive sequentially developed images from the image carriers while moving in a given direction there past; image detectors to detect conditions of images, respectively, formed on the transfer member; sensors to detect rotational displacements of the image carriers, respectively; and a controller. Such a controller is operable to do at least the following: perform image-to-image displacement control by doing at least the following, forming a detection image on the transfer member, the detection image including images transferred from the image carriers, and detecting a condition of the detection image via the image detectors, and adjusting image forming timing on the image carriers, respectively; perform speed-variation detection control by doing at least the following, forming a speed-variation detection image on the transfer member, the speed-variation detection image including an image transferred from each of image carriers, detecting a condition of the speed-variation detection image via the image detectors, and determining speed variation of the image carriers, respectively, per one revolution based upon outputs of the image detectors and the sensors; and perform image-to-image displacement control by doing at least the following, determining first driving speed patterns for the drivers based on speed variation patterns, respectively, detected by the speed-variation detection control, determining second driving speed patterns based upon the first driving speed patterns and having reduced variation of surface speeds of the image carriers, respectively. Such a controller further is operable to do at least the following: perform the image-to-image displacement control while driving the image carriers with the second driving speed patterns, respectively, and perform an image forming operation via the image carriers.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
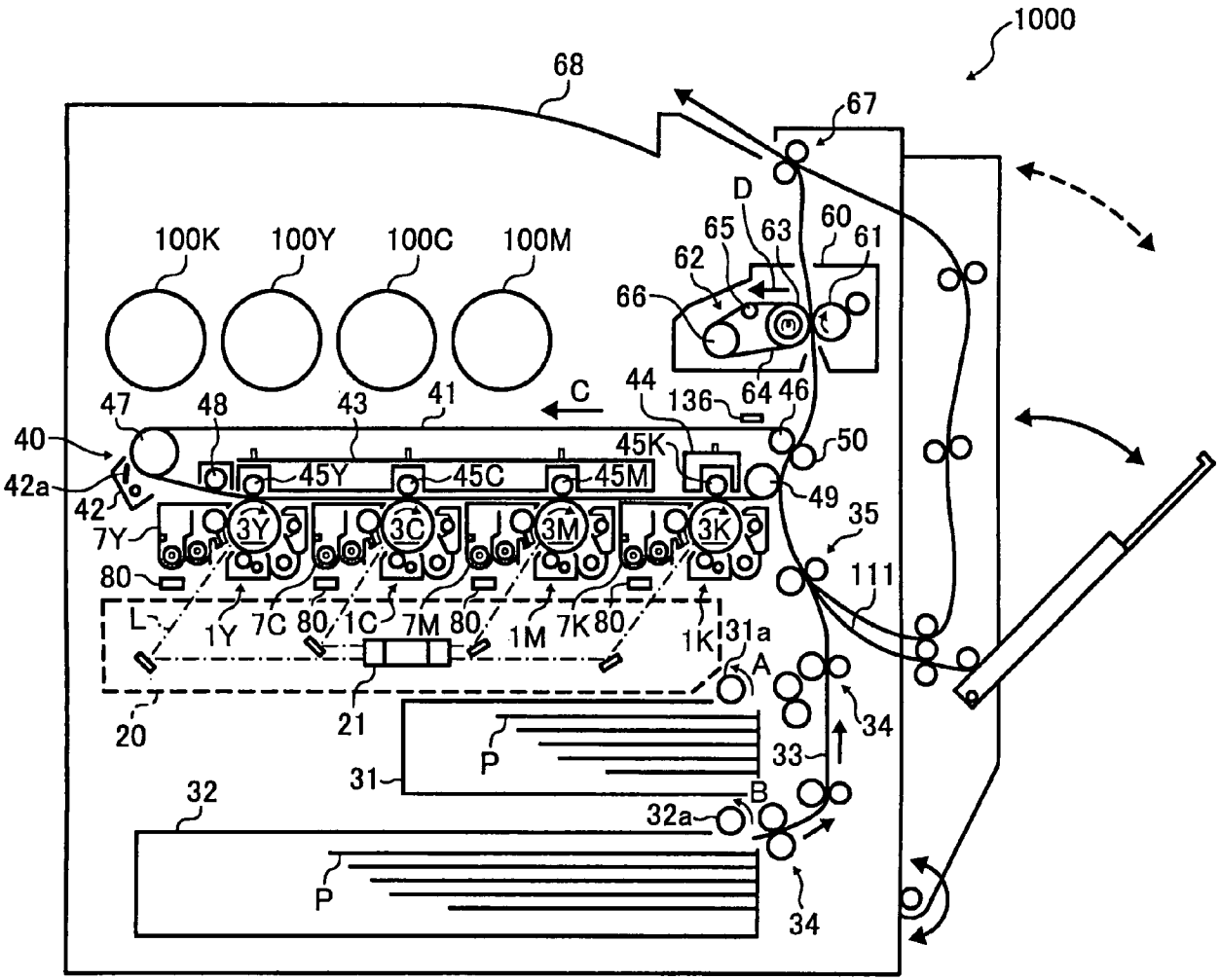
FIG. 1 is a schematic configuration of an image forming apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In view of background art, the inventors (while developing embodiments of the present invention) experimentally made a prototype image forming apparatus, which may conduct the above-explained adjustment control for writing timing of an optical unit, speed-variation detection control, and phase adjustment control. The inventors assumed that a superimposing-deviation of toner images may be effectively reduced by combining the above-mentioned control methods.

However, such prototype apparatus showed some superimposing-deviation of toner images in some experiments.

Such superimposing-deviation of toner images may be caused as discussed below.

In general, a speed variation per one revolution of an image carrier may be caused by an eccentricity of image carrier or drive-force transmitting member (e.g., gear).

Therefore, when the image carrier or drive-force transmitting member may be replaced with a new one, a speed variation per one revolution of image carrier or drive-force transmitting member may change.

When a sensor detects a replacement of image carrier, a writing timing of an optical unit may be adjusted by conducting adjustment work of an optical writing timing of an optical unit. Then, a phase of the each image carrier may be adjusted by a speed-variation detection control and phase adjustment control.

However, if such control process is conducted when the image carrier or drive-force transmitting member is replaced, a superimposing-deviation of images may become worse inversely.

Specifically, in a process of adjusting a writing timing of an optical unit for reducing a superimposing-deviation of images, a writing timing of optical unit may be determined based on a detected deviation level of superimposing-deviation of images.

If at least one of image carriers is replaced before adjusting a writing timing of optical unit, such image carriers may have a phase relationship, i.e., a non-negligible phase difference, which may make less effective the previously-determined level of phase adjustment.

In other words, a phase difference of image carriers becomes altered due to such replacement.

Under the above-mentioned altered phase relationship of image carriers, toner images may be formed on each of the image carriers, wherein such toner images may be used for detecting a superimposing-deviation of toner images.

Therefore, a writing timing of an optical unit may be adjusted to a value to suppress or reduce superimposing-deviation of toner images based on a detected deviation level as much as possible.

However, as above-mentioned, each of the image carriers may be in an altered phase relationship with each other because of replacement of image carrier.

If a speed-variation detection control and phase adjustment control may be conducted after determining the writing timing of the optical unit under such an altered phase relationship for image carriers, an undesirable phenomenon may occur, as follows.

Specifically, the writing timing of the optical unit, which is adjusted to a reference value in earlier timing, may be unintentionally changed to a distorted value, by which superimposing-deviation of images may become worse.

Herein, a replacement of an image carrier (e.g., a photoconductor) and/or a drive-force transmitting member (in some circumstances) can be realized by installing a new one. For example, a photoconductor installed in an image forming apparatus may be replaced with new photoconductor.

Furthermore, a replacement can (in some circumstances) also be realized by re-attaching a photoconductor or the like to an image forming apparatus after conducting maintenance work for an image forming apparatus, for example. In general, a photoconductor or the like may be removed from an image forming apparatus and reattached when maintenance work is conducted for an image forming apparatus.

If a position of a photoconductor and/or a drive-force transmitting member or the like may change due to such re-attachment, a speed variation pattern of photoconductor may change.

Also, in view of the background art, the inventors (while developing embodiments of the present invention) realized regarding the background art method of driving a drive motor according to an opposite phase relationship vis-à-vis a speed variation pattern, under a condition of replacement of a photoconductor, the above-mentioned drawbacks may similarly occur if a writing timing control of optical unit may be conducted by adjusting a driving speed of drive motor using a speed variation pattern detected before a replacement of photoconductor.

Referring now to the drawings, wherein like reference numerals designate identical or corresponding parts throughout the several views, an image forming apparatus according to an example embodiment is described with particular reference to FIG. 1.

FIG. 1 is a schematic configuration of the image forming apparatus 1000 according to an example embodiment of the present invention. The image forming apparatus 1000 may include a printer, for example, but is not limited to a printer.

As shown in FIG. 1, the image forming apparatus 1000 may include process units 1Y, 1C, 1M, and 1K, for example.

Each of the process units 1Y, 1C, 1M, and 1K may be used to form a toner image of yellow, magenta, cyan, and black, respectively. Hereinafter, reference characters of Y, M, C, and K are used to indicate each color of yellow, magenta, cyan, and black, as required.

The process units 1Y, 1C, 1M, and 1K may take a similar configuration for forming a toner image except toner colors (i.e., Y, M, C, and K toner). Accordingly, the process unit 1Y may be explained as a representative unit of the process units 1Y, 1C, 1M, and 1K, as required.

Figure 2:
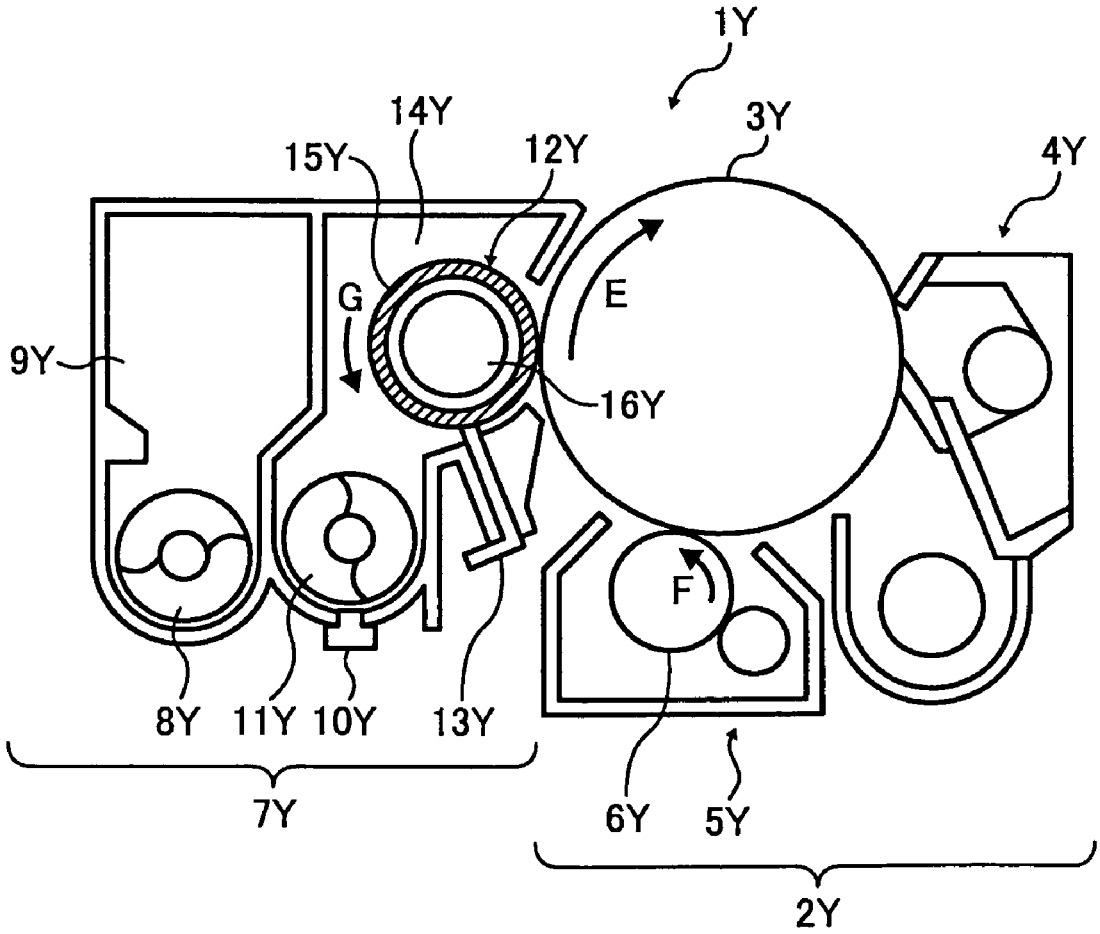
FIG. 2 is a schematic configuration (according to an example embodiment of the present invention) of a process unit of an image forming apparatus of FIG. 1.

For example, the process unit 1Y for forming Y toner image may include a photosensitive unit 2Y, and a developing unit 7Y as shown in FIG. 2.

Figure 3:
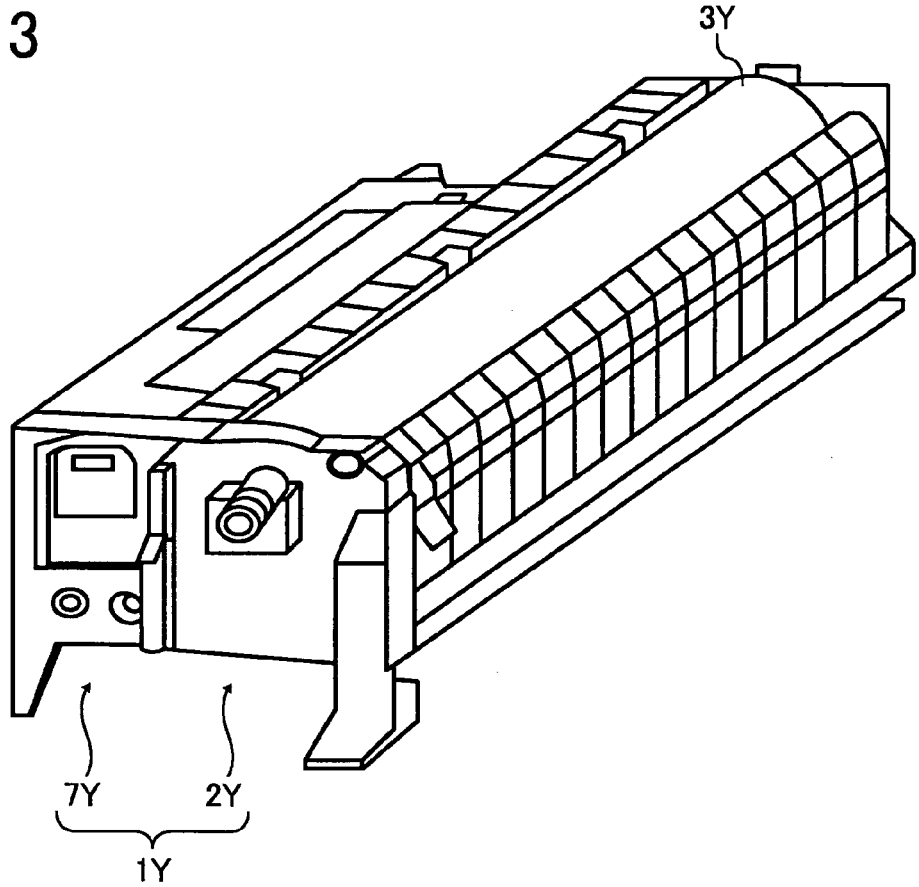
FIG. 3 is a perspective view (according to an example embodiment of the present invention) of a process unit of FIG. 2.

The photosensitive unit 2Y and developing unit 7Y may be integrated as the process unit 1Y as shown in FIG. 3. Such process unit 1Y may be detachable from the image forming apparatus 1000.

Figure 4:
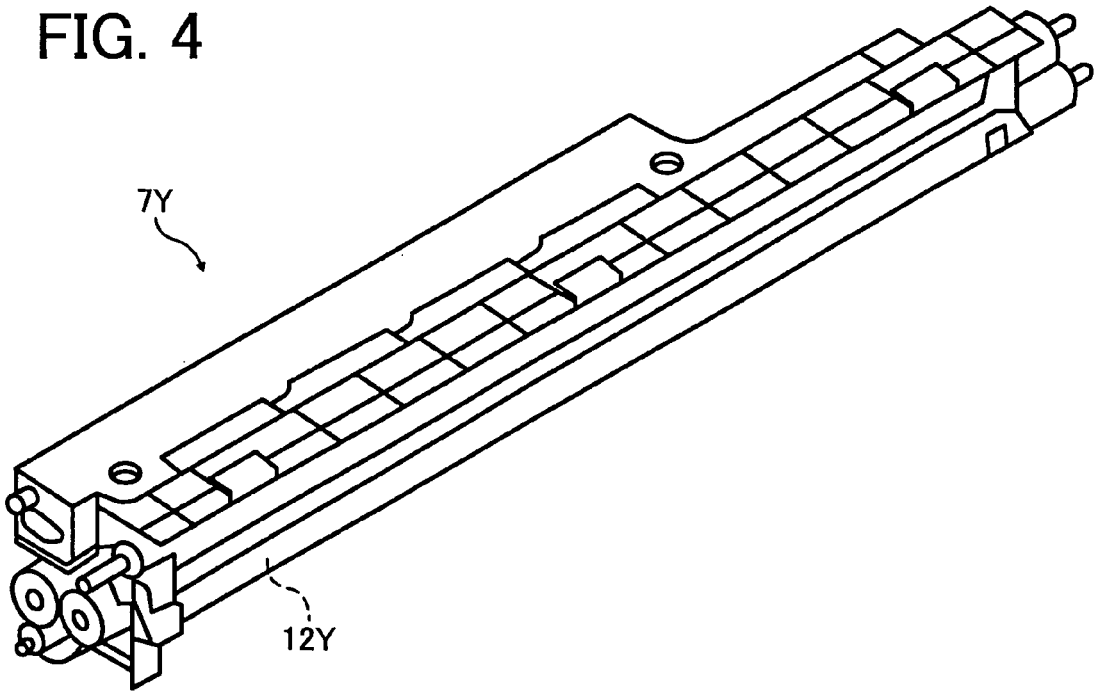
FIG. 4 is a perspective view (according to an example embodiment of the present invention) of a developing unit included in a process unit of FIG. 2.

When the process unit 1Y is removed from the image forming apparatus 1000, the developing unit 7Y may be further detachable from the photosensitive unit 2Y as shown in FIG. 4.

As shown in FIG. 2, the photosensitive unit 2Y may include a photoconductor 3Y, a cleaning unit 4Y, a charging unit 5Y, and a de-charging unit (not shown), for example.

The photoconductor 3Y, used as latent image carrier, may have a drum shape, for example.

The charging unit 5Y may uniformly charge a surface of the photoconductor 3Y, which may rotate in a clockwise direction in FIG. 2 by a driver (not shown).

The charging unit 5Y may include a contact type charger such as charging roller 6Y as shown in FIG. 2, for example.

The charging roller 6Y may be supplied with a charging bias voltage from a power source (not shown), and may rotate in a counter-clockwise direction when to uniformly charge the photoconductor 3Y. Instead of the charging roller 6Y, the charging unit 5Y may include a charging brush (not shown), for example.

Furthermore, the charging unit 5Y may include a non-contact type charger such as scorotron charger (not shown) to uniformly charge the photoconductor 3Y.

The surface of the photoconductor 3Y, uniformly charged by the charging unit 5Y, may be scanned by a light beam, emitted from an optical writing unit (to be described later), to form an electrostatic latent image for a yellow image on the photoconductor 3Y.

As shown in FIG. 2, the developing unit 7Y may include a first container 9Y having a first transport screw 8Y therein, for example.

The developing unit 7Y may further include a second container 14Y having a toner concentration sensor 10Y, a second transport screw 11Y, a developing roller 12Y, and a doctor blade 13Y, for example.

The toner concentration sensor 10Y may include a magnetic permeability sensor, for example.

The first container 9Y and second container 14Y may contain a Y-developing agent having magnetic carrier and Y toner. The Y toner may be negatively charged, for example.

The first transport screw 8Y, rotated by a driver (not shown), may transport the Y-developing agent to one end direction of the first container 9Y.

Then, the Y-developing agent may be transported into the second container 14Y through an opening (not shown) of a separation wall, provided between the first container 9Y and second container 14Y.

The second transport screw 11Y, rotated in the second container 14Y by a driver (not shown), may transport the Y-developing agent to one end direction of the second container 14Y.

The toner concentration sensor 10Y, attached to a bottom of the second container 14Y, may detect toner concentration in the Y developing agent, transported in the second container 14Y.

As shown in FIG. 2, the developing roller 12Y may be provided over the second transport screw 11Y while the developing roller 12Y and second transport screw 11Y may be provided in the second container 14Y in a parallel manner.

As shown in FIG. 2, the developing roller 12Y may include a developing sleeve 15Y, and a magnet roller 16Y, for example.

The developing sleeve 15Y may be made of non-magnetic material and formed in a pipe shape, for example. The magnet roller 16Y may be included in the developing sleeve 15Y, for example.

When the developing sleeve 15Y may rotate in a counter-clockwise direction in FIG. 2, a portion of the Y-developing agent, transported by the second transport screw 11Y, may be carried-up to a surface of the developing sleeve 15Y with an effect of magnetic force of the magnet roller 16Y.

The doctor blade 13Y, provided over the developing sleeve 15Y with a given space therebetween, may regulate a thickness of layer of the Y developing agent on the developing sleeve 15Y.

Such thickness-regulated Y developing agent may be transported to a developing area, which may face the photoconductor 3Y, with a rotation of the developing sleeve 15Y.

With such transportation of Y-developing agent, Y toner in Y-developing agent may be transferred to an electrostatic latent image formed on the photoconductor 3Y to develop Y toner image on the photoconductor 3Y.

The Y-developing agent, which loses the Y toner by such developing process, may be returned to the second transport screw 11Y with a rotation of the developing sleeve 15Y.

Such Y developing agent may be transported by the second transport screw 11Y and returned to the first container 9Y through the opening (not shown) of the separation wall.

The toner concentration sensor 10Y may detect permeability of the Y-developing agent, and transmit a detected permeability to a controller of the image forming apparatus 1000 as voltage signal.

The permeability of Y developing agent may correlate with Y toner concentration in the Y-developing agent.

Accordingly, the toner concentration sensor 10Y may output a voltage signal corresponding to a current Y toner concentration in the second container 14Y.

The controller may include a RAM (random access memory), which stores a reference value Vtref for voltage signal transmitted from the toner concentration sensor 10Y. The reference value Vtref may be set to a value, which is desirable for developing process.

The reference value Vtref may be set to a desirable toner concentration for each of yellow toner, cyan toner, magenta toner, and black toner. The RAM may store such reference value Vtref as data.

In case of the developing unit 7Y, the controller may compare a reference value Vtref for yellow toner concentration and an actual voltage signal transmitted from the toner concentration sensor 10Y.

Based on such comparison, the controller may drive a toner supplier (not shown) for a given time period to supply fresh Y toner to the developing unit 7Y.

With such process, fresh Y toner may be supplied to the first container 9Y, as required, by which Y toner concentration in the Y-developing agent in the first container 9Y may be maintained at a desirable level after the developing process, which consumes Y toner.

Accordingly, Y toner concentration in the Y-developing agent in the second container 14Y may be maintained at a given range.

Such toner supply control may be similarly conducted for process units 1C, 1M, and 1K using different color toners.

The Y toner image formed on the photoconductor 3Y may be then transferred to an intermediate transfer belt (to be described later).

After transferring Y toner image to the intermediate transfer belt, the cleaning unit 4Y of the photosensitive unit 2Y may remove toner particles remaining on the surface of the photoconductor 3Y.

After such removal of toner particles, the de-charging unit (not shown) may de-charge the surface of the photoconductor 3Y to prepare for a next image forming.

A similar transferring process for toner images may be conducted for process units 1C, 1M, and 1K. Specifically, M, C, and K toner images may be transferred to the intermediate transfer belt from the respective photoconductors 3C, 3M, and 3K, as similar to the photoconductor 3Y.

As shown in FIG. 1, the image forming apparatus 1000 may include an optical writing unit 20 under the process units 1Y, 1C, 1M, and 1K, for example.

The optical writing unit 20 may irradiate a light beam L to each of the photoconductors 3Y, 3C, 3M, and 3K of the respective process units 1Y, 1C, 1M, and 1K based on original image information.

With such process, electrostatic latent images for Y, M, C, and K may be formed on the respective photoconductors 3Y, 3C, 3M, and 3K.

The optical writing unit 20 may irradiate the light beam L to the photoconductors 3Y, 3C, 3M, and 3K with a polygon mirror 21 and other optical parts such as lens and mirror. The polygon mirror 21, rotated by a motor (not shown), may deflect a light beam coming from a light source (not shown). Such light beam then goes to the optical parts such as lens and mirror.

The optical writing unit 20 may include another configuration such as LED (light emitting diode) array for scanning the photoconductors 3Y, 3C, 3M, and 3K, with a laser beam, for example.

The image forming apparatus 1000 may further include a first sheet cassette 31 and a second sheet cassette 32 under the optical writing unit 20, for example.

As shown in FIG. 1, the first sheet cassette 31 and second sheet cassette 32 may be provided in a vertical direction each other, for example.

The first sheet cassette 31 and second sheet cassette 32 may store a bundle of sheets as recording media.

A top sheet in the first sheet cassette 31 or second sheet cassette 32 is referred as recording sheet P. The recording sheet P may contact to a first feed roller 31*a* or a second feed roller 32*a*.

When the first feed roller 31*a*, driven by a driver (not shown), may rotate in a counter-clockwise direction in FIG. 1, the recording sheet P in the first sheet cassette 31 may be fed to a sheet feed route 33, which extends in a vertical direction in a right side of the image forming apparatus 1000.

Similarly, when the second feed roller 32*a*, driven by a driver (not shown), may rotate in a counter-clockwise direction in FIG. 1, the recording sheet P in the second sheet cassette 32 may be fed to the sheet feed route 33.

The sheet feed route 33 may be provided with a plurality of transport rollers 34 as shown in FIG. 1.

The plurality of transport rollers 34 may transport the recording sheet P in one direction in the sheet feed route 33 (e.g., from lower to upper direction in the sheet feed route 33).

The sheet feed route 33 may also be provided with a registration roller 35 at the end of the sheet feed route 33.

The registration roller 35 may receive the recording sheet P, fed by the transport roller 34, and then the registration roller 35 may stop its rotation temporarily.

After such temporal stopping, the registration roller 35 may feed the recording sheet P to a secondary transfer nip (to be described later) at a given timing.

As shown in FIG. 1, the image forming apparatus 1000 may further include a transfer unit 40 over the process units 1Y, 1C, 1M, and 1K, for example.

The transfer unit 40 may include an intermediate transfer belt 41, a belt-cleaning unit 42, a first bracket 43, a second bracket 44, primary transfer rollers 45Y, 45C, 45M, and 45K, a back-up roller 46, a drive roller 47, a support roller 48, and a tension roller 49, for example.

The intermediate transfer belt 41 may be extended by the primary transfer rollers 45Y, 45C, 45M, and 45K, back-up roller 46, drive roller 47, support roller 48, and tension roller 49.

The intermediate transfer belt 41 may travel in a counter-clockwise direction in FIG. 1 in an endless manner with a driving force of the drive roller 47.

The primary transfer rollers 45Y, 45C, 45M, and 45K, photoconductors 3Y, 3C, 3M, and 3K may form primary transfer nips respectively while sandwiching the intermediate transfer belt 41 therebetween.

The primary transfer rollers 45Y, 45C, 45M, and 45K may apply a primary transfer biasing voltage, supplied from a power source (not shown), to an inner face of the intermediate transfer belt 41.

The primary transfer biasing voltage may have an opposite polarity (e.g., positive polarity) with respect to toner polarity (e.g., negative polarity).

The intermediate transfer belt 41 traveling in an endless manner may receive the Y, M, C, and K toner image from the photoconductors 3Y, 3C, 3M, and 3K at the primary transfer nips for Y, M, C, and K toner image in a super-imposing and sequential manner, by which the Y, M, C, K toner image may be transferred to the intermediate transfer belt 41.

Accordingly, the intermediate transfer belt 41 may have a four-color (or full color) toner image thereon.

As shown in FIG. 1, a secondary transfer roller 50, provided over an outer face of the intermediate transfer belt 41, may form a secondary transfer nip with the back-up roller 46 while sandwiching the intermediate transfer belt 41 therebetween.

The registration roller 35 may feed the recording sheet P to the secondary transfer nip at a given timing, which is synchronized to a timing for forming the four-color toner image on the intermediate transfer belt 41.

The secondary transfer roller 50 and back-up roller 46 may generate a secondary transfer electric field therebetween.

The four-color toner image on the intermediate transfer belt 41 may be transferred to the recording sheet P at the secondary transfer nip with an effect of the secondary transfer electric field and nip pressure.

After transferring toner images at the secondary transfer nip to the recording sheet P, some toner particles may still remain on the intermediate transfer belt 41.

The belt-cleaning unit 42 may remove such remaining toner particles from the intermediate transfer belt 41.

Specifically, the belt-cleaning unit 42 may remove toner particles remaining on the intermediate transfer belt 41 by contacting a cleaning blade 42*a* on the outer face of the intermediate transfer belt 41, for example.

The first bracket 43 of the transfer unit 40 may pivot with a given rotational angle at an axis of the support roller 48 with an ON/OFF of solenoid (not shown).

In case of forming a monochrome image with the image forming apparatus 1000, the first bracket 43 may be rotated in a counter-clockwise direction in FIG. 1 for some degree by activating the solenoid.

With such rotating movement of the first bracket 43, the primary transfer rollers 45Y, 45C, and 45M may revolve in a counter-clockwise direction around the support roller 48.

With such process, the intermediate transfer belt 41 may be spaced apart from the photoconductors 3Y, 3C, and 3M.

Accordingly, a monochrome image can be formed on the recording sheet by driving the process unit 1K while stopping other process units 1Y, 1C, and 1M.

Such configuration may reduce or suppress an aging of the process units 1Y, 1C, and 1M because the process units 1Y, 1C, and 1M may not be driven when a monochrome image forming is conducted.

As shown in FIG. 1, the image forming apparatus 1000 may include a fixing unit 60 over the secondary transfer nip, for example.

The fixing unit 60 may include a pressure roller 61 and a fixing belt unit 62, for example.

The fixing belt unit 62 may include a fixing belt 64, a heat roller 63, a tension roller 65, a drive roller 66, and a temperature sensor (not shown), for example. The heat roller 63 may include a heat source such as halogen lamp, for example.

The fixing belt 64, extended by the heat roller 63, tension roller 65, and drive roller 66, may travel in a counter-clockwise direction in an endless manner. During such traveling movement of the fixing belt 64, the heat roller 63 may heat the fixing belt 64.

As shown in FIG. 1, the pressure roller 61 facing the heat roller 63 may contact an outer face of the heated fixing belt 64. Accordingly, the pressure roller 61 and the fixing belt 64 may form a fixing nip.

The temperature sensor (not shown) may be provided over an outer face of the fixing belt 64 with a given space and near the fixing nip so that the temperature sensor may detect a surface temperature of the fixing belt 64, which is just going into the fixing nip.

The temperature sensor transmits a detected temperature to a power source circuit (not shown) as a signal. Based on such signal, the power source circuit may control a power ON/OFF to the heat source in the heat roller 63, for example.

With such controlling, the surface temperature of fixing belt 64 may be maintained at a given level such as about 140 degree Celsius, for example.

The recording sheet P passed through the secondary transfer nip may then be transported to the fixing unit 60.

The fixing unit 60 may apply pressure and heat to the recording sheet P at the fixing nip to fix the four-color toner image on the recording sheet P.

After the fixing process, the recording sheet P may be ejected to an outside of the image forming apparatus 1000 with an ejection roller 67.

The image forming apparatus 1000 may further include a stack 68 on a top of the image forming apparatus 1000. The recording sheet P ejected by the ejection roller 67 may be stacked on the stack 68.

The image forming apparatus 1000 may further include toner cartridges 100Y, 100C, 100M, and 100K over the transfer unit 40. The toner cartridges 100Y, 100C, 100M, and 100K may store Y, M, C, and K toner, respectively.

The Y, M, C, and K toner may be supplied from the toner cartridges 100Y, 100C, 100M, and 100K to the developing unit 7Y, 7C, 7M, and 7K of the process units 1Y, 1C, 1M, and 1K, as required.

The toner cartridges 100Y, 100C, 100M, and 100K and the process units 1Y, 1C, 1M, and 1K may be separately detachable from the image forming apparatus 1000.

Hereinafter, a drive-force transmitting configuration in the image forming apparatus 1000 is explained with reference to FIGS. 5 and 6. The drive-force transmitting configuration may be attached to a housing structure of the image forming apparatus 1000, for example.

Figure 5:
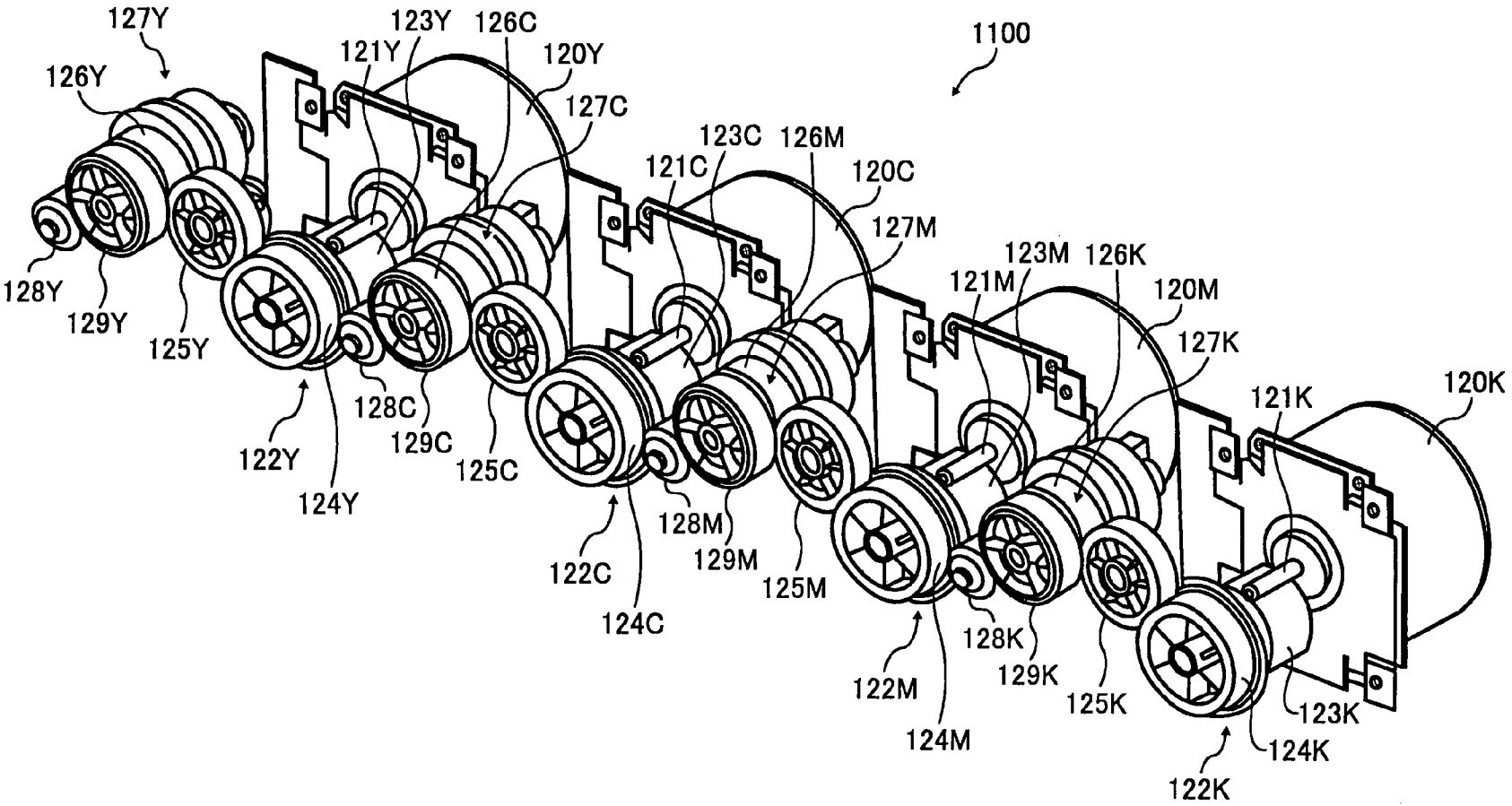
FIG. 5 is a perspective view (according to an example embodiment of the present invention) of a drive-force transmitting configuration in an image forming apparatus of FIG. 1.

FIG. 5 is a perspective view of a drive-force transmitting configuration in the image forming apparatus 1000. FIG. 6 is a top view of the drive-force transmitting configuration of FIG. 5.

As shown in FIG. 5, the image forming apparatus 1000 may include a support plate, to which process drive motors 120Y, 120C, 120M, and 120K may be attached.

The process drive motors 120Y, 120C, 120M, and 120K may drive the process unit 1Y, 1C, 1M, and 1K, respectively.

Each of the process drive motors 120Y, 120C, 120M, and 120K may have a shaft, to which drive gears 121Y, 121C, 121M, and 121K may be attached.

Under the shaft of the process drive motors 120Y, 120C, 120M, and 120K, developing gears 122Y, 122C, 122M, and 122K may be provided.

The developing gears 122Y, 122C, 122M, and 122K may drive the developing unit 7Y, 7M, 7C, and 7K.

The developing gears 122Y, 122C, 122M, and 122K may be engaged to a fixed shaft (not shown), protruded from the support plate S, and may rotate on the shaft.

Each of the developing gears 122Y, 122C, 122M, and 122K may include first gears 123Y, 123C, 123M, and 123K, and second gears 124Y, 124C, 124M, and 124K, respectively.

The first gear 123Y and second gear 124Y may rotate together on a common shaft. Other first gears 123C, 123M, and 123K, and second gears 124C, 124M, and 124K may also have a similar configuration.

Figure 6:
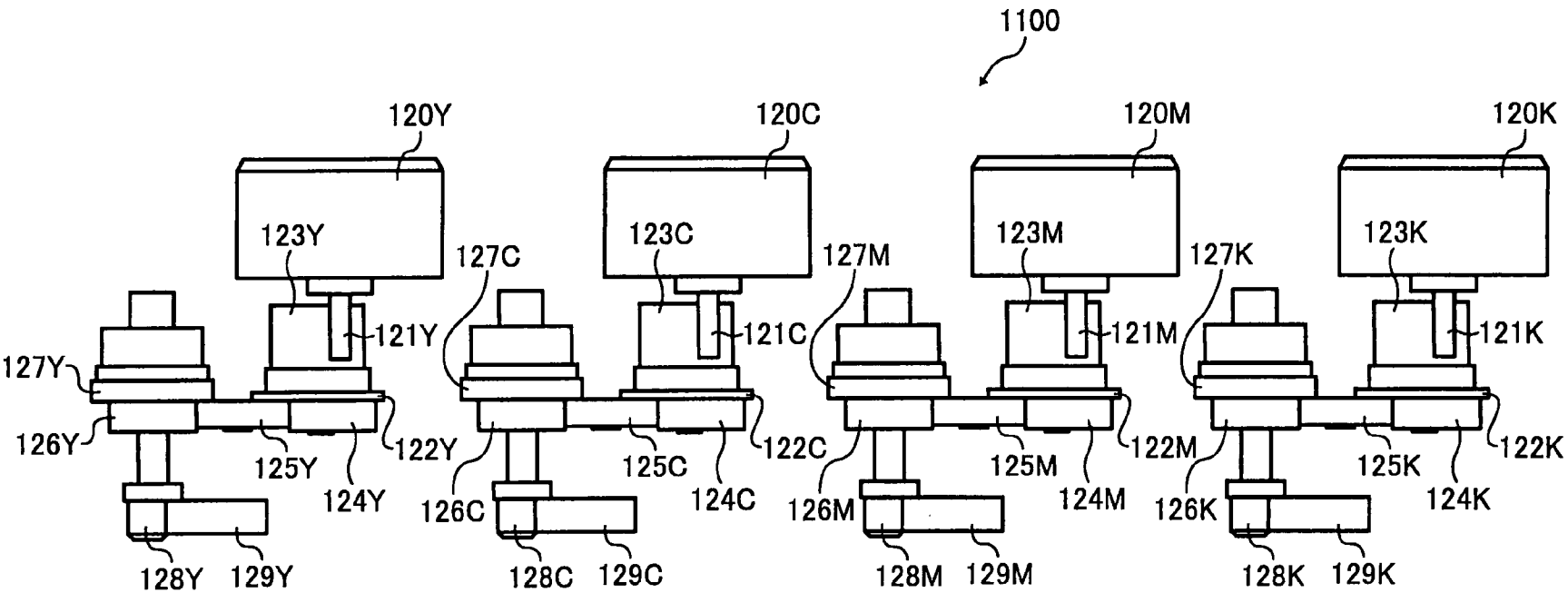
FIG. 6 is a top view (according to an example embodiment of the present invention) of a drive-force transmitting configuration of FIG. 5.

As shown in FIGS. 5 and 6, the first gears 123Y, 123C, 123M, and 123K may be provided between the process drive motors 120Y, 120C, 120M, and 120K, and the second gears 124Y, 124C, 124M, and 124K, respectively.

The first gears 123Y, 123M, 123C, and 123K may be meshed to the drive gears 121Y, 121C, 121M, and 121K of the process drive motors 120Y, 120C, 120M, and 120K, respectively.

Accordingly, the developing gears 122Y, 122M, 122C, and 122K may be rotatable by a rotation of the process drive motors 120Y, 120C, 120M, and 120K, respectively.

The process drive motors 120Y, 120C, 120M, and 120K may include a DC (direct current) brushless motor such as DC (direct current) servomotor, for example.

The drive gears 121Y, 121C, 121M, and 121K, and photoconductor gears 133Y, 133C, 133M, and 133K (see FIG. 8) have a given speed reduction ratio such as 1:20, for example.

Figure 8:
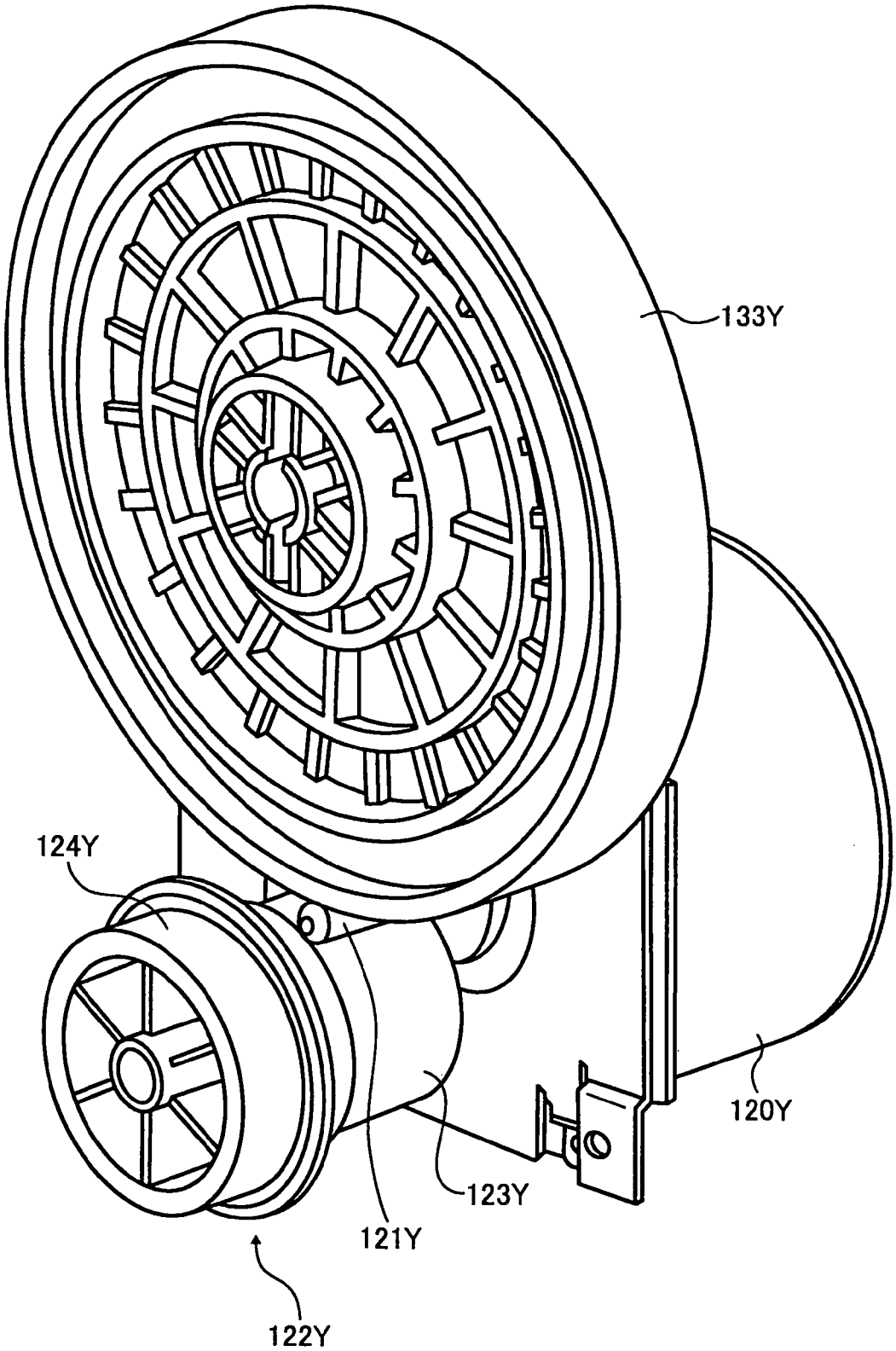
FIG. 8 is a perspective view (according to an example embodiment of the present invention) of a photoconductor gear and its surrounding configuration.

As shown in FIG. 8, a number of speed-reduction stages from the drive gear 121 to the photoconductor gear 133 may be set to one stage in an example embodiment.

In general, the smaller the number of parts or components, the smaller the manufacturing cost of an apparatus.

Furthermore, the smaller the number of gears used for speed-reduction, the smaller the effect of meshing or eccentricity error of gears, or drive-force transmitting error.

Accordingly, two gears (e.g., drive gear 121 and photoconductor gear 133) may be used for reducing a speed with one stage.

Such one-stage speed reduction may result into a relatively greater speed reduction ratio such as 1:20, by which a diameter of the photoconductor gear 133 may become greater than the photoconductor 3.

By using the photoconductor gear 133 having a greater diameter, a pitch deviation on a surface of the photoconductor 3 corresponding to one tooth meshing of gear may become smaller, by which an image degradation caused by uneven image-printing concentration in a sub-scanning direction may be reduced.

A speed reduction ratio may be set based on a relationship of a target speed of the photoconductor 3 and a physical property of the process drive motor 120. Specifically, a speed range may be determined to realize higher efficiency of motor such as reducing of motor energy loss and higher rotational precision of motor such as reducing uneven rotation of motor.

As shown in FIGS. 5 and 6, first linking gears 125Y, 125C, 125M, and 125K are provided at the left side of the developing gears 122Y, 122C, 122M, and 122K.

The first linking gears 125Y, 125C, 125M, and 125K may be rotatable on a fixed shaft (not shown), provided on the support plate.

As shown in FIGS. 5 and 6, the first linking gears 125Y, 125C, 125M, and 125K may be meshed to the second gears 124Y, 124C, 124M, and 124K of the developing gears 122Y, 122C, 122M, and 122K, respectively.

Accordingly, the first linking gears 125Y, 125C, 125M, and 125K may be rotatable with a rotation of the developing gears 122Y, 122C, 122M, and 122K, respectively.

As shown in FIG. 6, the first linking gears 125Y, 125C, 125M, and 125K may be meshed to the second gears 124Y, 124C, 124M, and 124K, respectively, at an up-stream side of drive-force transmitting direction.

As also shown in FIG. 6, the first linking gears 125Y, 125C, 125M, and 125K may also be meshed to clutch input gears 126Y, 126C, 126M, and 126K, respectively, at a down-stream side the drive-force transmitting direction.

As shown in FIGS. 5 and 6, the clutch input gears 126Y, 126C, 126M, and 126K may be supported by developing clutch 127Y, 127C, 127M, and 127K, respectively.

Each of the developing clutches 127Y, 127C, 127M, and 127K may be controlled by a controller of the image forming apparatus 1000.

Specifically, the controller may control a power-supply to the developing clutches 127Y, 127C, 127M, and 127K by conducing power ON/OFF to the developing clutches 127Y, 127C, 127M, and 127K.

Under a control by the controller, a clutch shaft of the developing clutches 127Y, 127C, 127M, and 127K may be engaged to the clutch input gears 126Y, 126C, 126M, and 126K to rotate with the clutch input gears 126Y, 126C, 126M, and 126K.

Or under a control by the controller, the clutch shaft of the developing clutches 127Y, 127C, 127M, and 127K may be disengaged from the clutch input gears 126Y, 126C, 126M, and 126K to rotate only the clutch input gears 126Y, 126C, 126M, and 126K, in which the clutch input gears 126Y, 126C, 126M, and 126K may be idling.

As shown in FIG. 6, clutch output gears 128Y, 128C, 128M, and 128K may be attached to an end of the clutch shaft of the developing clutches 127Y, 127C, 127M, and 127K, respectively.

When a power is supplied to the developing clutches 127Y, 127C, 127M, and 127K, the clutch shaft of the developing clutches 127Y, 127C, 127M, and 127K may be engaged to the clutch input gears 126Y, 126C, 126M, and 126K.

Then, a rotation of the clutch input gears 126Y, 126C, 126M, and 126K may be transmitted to the clutch shaft of the developing clutches 127Y, 127C, 127M, and 127K, by which the clutch output gears 128Y, 128C, 128M, and 128K may be rotated.

On one hand, when a power-supply to the developing clutches 127Y, 127C, 127M, and 127K is stopped, the clutch shaft of the developing clutches 127Y, 127C, 127M, and 127K may be disengaged from the clutch input gears 126Y, 126C, 126M, and 126K, by which only the clutch input gears 126Y, 126C, 126M, and 126K may be idling without rotating the clutch shaft of the developing clutches 127Y, 127C, 127M, and 127K.

Accordingly, the rotation of the clutch input gears 126Y, 126C, 126M, and 126K may not be transmitted to the clutch output gears 128Y, 128C, 128M, and 128K, respectively.

Therefore, a rotation of the clutch output gears 128Y, 128C, 128M, and 128K may be stopped because the process drive motors 120Y, 120C, 120M, and 120K may be idling.

As shown in FIG. 6, second linking gears 129Y, 129C, 129M, and 129K may be meshed at the right side of the clutch output gears 128Y, 128C, 128M, and 128K, respectively.

Accordingly, the second linking gears 129Y, 129C, 129M, and 129K may be rotatable with the clutch output gears 128Y, 128C, 128M, and 128K, respectively.

The above-described drive-force transmitting configuration in the image forming apparatus 1000 may transmit a drive force as below.

Specifically, a drive force may be transmitted with a sequential order beginning from the process drive motor 120, drive gear 121, first gear 123 and second gear 124 of developing gear 122, first linking gear 125, clutch input gear 126, clutch output gear 128, and to second linking gear 129.

Figure 7:
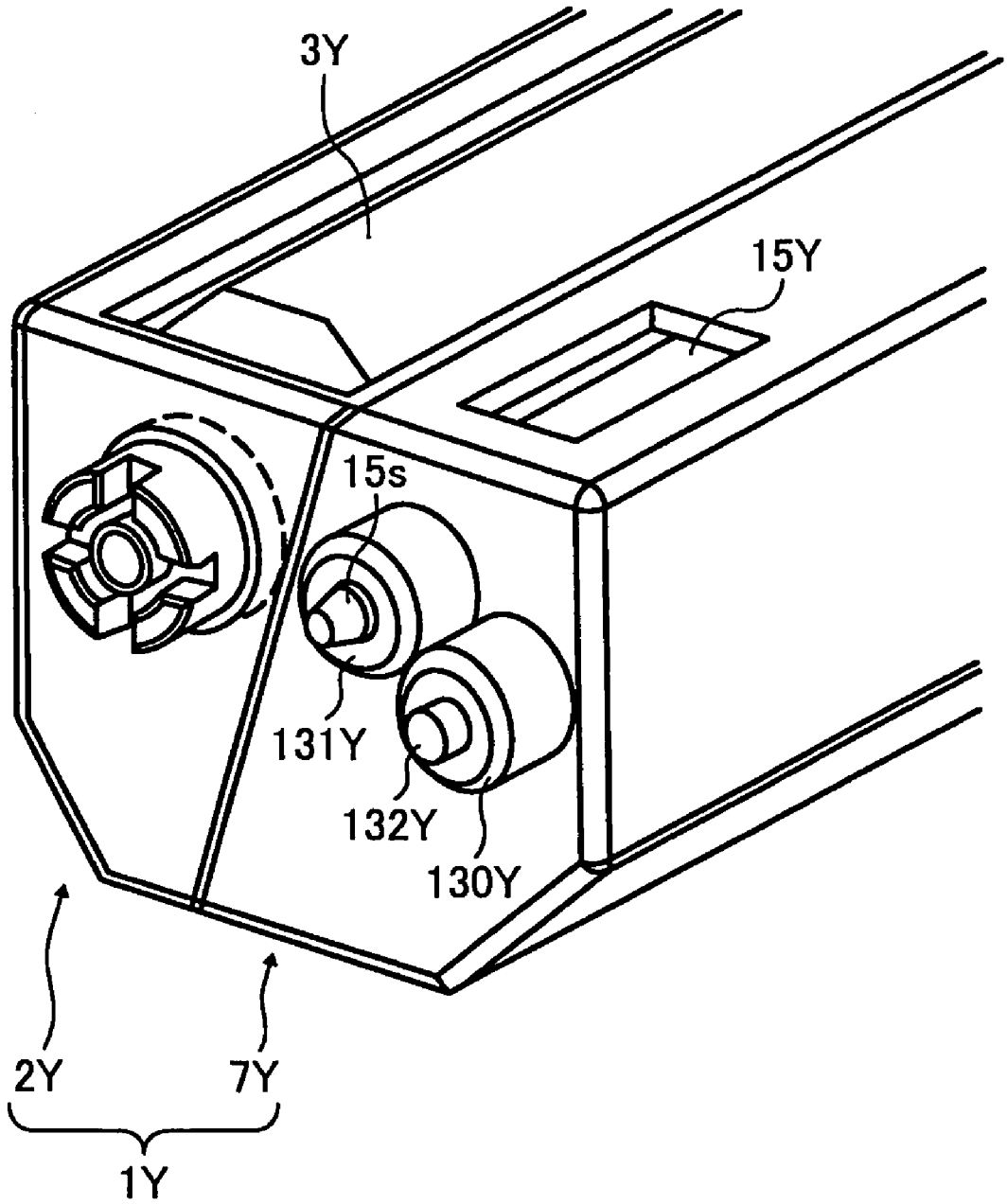
FIG. 7 is a partial perspective view (according to an example embodiment of the present invention) of one end of a process unit of FIG. 2.

FIG. 7 is a partial perspective view of the process unit 1Y.

The developing sleeve 15Y in the developing unit 7Y may have a shaft 15S, which protrudes from one end face of a casing of the developing unit 7Y as shown in FIG. 7.

As shown in FIG. 7, the shaft 15S may be attached with a first sleeve gear 131Y.

As also shown in FIG. 7, an attachment shaft 132Y may be protruded from the one end face of a casing of the developing unit 7Y.

The attachment shaft 132Y may be attached with a third linking gear 130Y rotatable with the attachment shaft 132Y. The third linking gear 130Y may mesh with the first sleeve gear 131Y as shown in FIG. 7.

When the process unit 1Y is installed in the image forming apparatus 1000, the third linking gear 130Y, meshing with the first sleeve gear 131Y, may mesh with the second linking gear 129Y shown in FIGS. 5 and 6.

Accordingly, a rotation of the second linking gear 129Y may be sequentially transmitted to the third linking gear 130Y, and then to the first sleeve gear 131Y, by which the developing sleeve 15Y may be rotated.

Similarly, a rotation may be transmitted to a developing sleeve of other process units 1C, 1M, and 1K in a similar manner.

FIG. 7 shows one end of the process unit 1Y. At the other end of the process unit 1Y, the shaft 15S of the developing sleeve 15Y may also protrude from the casing, and the protruded portion of the shaft 15S may be attached with a second sleeve gear (not shown).

Although not shown in FIG. 7, each of the first transport screw 8Y and second transport screw 10Y (see in FIG. 2) may have a shaft, which protrudes from the other end of the casing of the process unit 1Y.

The protruded portion of the shafts (not shown) of the first transport screw 8Y and second transport screw 10Y may be respectively attached with a first screw gear, and a second screw gear (not shown).

The second screw gear may mesh with the second sleeve gear (not shown), and also mesh with the first screw gear.

When the developing sleeve 15Y is rotated by a rotation of the first sleeve gear 131Y, the second sleeve gear at the other end of the process unit 1Y may also be rotated.

With a rotation of the second sleeve gear, the second screw gear is rotated, and then a driving force, transmitted from the second screw gear, may rotate the second transport screw 11Y.

Furthermore, the first screw gear meshed to the second screw gear may transmit a driving force to the first transport screw 8Y, by which the first transport screw 8Y may rotate.

A similar configuration may be applied to other process units 1C, 1M, and 1K.

As above described, each of the process units 1Y, 1C, 1M, and 1K may have a group of gears, which may be used for a developing process such as drive gear 121, developing gear 122, first linking gear 125, clutch input gear 126, clutch output gear 128, second linking gear 129, third linking gear 130, first sleeve gear 131Y, second sleeve gear, first screw gear, and second screw gear, for example.

FIG. 8 is a perspective view of the photoconductor gear 133Y and its surrounding configuration.

As shown in FIG. 8, the drive gear 121Y may mesh the first gear 123Y of developing gear 122Y, and the photoconductor gear 133Y.

With such configuration, the photoconductor gear 133Y, used as drive-force transmitting member, may be rotatable by the drive-force transmitting configuration of the image forming apparatus 100.

In an example embodiment, a diameter of the photoconductor gear 133Y may be set greater than a diameter of the photoconductor 3.

When the process drive motor 120Y rotates, a rotation of the process drive motor 120Y may be transmitted to the photoconductor gear 133Y via the drive gear 121 with one-stage speed reduction, by which the photoconductor 3 may rotate.

A similar configuration may be applied to other process units 1C, 1M, and 1K in the image forming apparatus 1000.

A shaft of the photoconductor 3 in the process unit 1 may be connected to the photoconductor gear 133 with a coupling (not shown) attached to one end of the shaft of photoconductor 3.

The photoconductor gear 133 may be supported by an internal structure of the image forming apparatus 1000, for example.

In the above explanation, one motor (e.g., process drive motor 120) may be used for driving gears. However, a plurality of motors may be used for driving gears. For example, a motor for driving the photoconductor gear 133, and a motor for driving the drive gear 121 may be a different motor for each of the process unit 1Y, 1C, 1M, and 1K.

Hereinafter, a configuration for controlling an image forming in the image forming apparatus 1000 is explained.

Figure 9:
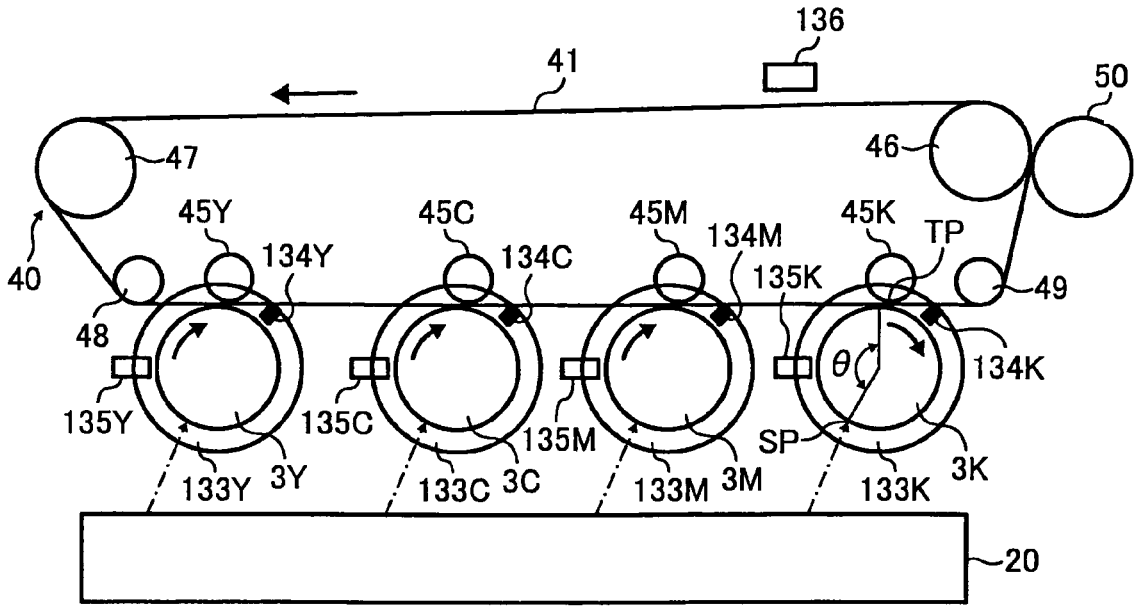
FIG. 9 is a schematic configuration (according to an example embodiment of the present invention) of photoconductors, a transfer unit, and an optical writing unit in an image forming apparatus of FIG. 1.

FIG. 9 is a schematic configuration of the photoconductors 3Y, 3C, 3M, and 3K, transfer unit 40, and optical writing unit 20 in the image forming apparatus 1000.

As shown in FIG. 9, the photoconductor gears 133Y, 133C, 133M, and 133K may respectively have markings 134Y, 134C, 134M, and 134K thereon at a given position.

A rotation of the photoconductor gears 133Y, 133C, 133M, and 133K may be transmitted to the respective photoconductors 3Y, 3C, 3M, and 3K.

As also shown in FIG. 9, the image forming apparatus 1000 may further include position sensors 135Y, 135C, 135M, and 135K. The position sensor 135 may include a photosensor, for example.

The position sensors 135Y, 135C, 135M, and 135K may detect the markings 134Y, 134C, 134M, and 134K at a given timing, respectively.

Specifically, the position sensors 135Y, 135C, 135M, and 135K may detect the markings 134Y, 134C, 134M, and 134K per one revolution of the photoconductor gears 133Y, 133C, 133M, and 133K, for example.

With such configuration, a rotational speed of the photoconductors 3Y, 3C, 3M, and 3K per one revolution may be detected.

In other words, a timing when the photoconductors 3Y, 3C, 3M, and 3K come to a given rotational angle may be detected with the position sensors 135Y, 135C, 135M, and 135K and markings 134Y, 134C, 134M, and 134K.

As shown in FIG. 9, an optical sensor unit 136 may be provided over the transfer unit 40, for example.

Figure 10:
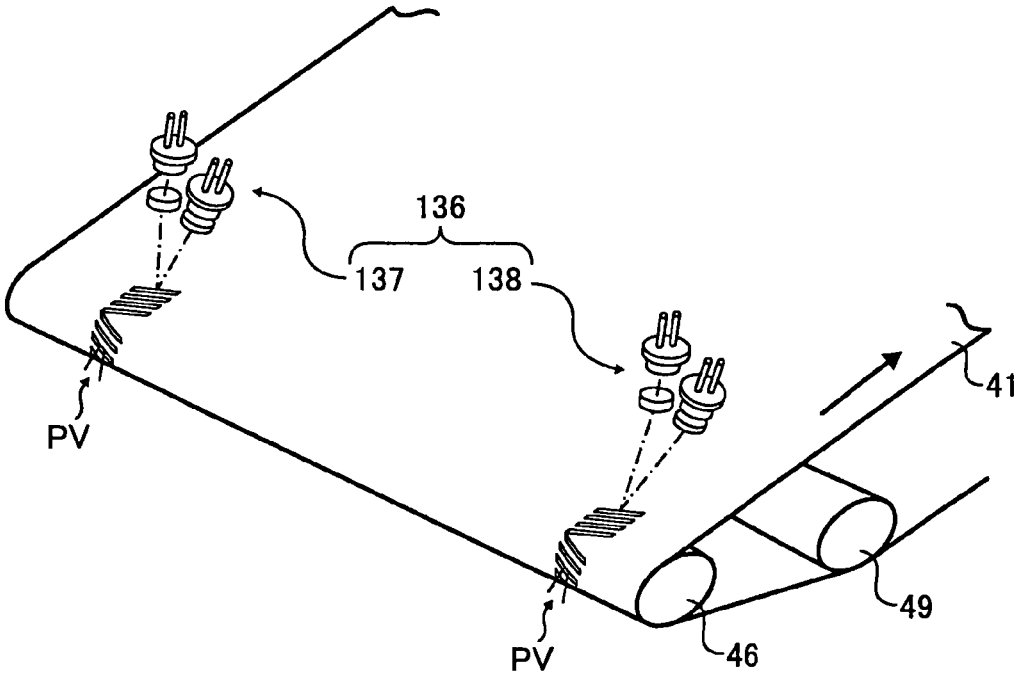
FIG. 10 is a perspective view (according to an example embodiment of the present invention) of an intermediate transfer belt with an optical sensor unit.

As shown in FIG. 10, the optical sensor unit 136 may include optical sensors 137 and 138 over the transfer unit 40, for example.

Such optical sensors 137 and 138 may be spaced apart each other in a width direction of the intermediate transfer belt 41, and the optical sensors 137 and 138 may be provided over the transfer unit 40 with a given space as shown in FIG. 10.

The optical sensors 137 and 138 may include a reflection type photosensor (not shown), for example.

In general, an image forming apparatus may be inevitably exposed to environmental conditions. For example, an image forming apparatus may be susceptible to a temperature change or an external force.

Such environmental condition may change a position or size of process unit although such change may be in a smaller scale.

Specifically, an external force may be applied to a process unit when a sheet jamming is corrected, when a part is replaced during maintenance work, and when an image forming apparatus is moved from one place to another place, for example.

Such temperature change or external force may affect an image forming operation conducted by each process unit, by which toner images produced by each process unit may not be superimposed in a higher precision.

In an example embodiment, the image forming apparatus 1000 may conduct a timing adjustment control at a given timing to suppress or reduce a superimposing deviation of toner images, wherein the given timing may include a timing when a power-supply switch is set to ON, and a timing when a given time has elapsed.

FIG. 10 is a perspective view of the intermediate transfer belt 41 and the optical sensor unit 136 having the optical sensors 137 and 138.

A controller of the image forming apparatus 1000 may conduct a timing adjustment control at a given timing. Such timing may include when a power-supply switch (not shown) is pressed to ON, when a given time period has elapsed, or the like, for example.

As shown in FIG. 10, the timing adjustment control may be conducted by forming a test image PV formed on a first and second lateral side of the intermediate transfer belt 41.

The test image PV may be used for detecting positional deviation of toner images formed on the intermediate transfer belt 41.

As shown in FIG. 10, the first and second lateral side may be opposite sides each other in a width direction of the intermediate transfer belt 41.

The test image PV for detecting positional deviation of toner images may be formed with a plurality of toner images, which will be described later.

The optical sensor unit 136, provided over the intermediate transfer belt 41, may include the optical sensors 137 and 138. The optical sensor 137 may be refereed as first optical sensor 137, and the optical sensor 138 may be refereed as second optical sensor 138, hereinafter.

The first optical sensor 137 may include a light source and a light receiver. A light beam emitted from the light source passes through a condenser lens, and reflects on a surface of the intermediate transfer belt 41. The light receiver receives the reflected light beam.

Based on a light intensity of the received light beam, the first optical sensor 137 may output a voltage signal.

When the toner images in the test image PV on the first lateral side of the intermediate transfer belt 41 passes through an area under the first optical sensor 137, a light intensity received by the light receiver of the first optical sensor 137 may change compared to before detecting the toner images in the test image PV.

The first optical sensor 137 may output a voltage signal corresponding to the light intensity received by the light receiver.

Similarly, the second optical sensor 138 may detect toner images in another test image PV formed on the second lateral side of the intermediate transfer belt 41.

As such, the first and second optical sensors 137 and 138 may detect toner images in the test image PV formed on the first and second lateral side of the intermediate transfer belt 41.

The light source may include an LED (light emitting diode) or the like, which can generate a light beam having a sufficient level of light intensity for detecting toner image.

The light receiver may include a CCD (charge coupled device), which has a number of light receiving elements arranged in rows, for example.

With such process, toner images in a test image PV formed on each lateral side of the intermediate transfer belt 41 may be detected.

Based on a detection result, a position of each toner image in a main scanning direction (i.e., scanning direction by a light beam), a position of each toner image in a sub-scanning direction (i.e., belt moving direction), multiplication constant error in a main scanning direction, a skew in a main scanning direction may be adjusted, for example.

Figure 11:
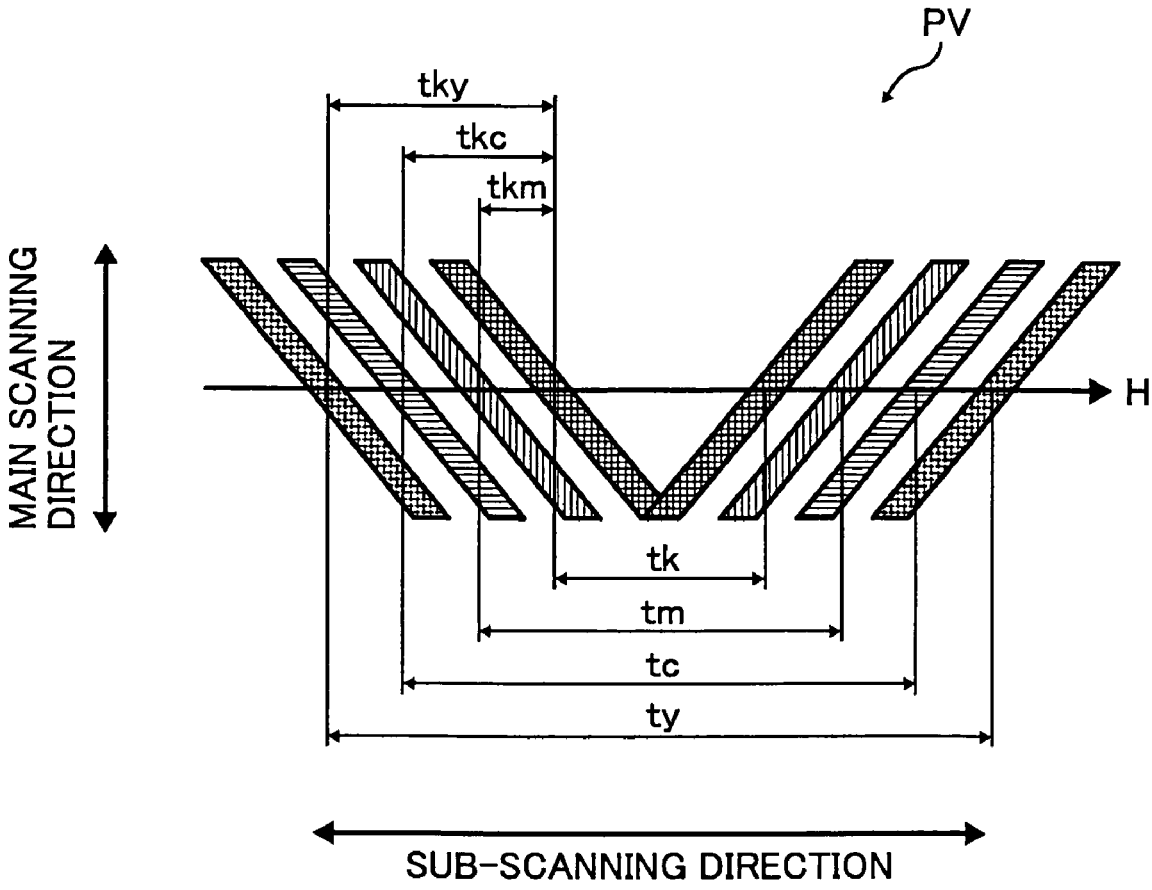
FIG. 11 is a schematic view (according to an example embodiment of the present invention) of an image pattern for detecting positional deviation of images.

As shown in FIG. 11, the test image PV may include a group of line images, in which toner images of Y, M, C, and K may be formed on the intermediate transfer belt 41 by inclining each line image approximately 45 degrees from the main scanning direction and setting a given pitch between each of the line images in a sub-scanning direction (or belt moving direction).

Although the line image patterns of Y, M, C, and K are slanted from the main scanning direction in FIG. 11, the line images of Y, M, C, and K may be formed on the intermediate transfer belt 41 without slanting from the main scanning direction. For example, line image patterns of Y, M, C, and K, which are parallel to the main scanning direction, may be formed on the on the intermediate transfer belt 41, for example.

In an example embodiment, a difference of detection timing between K toner image and each of other toner images (i.e., Y, M, C toner image) in one test image PV may be detected, for example.

In FIG. 11, line images of Y, M, C, and K may be lined from left to right, for example.

The K toner image may be used as reference color image, and a difference of detection timing between the K toner image and each of C, M, K toner images are referred as "tky, tkc, and tkm" in FIG. 11.

A difference between a measured value and a theoretical value of "tky, tkc, and tkm" may be compared to compute a deviation amount of each toner image in a sub-scanning direction.

The polygon mirror 21 may have regular polygonal shape such as a hexagonal shape, for example. Accordingly, the polygon mirror 21 has a plurality mirror faces having a similar shape.

If the polygon mirror 21 may have a hexagonal shape, the polygon mirror 21 has six mirror faces. If the polygon mirror 21 rotates for one revolution, an optical writing process may be conducted for six times (or six scanning lines) in a main scanning direction of an image carrier (e.g., photoconductor), which rotates during an optical writing process.

Accordingly, a pitch of scanning line in a sub-scanning direction may correspond to a moving distance of image carrier, which rotationally moves during a time period when a light beam coming from one mirror face of the polygon mirror 21 scans the image carrier.

Based on the computed deviation amount of the toner images, an optical-writing starting timing to the photoconductor 3Y, 3C, 3M, and 3K may be adjusted for each scanning line, corresponding to each mirror face of the polygon mirror 21 of the optical writing unit 20.

With such adjustment, a superimposing-deviation of toner images in the sub-scanning direction may be reduced.

In the above-described controlling, an image-to-image displacement may be detected and adjusted (or controlled), wherein the image-to-image displacement should be understood as including a situation that one color image and another color image may be incorrectly superimposed each other on the intermediate transfer belt 41.

An inclination (or skew) of each color toner image with respect to a main scanning direction may be determined based on a comparison of two toner images for same color formed on opposite lateral sides each other on the intermediate transfer belt 41. Specifically, a positional deviation between two toner images for same color in a sub-scanning direction may be detected by the optical sensor unit 136.

Based on such detected result, a lens adjustment mechanism (not shown) may adjust a position of a toroidal lens (not shown) in the optical writing unit 20, by which inclination (or skew) of each color toner image with respect to a main scanning direction may be reduced or suppressed.

In the image forming apparatus 1000, four light beams may be used for irradiating the respective photoconductors 3Y, 3C, 3M, and 3K.

Such light beams may be deflected by one common polygon mirror (i.e., polygon mirror 21), and then each of the light beams may scan each of the photoconductors 3Y, 3C, 3M, and 3K in a main scanning direction.

In such configuration, an optical-writing starting timing for each of the photoconductors 3Y, 3C, 3M, and 3K may be adjusted with a time value, obtained by multiplying a writing time of one line (i.e., one scanning line) with an integral number (e.g., one, two, three) when the timing adjustment control is conducted.

For example, assume that two photoconductors may have a superimposing-deviation in the sub-scanning direction (or surface moving direction of photoconductor 3) by more than "½ dot."

In this case, an optical-writing starting timing for one of the photoconductors may be delayed or advanced for a time value, which is obtained by multiplying a writing time for one line with an integral number (e.g., one, two, three times).

Specifically, when a superimposing-deviation amount in a sub-scanning direction is "¾ dot," an optical-writing starting timing may be delayed or advanced for a time value, obtained by multiplying a writing time for one line with an integral number of one.

When a superimposing-deviation amount in a sub-scanning direction is "7/4 dot," an optical-writing starting timing may be delayed or advanced for a time value, obtained by multiplying a writing time for one line with an integral number of two.

With such controlling, a superimposing-deviation in a sub-scanning direction may be suppressed ½ dot or less, for example.

However, if a superimposing-deviation amount in a sub-scanning direction is "½ dot," the above-explained method that delaying or advancing an optical-writing starting timing with a time value, obtained by multiplying a writing time for one line with an integral number, may not suppress or reduce the superimposing-deviation amount of "½ dot," but the superimposing-deviation amount of "½ dot" still remains as it is.

Furthermore, if a superimposing-deviation amount in a sub-scanning direction is less than "½ dot," the above-explained method that delaying or advancing an optical-writing starting timing with a time value, obtained by multiplying a writing time for one line with an integral number, may unfavorably increase the superimposing-deviation amount.

Accordingly, if a superimposing-deviation amount in a sub-scanning direction is less than ½ dot, an adjustment of optical-writing starting timing may not be conducted with the above-explained method that delaying or advancing an optical-writing starting timing with a time value, obtained by multiplying a writing time for one line with an integral number.

Such superimposing-deviation of less than ½ dot may not be caused by a surface speed variation of photoconductor 3 but may be caused by a deviation of optical-writing starting timing from an optimal timing. For example, if an image resolution level is 600 dpi (dot per inch), one dot may be about 42 μm, and thereby an image as a whole may be deviated for about 21 μm even if a timing adjustment control is conducted. As such, a superimposing-deviation of less than ½ dot may not be reduced by a timing adjustment control.

However, for coping with a recent market need for enhanced image quality, a superimposing-deviation of less than ½ dot may need to be reduced or suppressed.

In the image forming apparatus 1000, if a superimposing-deviation of less than ½ dot may be detected when conducting the timing adjustment control, then the CPU 146 may compute a drive-speed correction value corresponding to a deviation amount, and stores the computed drive speed correction value to a data storage device such as RAM.

When conducting a printing job in the image forming apparatus 1000, each of the photoconductors 3Y, 3C, 3M and 3K may be driven with a drive speed based on the computed drive-speed correction value. The printing job may be instructed from an external apparatus such as personal computer, which transmits image information to the image forming apparatus 1000, for example.

With such controlling for printing job, each of the photoconductors 3Y, 3M, 3C, and 3K may have a different linear velocity among the photoconductors 3Y, 3M, 3C, and 3K to reduce a superimposing-deviation of less than ½ dot, as required. Accordingly, a superimposing-deviation amount may be reduced to less than ½ dot.

However, if each of the photoconductors 3Y, 3M, 3C, and 3K may have a different linear velocity, a phase relationship of the photoconductors 3Y, 3M, 3C, and 3K may deviate from a desirable relationship when each of the photoconductors 3Y, 3M, 3C, and 3K may rotate for one time, two times, three times, and so on.

If a printing operation is conducted only one time, such phase deviation of the photoconductors 3Y, 3M, 3C, and 3K may not cause a significant trouble.

However, if a printing operation is conducted for a plurality of recording sheets continuously, a deviation of phase relationship among the photoconductors 3Y, 3M, 3C, and 3K may be accumulated when a number of printing sheets are increased, and a phase deviation may become unfavorably greater value due to the accumulated deviations of phase relationship among the photoconductors 3Y, 3M, 3C, and 3K.

In view of such situations, the image forming apparatus 1000 may include an image quality mode and a speed mode, for example.

The image quality mode may set a priority on an image quality. The speed mode may set a priority on a printing speed.

The image quality mode and speed mode may be selectable by operating a key on an operating panel (not shown) or by a print driver of a personal computer, for example.

If a continuous printing operation is conducted under a condition of the image quality mode, the continuous printing job may be suspended at a given timing (e.g., when a given number of sheets are continuously printed) to conduct an phase adjustment control at such given timing.

Figure 12:
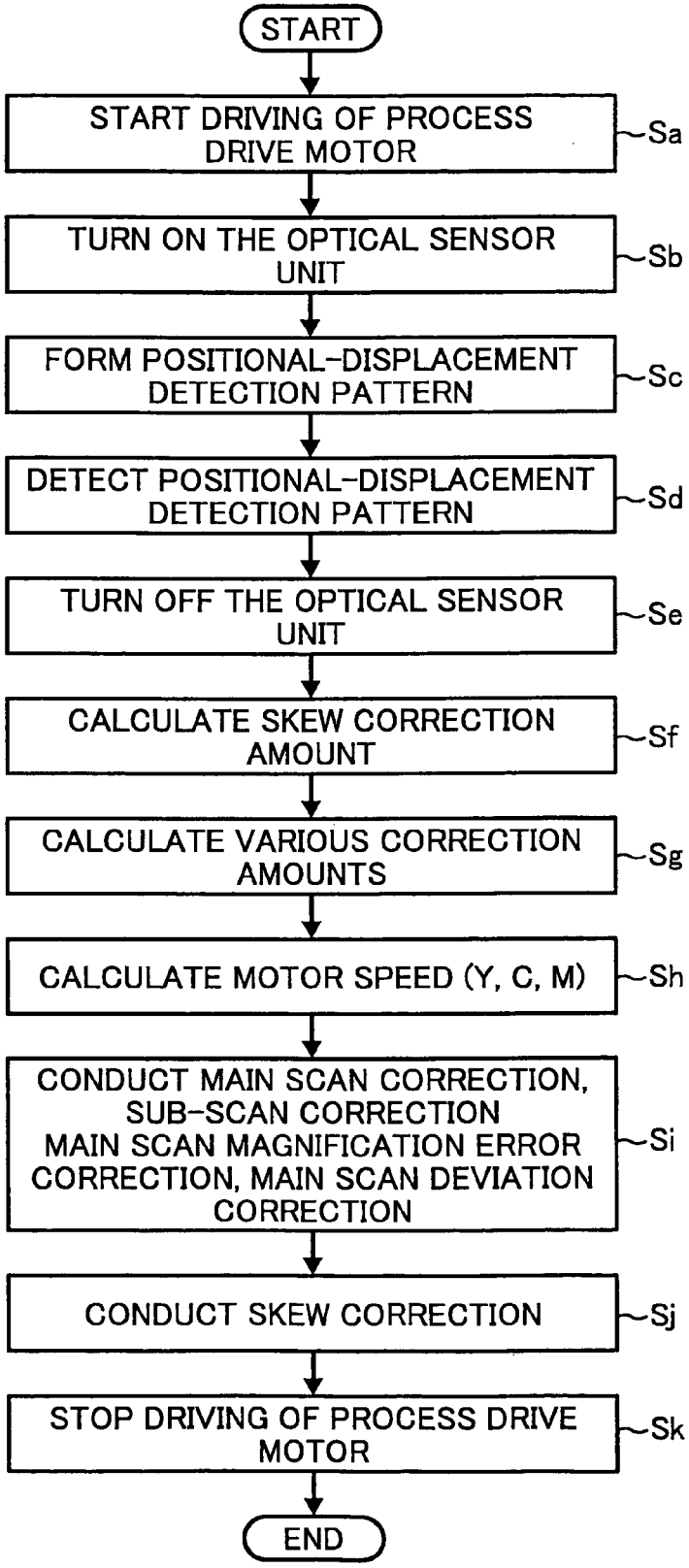
FIG. 12 is a flowchart (according to an example embodiment of the present invention) explaining a process for timing adjustment control conducted by a controller in an image forming apparatus.

FIG. 12 is a flowchart explaining a process for timing adjustment control conducted by a controller in the image forming apparatus 1000. With such timing adjustment control, an image-to-image displacement may be suppressed or reduced.

At step Sa, a controller may activate the process drive motors 120Y, 120C, 120M, and 120K.

At step Sb, the controller may activate the optical sensor unit 136 (e.g., turn ON the optical sensor unit 136).

At step Sc, the test image PV may be formed on the intermediate transfer belt 41.

At step Sd, the optical sensor unit 136 may sense the test image PV.

At step Se, the controller may deactivate the optical sensor unit 136 (e.g., turn OFF the optical sensor unit 136).

At steps Sf and Sg, based on a detection result of the test image PV, the controller may compute a skew correction value, a main scanning position correction value, a sub-scanning position correction value, a main scanning multiplication error correction value, and a main scanning deviation correction value for each color.

Furthermore, the controller may compute a speed of each of the process drive motors 120Y, 120C, 120M, and 120K to determine a line velocity difference such that positional deviation of less than ½ dot in a sub-scanning direction may be suppressed.

At step Sj, based on such correction values, the controller may conduct a skew correction, main scanning position correction, sub-scanning position correction, main scanning multiplication error correction, and main scanning deviation correction.

At step Sk, the controller may deactivate the process drive motors 120Y, 120C, 120M, and 120K.

The controller of the image forming apparatus 1000 may conduct a speed-variation detection control and phase adjustment control for each of photoconductors at a given timing.

Such given timing may include a timing when a photoconductor is replaced, a timing when a print command is issued when a high quality mode is selected for image forming, for example. A replacement of a photoconductor may change speed variation pattern and phase adjustment of a photoconductor.

Figure 13:
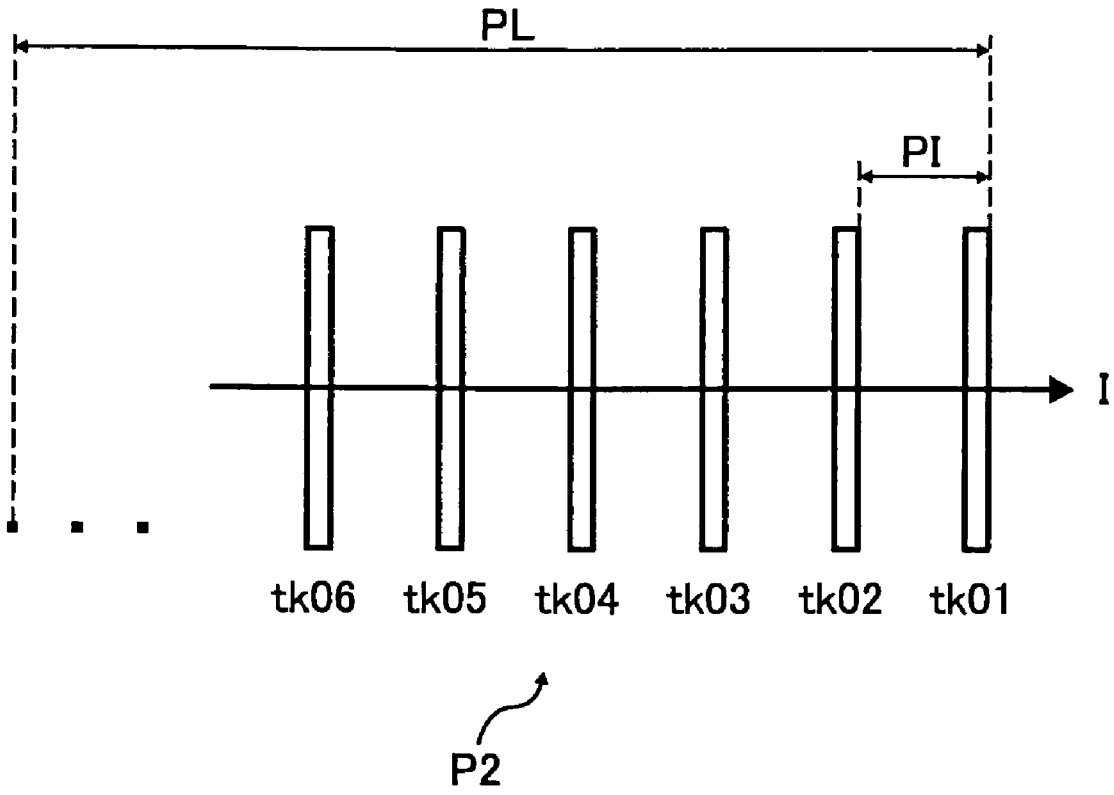
FIG. 13 is a schematic view (according to an example embodiment of the present invention) of a speed-variation detection image to be used for a phase adjustment of photoconductors.

In case of phase adjustment control of photoconductors for Y, M, C, K, speed-variation detection image may be formed on the intermediate transfer belt 41 as shown in FIG. 13.

For example, a plurality of K toner images (e.g., tk01, tk02, tk03, tk04, tk05, tk06) may be formed with a given pitch in a belt moving direction.

Although the plurality of K toner images (e.g., tk01, tk02, tk03, tk04, tk05, tk06) may be formed with such given pitch, a speed variation of photoconductor 3K may cause the plurality of K toner images to be formed with an actual pitch deviated from such given pitch.

Such deviation for pitch may be read as time pitch error by the first optical sensor 137 or second optical sensor 138.

In the image forming apparatus 1000, a speed-variation detection control may be conducted by forming a speed-variation detection image of Y color and a speed-variation detection image of K color as one set.

Similarly, a speed-variation detection image of C color and a speed-variation detection image of K color may be formed as one set.

Similarly, a speed-variation detection image of M color and a speed-variation detection image of K color may be formed as one set.

Specifically, in case of one set of Y and K color, the speed-variation detection image of Y color may be formed on a first lateral side of the intermediate transfer belt 41, and the speed-variation detection image of K color may be formed on a second lateral side of the intermediate transfer belt 41, for example.

The speed-variation detection image of Y color may be detected with the first optical sensor 137, and the speed-variation detection image of K color may be detected with the second optical sensor 138, wherein the first optical sensor 137 and second optical sensor 138 may detect one set of speed-variation detection images formed on the intermediate transfer belt 41 in a substantially concurrent manner, for example.

A similar process may be applied to one set of the speed variation images C and K, and one set of speed variation images M and K, wherein the first optical sensor 137 and second optical sensor 138 may detect one set of speed-variation detection images formed on the intermediate transfer belt 41 in a substantially concurrent manner.

In other words, the image forming apparatus 1000 may conduct three processes for the speed-variation detection control: a process of forming speed-variation detection images for Y and K color, and detecting such images with the optical sensor unit 136; a process of forming speed-variation detection images for C and K color, and detecting such images with the optical sensor unit 136; and a process of forming speed-variation detection images for M and K color, and detecting such images with the optical sensor unit 136. The speed-variation detection control process will be described later.

As shown in FIG. 1, the intermediate transfer belt 41 may pass through the secondary transfer nip, defined by the secondary transfer roller 50 and the intermediate transfer belt 41, before the intermediate transfer belt 41 may come to a position facing the optical sensor unit 136.

Accordingly, the above-mentioned test image PV or speed-variation detection image, formed on the intermediate transfer belt 41, may contact the secondary transfer roller 50 at the secondary transfer nip before the intermediate transfer belt 41 may come to the position facing the optical sensor unit 136.

If the secondary transfer roller 50 may contact the intermediate transfer belt 41 at the secondary transfer nip, the above-mentioned test image PV or speed-variation detection image may be transferred to a surface of the secondary transfer roller 50 from the intermediate transfer belt 41.

Accordingly, in an example embodiment, a roller engagement unit (not shown) may be activated to discontact (or separate) the secondary transfer roller 50 from the intermediate transfer belt 41 before the above-mentioned timing adjustment control or speed-variation detection control is conducted in the image forming apparatus 1000.

With such configuration, the above-mentioned test image PV or speed-variation detection image may not be transferred to the secondary transfer roller 50.

Hereinafter, a circuit configuration for controller controlling the image forming apparatus 1000 is explained with FIG. 14.

Figure 14:
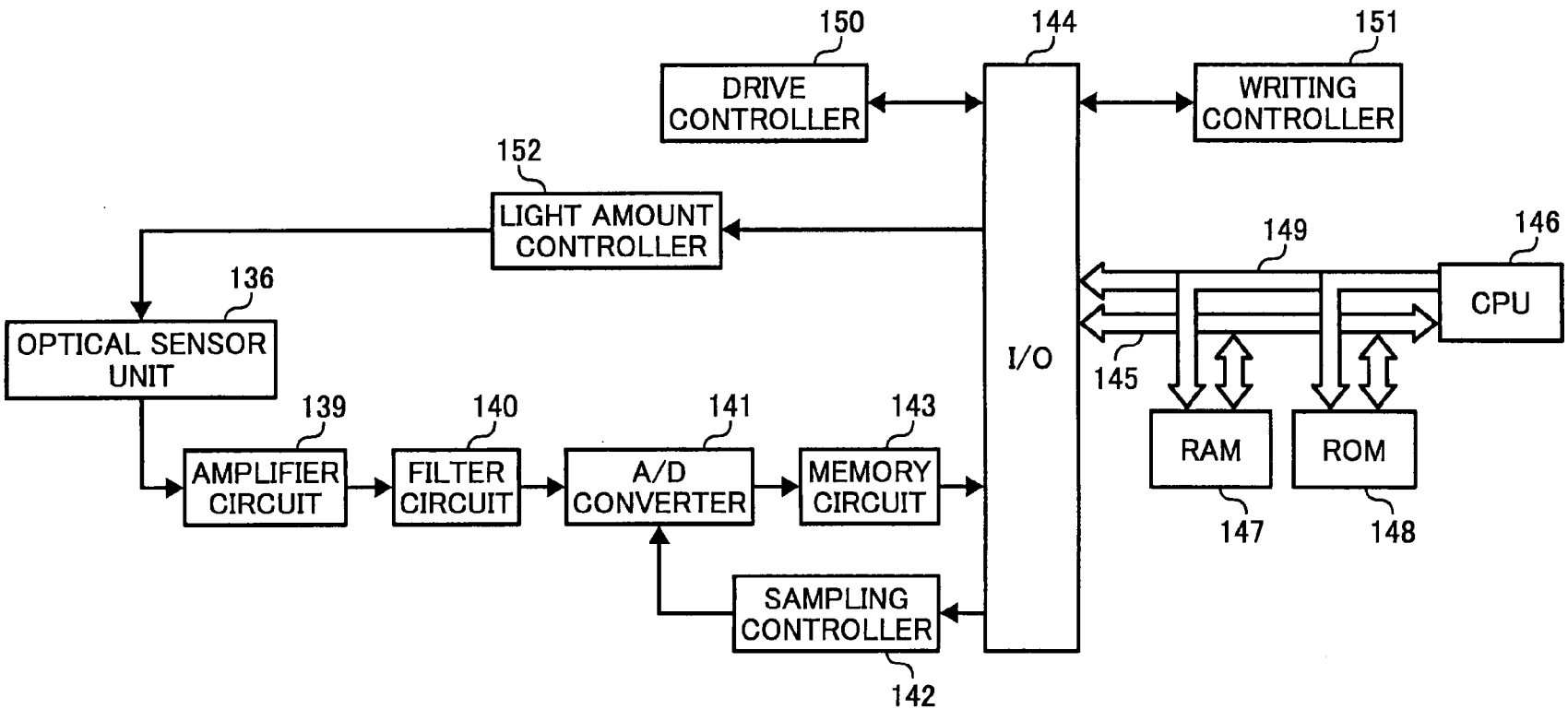
FIG. 14 is a block diagram (according to an example embodiment of the present invention) explaining a circuit configuration of a controller of an image forming apparatus of FIG. 1.

FIG. 14 is a block diagram of a circuit configuration of the controller of the image forming apparatus 1000.

The circuit configuration may include the optical sensor unit 136, an amplifier circuit 139, a filter circuit 140, an A/D (analog/digital) converter 141, a sampling controller 142, a memory circuit 143, an I/O (input/output) port 144, a data bus 145, a CPU (central processing unit) 146, a RAM (random access memory) 147, a ROM (read only memory) 148, an address bus 149, a drive controller 150, a writing controller 151, and a light amount controller 152.

When the timing adjustment control or speed-variation detection control is conducted, the optical sensor unit 136 may transmit a signal to the amplifier circuit 139, and the amplifier circuit 139 may amplify and transmit the signal to the filter circuit 140.

The filter circuit 140 may select a line detection signal, and transmit the selected signal to the A/D converter 141, at which analog data may be converted to digital data.

The sampling controller 142 may control data sampling, and the sampled data may be stored in the memory circuit 143 by FIFO (first-in first-out) manner.

When a detection of the test image PV or speed-variation detection image is completed, the data stored in the memory circuit 143 may be loaded to the CPU 146 and RAM 147 via the I/O port 144 and data bus 145.

The CPU 146 may conduct arithmetic processing to compute deviation amount such as positional deviation of each toner image, skew deviation, phase deviation of each image carriers (e.g., photoconductor), for example.

The CPU 146 may also conduct arithmetic processing for computing multiplication rate for each toner image in main scanning direction and sub-scanning direction, for example.

The CPU 146 may store data to the drive controller 150 or writing controller 151 such computed data for deviation amount.

The drive controller 150 or writing controller 151 may conduct correction operation with such data.

Such correction operation may include skew correction of each toner image, image position correction in a main scanning direction, image position correction in a sub-scanning direction, and multiplication rate correction, for example.

The drive controller 150 may control the process drive motors 120Y, 120C, 120M, and 120K, which drives the photoconductors 3Y, 3M, 3M, and 3K, respectively. The writing controller 151 may control the optical writing unit 20.

The writing controller 151 may adjust a writing-starting position in a main scanning direction and sub-scanning direction for the photoconductors 3Y, 3M, 3M, and 3K based on data transmitted from the CPU 146.

The writing controller 151 may also include a device such as clock generator using VCO (voltage controlled oscillator) to set output frequency precisely. In the image forming apparatus 1000, an output of the clock generator may be used as image clock.

The drive controller 150 may generate drive-control data to control the process drive motors 120Y, 120C, 120M, and 120K, based on data transmitted from the CPU 146, to adjust a phase of each of the photoconductors 3Y, 3C, 3M, and 3K per one revolution at a given level.

In the image forming apparatus 1000, the light amount controller 152 may control light intensity of the light source of the optical sensor unit 136. With such controlling, the light intensity of the light source of the optical sensor unit 136 may be maintained at a desirable level.

The ROM 148, connected to the data bus 145, may store programs such as algorithm for computing the above-mentioned deviation amount, a program for conducting printing job, and a program for conducting a timing adjustment control, speed-variation detection control, phase adjustment control, for example.

The CPU 146 may designate ROM address, RAM address, and input/output units via the address bus 149.

As shown in FIG. 13, the speed-variation detection image may include a plurality of toner images for same color, which are formed on the intermediate transfer belt 41 with a given pitch in a sub-scanning direction (or belt moving direction).

A pitch PI, shown in FIG. 13, for toner images in one speed-variation detection image may be set to a smaller value.

However, the pitch PI may not be set too-small value because of a width limitation for image forming and computing time limitation, for example.

Furthermore, a length PL of the speed-variation detection image in a sub-scanning direction (or belt moving direction) may be set to a length, which may be obtained by multiplying the circumference length of the photoconductor 3 with an integral number (e.g., one, two, three).

When to set the length PL, cyclical deviations not related to the photoconductor 3 may need to be considered.

Such other cyclical deviations may occur when a speed-variation detection image is formed on the intermediate transfer belt 41 or when conducting the speed-variation detection control.

Such other cyclical deviations may include various types of frequency components such as: 1) linear velocity deviation of the drive roller 47 per one revolution, wherein the drive roller 47 may drive the intermediate transfer belt 41, 2) tooth pitch deviation or eccentricity of gears, which drives the intermediate transfer belt 41 or transmits a driving force to the intermediate transfer belt 41, 3) a meandering of intermediate transfer belt 41, and 4) a thickness deviation in the intermediate transfer belt 41 in a circumferential direction, for example.

In general, when the speed variation image is detected, a detected value may include such cyclical deviation components.

Therefore, a speed variation component of the photoconductor 3 per one revolution may need to be detected by extracting such cyclical deviation components, which may be unnecessary.

For example, assume an example case that, in addition to a speed variation component of the photoconductor 3 per one revolution, a speed variation component of the drive roller 47 per one revolution may be included in a time-pitch error when conducting a speed-variation detection image. The drive roller 47 may be used to drive intermediate transfer belt 41.

In such a case, a speed variation component of the drive roller 47 may need to be reduced or suppressed to set the length PL for the speed-variation detection image at a desired level.

For example, the photoconductor 3 may have a diameter of 40 mm, and the drive roller 47 may have a diameter of 30 mm.

In such condition, one cycle of photoconductor 3 and one cycle of drive roller 47 may become 125.7 mm and 94.2 mm, respectively. The one cycle can be calculated by a formula of "$2\pi r$," wherein "r" is a radius of circle.

For example, a common multiple of such two cycles may be used to set a length PL for speed-variation detection control.

For example, the common multiple of 125.7 mm and 94.2 mm may become 377 mm, by which the length PL may be set to 377 mm.

Based on such length PL, the controller may be set the pitch PI of each toner image in the speed-variation detection image.

With such setting, the controller may compute a maximum amplitude or phase value of speed variation image of the photoconductor 3 per one revolution with a higher precision by reducing an effect of cyclical deviation component of drive roller 47.

Such computation of maximum amplitude or phase value may be possible because a computing term of the cyclical deviation component related to the drive roller 47 may be set to substantially "0."

Similarly, if a cyclical deviation component by thickness deviation of the intermediate transfer belt 41 in a circumferential direction may be included in a time-pitch error for speed-variation detection image, the length PL of the speed-variation detection image may be set as below.

Specifically, the length PL of the speed-variation detection image may be obtained by (1) multiplying the circumference length of photoconductor 3 with an integral number (e.g., one, two, three times), and (2) selecting a value which is most closer to one lap of the intermediate transfer belt 41 from such integrally multiplied values.

With such setting, an effect of cyclical deviation component of intermediate transfer belt 41 may be reduced or suppressed.

Furthermore, a cyclical deviation component of a motor (not shown), which drives the drive roller 47, may have a different frequency with respect to a cyclical deviation component of photoconductor 3.

If such cyclical deviation component of the drive motor (not shown) may become ten (10) times or more of a cyclical deviation component of photoconductor 3, for example, such cyclical deviation component of the drive motor may be removed by a low-pass filter, for example.

A pulse width for each pulse data, stored in the memory circuit 143, may vary depending on light intensity of light, which is received by the light receiver of the optical sensor unit 136.

The light intensity of light, received by the light receiver, may vary depending on a concentration level of toner image formed on the immediate transfer belt 41.

Accordingly, the pulse width for each of pulse data, stored in the memory circuit 143, may vary depending on a concentration of toner image formed on the immediate transfer belt 41.

In case of timing adjustment control or speed-variation detection control, each toner image in the test image PV or speed-variation detection image may need to be detected with higher precision.

When to conduct such image detection with higher precision, the CPU 146 may need to recognize a position of each pulse even if each pulse may have a different shape in pulse width as shown in FIGS. 16*b* and 16*c*.

Figure 16:
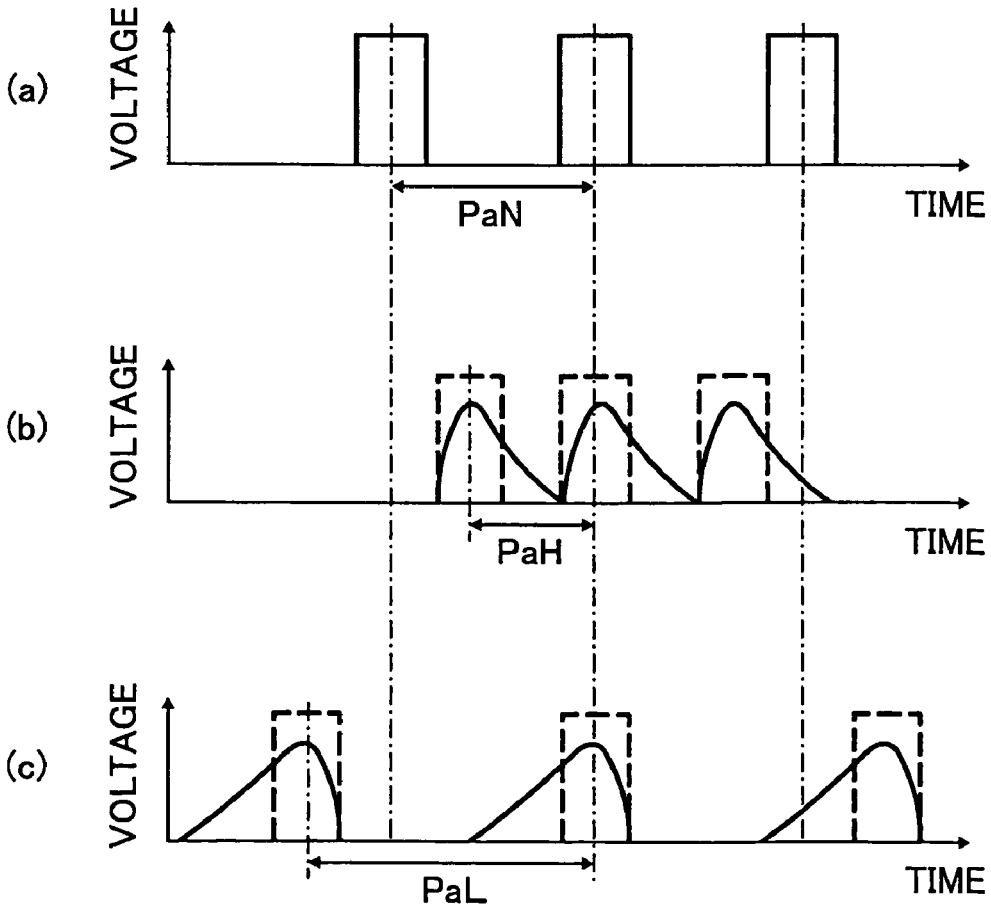
FIGS. 16*a*, 16*b*, and 16*c* are graphs (according to an example embodiment of the present invention) showing output pulses of an optical sensor unit, which detects toner images formed on an intermediate transfer belt.

As shown in FIG. 16, each pulse, having different width, may correspond to each of toner images formed on the intermediate transfer belt 41.

If the CPU 146 may recognize a pulse using a pulse width that exceeds a given threshold value, the CPU 146 may not detect toner images formed on the intermediate transfer belt 41 with higher precision in some cases as shown in FIGS. 16*b* and 16*c*, for example.

In view of such situation, in the image forming apparatus 1000, the CPU 146 may recognize a pulse using a pulse peak position instead of pulse width, for example.

With such configuration, the CPU 146 may precisely recognize a pulse using a pulse peak position even if an image forming timing on the intermediate transfer belt 41 from the photoconductor 3 may be deviated from an optimal timing by a speed variation of the photoconductor 3.

Hereinafter, the above-explained pulse is explained in detail with reference to FIGS. 15 and 16.

Figure 15:
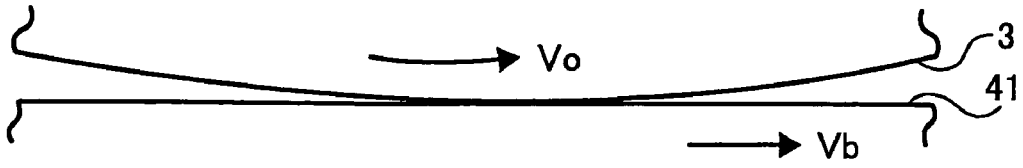
FIG. 15 is an expanded view (according to an example embodiment of the present invention) of a primary transfer nip defined by a photoconductor and an intermediate transfer belt.

FIG. 15 is an expanded view of a primary transfer nip between the photoconductor 3 and intermediate transfer belt 41. FIGS. 16*a*, 16*b*, and 16*c* are graphs showing pulses, output from the optical sensor unit 136.

FIG. 16*a* is a graph showing an output pulse from the optical sensor unit 136 used for detecting a toner image, which is transferred to the intermediate transfer belt 41 when the photoconductor 3 and intermediate transfer belt 41 has no substantial difference between their surface speeds.

FIG. 16*b* is a graph showing an output pulse from the optical sensor unit 136 used for detecting a toner image, which is transferred to the intermediate transfer belt 41 when a first surface speed V0 of the photoconductor 3 is faster than a second surface speed Vb of the intermediate transfer belt 41 at the primary transfer nip.

FIG. 16*c* is a graph showing an output pulse from the optical sensor unit 136 used for detecting a toner image, which is transferred to the intermediate transfer belt 41 when a first surface speed V0 of the photoconductor 3 is slower than a second surface speed Vb of the intermediate transfer belt 41 at the primary transfer nip.

At the primary transfer nip, the photoconductor 3 and intermediate transfer belt 41 may move with respective surface speeds while contacting each other at the primary transfer nip.

If the first surface speed V0 of the photoconductor 3 and the second surface speed Vb of the intermediate transfer belt 41 may set to a substantially similar speed, a pulse wave output from the optical sensor unit 136 may have a rectangular shape as shown in FIG. 16*a*. The pulse wave may correspond to a concentration of toner image.

In this condition, each pulse may have an interval PaN shown in FIG. 16*a*.

If the first surface speed V0 of the photoconductor 3 is faster than the second surface speed Vb of the intermediate transfer belt 41, each pulse may have an interval may have an interval PaH shown in FIG. 16*b*, which may be shorter than the interval PaN.

In such a case, a shape of each pulse may have a first mountain shape having a longer tail in a right side as shown in FIG. 16*b*. As shown in FIG. 16*b*, such pulse may rise sharply and descent gradually.

Such pulse wave may be generated because toner images may be more condensed in one direction of belt moving direction of the intermediate transfer belt 41 (e.g., rightward in FIG. 16*b*) due to a surface speed difference between the photoconductor 3 and intermediate transfer belt 41. Accordingly, toner images formed on the intermediate transfer belt 41 may have uneven concentration.

If the first surface speed V0 of the photoconductor 3 is slower than the second surface speed Vb of the intermediate transfer belt 41, each pulse may have an interval PaL shown in FIG. 16*c*, which may be longer than the interval PaN.

In such a case, a shape of each pulse may have a second mountain shape having a longer tail in a left side as shown in FIG. 16*c*. As shown in FIG. 16*c*, such pulse may rise gradually and descents sharply.

Such pulse wave may be generated because toner images may be more condensed in another direction of belt moving direction of the intermediate transfer belt 41 (e.g., leftward in FIG. 16*b*) due to a surface speed difference between the photoconductor 3 and intermediate transfer belt 41. Accordingly, toner images formed on the intermediate transfer belt 41 may have uneven concentration.

If the CPU 146 may recognize a pulse, corresponding to a toner image formed on the intermediate transfer belt 41, when the pulse peak value exceeds a given threshold value, an undesirable phenomenon may occur as below.

In case of conditions shown in FIGS. 16*b* and 16*c*, a pulse peak may not exceed a given threshold value due to an effect of the above-mentioned condensed toner image, and thereby the CPU 146 may not detect a toner image. Furthermore, the CPU 146 may not detect a highest concentration area of toner image.

In view of such situation, in the image forming apparatus 1000, a pulse peak itself may be used for detecting a toner image formed on the intermediate transfer belt 41, wherein the pulse peak may take any value.

Specifically, based on data stored in the memory circuit 143, the CPU 146 may recognize a pulse with a pulse peak, and store a recognized timing to the RAM 147 as timing data by assigning a data number. With such configuration, a time-pitch error may be detected more accurately.

The time-pitch error, stored in the RAM 147 as data, may correspond to a speed variation of the photoconductor 3 per one revolution.

A faster speed area or lower speed area on the photoconductor 3 per one revolution may occur when an amount of eccentricity, caused by any one of the photoconductor 3, photoconductor gear 133, and a coupling connecting the photoconductor 3 and photoconductor gear 133, may become a greater value.

In other words, a faster speed or lower speed on the photoconductor 3 per one revolution may occur when the above-mentioned eccentricity may become its upper limit or lower limit.

A change of eccentricity may be expressed with a sine wave pattern having an upper limit and lower limit, for example.

Accordingly, a speed-variation detection control of the photoconductor 3 may be analyzed by relating a pattern or amplitude of sine wave with a timing when the position sensor 135 detects the marking 134.

Such analysis may be conducted by known analytic methods such as zero crossing method in which average value of all data is set to zero, and a method for analyzing amplitude and phase of deviation component from a peak value, for example.

However, detected data may be susceptible to a noise effect, by which an error may become greater at an unfavorable level when the above-mentioned known methods are used.

Therefore, the image forming apparatus 1000 may employ a quadrature detection method for analyzing amplitude and phase of speed-variation detection image.

The quadrature detection method may be another known signal analysis method, which may be used for a demodulator circuit in telecommunications sector, for example.

Figure 17:
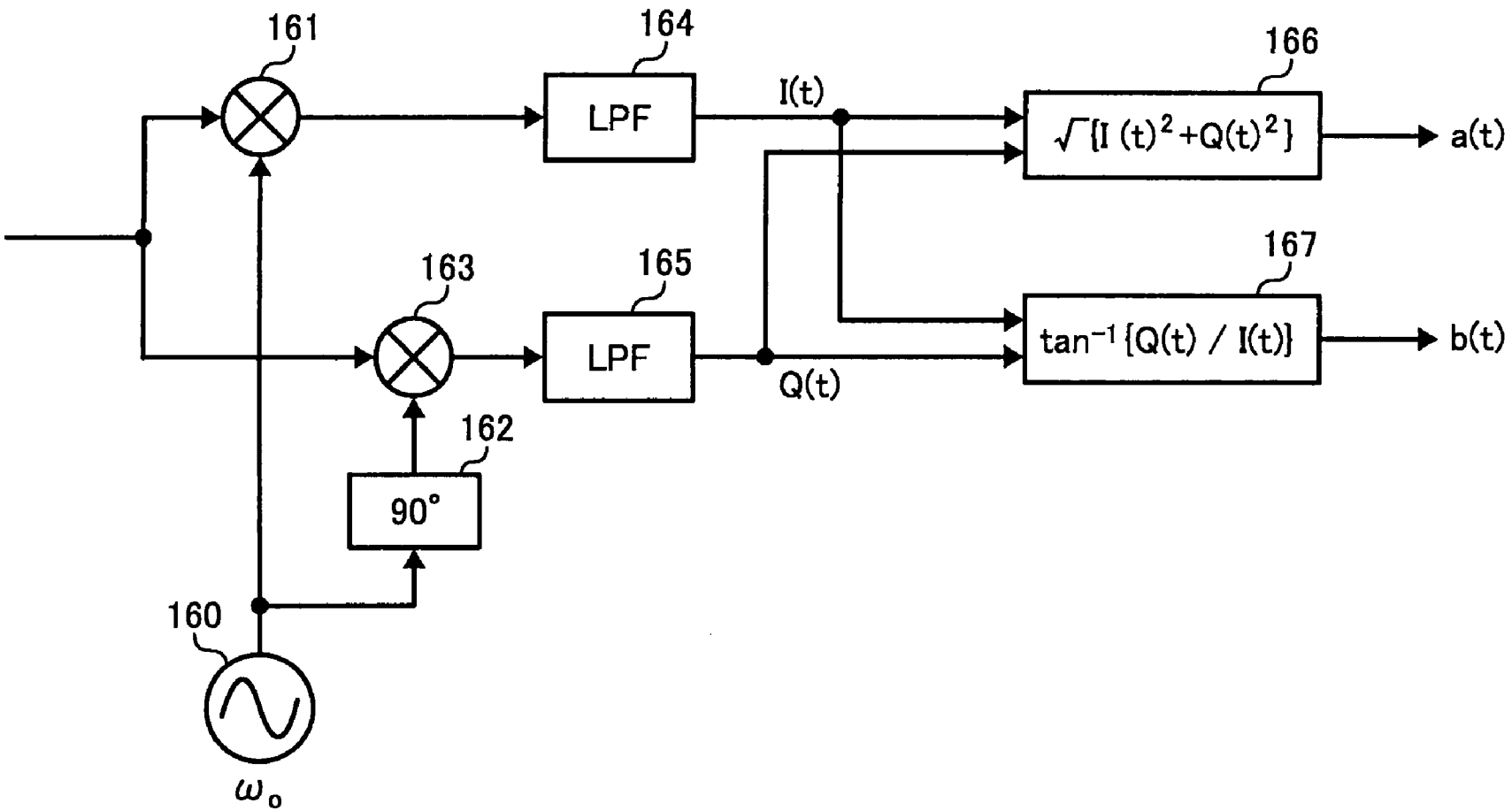
FIG. 17 is a block diagram (according to an example embodiment of the present invention) explaining a circuit configuration for a quadrature detection method.

FIG. 17 is an example circuit configuration for conducting the quadrature detection method.

As shown FIG. 17, the circuit configuration may include an oscillator 160, a first multiplier 161, a 90-degree phase shifter 162, a second multiplier 163, a first LPF (low pass filter) 164, a second LPF (low pass filter) 165, an amplitude computing unit 166, and a phase computing unit 167, for example.

A signal, output from the optical sensor unit 136, may have a wave shape, and stored in the RAM 147 as data.

Such data may include a speed variation pattern of the photoconductor 3, and other speed variation pattern related to other parts such as gears.

Therefore, such data may include various types of speed variation pattern related to other parts, by which an overall speed variation may increase over the time.

Such various types of speed variation pattern related to other parts may be extracted from the data, and then the data may be converted to a deviation data.

Such various types of speed variation related to other parts may be computed by applying least-squares method to the data, and the converted deviation data may be used as multiplication rate correction value, for example.

The converted deviation data may be processed as below.

The oscillator 160 may oscillate a frequency signal, which is to be desirably detected.

In an example embodiment, the oscillator 160 may oscillate such frequency signal, which is adjusted to the frequency $\omega 0$ of rotation cycle of image carrier (e.g., photoconductor 3).

The oscillator 160 may oscillate the frequency signal from a phase condition, corresponding to a reference timing when forming the test image PV shown in FIG. 11 and the speed-variation detection image shown in FIG. 13, wherein the test image PV shown in FIG. 11 and the speed-variation detection image shown in FIG. 13 may be collectively referred as "detection image" as required.

In case of forming the detection image, the oscillator 160 may oscillate the frequency signal $\omega 0$ from a given timing (or given phase or position) of the photoconductor 3, for example.

The oscillator 160 may output the frequency signal to the first multiplier 161, or to the second multiplier 163 via the 90-degree phase shifter 162.

The rotation cycle (or frequency signal $\omega 0$) of the photoconductor 3 may be measured by detecting the marking 134 on the photoconductor gear 133 with the position sensor 135.

The first multiplier 161 may multiply the deviation data stored in the RAM 147 with the frequency signal, outputted from the oscillator 160.

Furthermore, the second multiplier 163 may multiply the deviation data stored in the RAM 147 with a frequency signal, outputted from the 90-degree phase shifter 162.

With such multiplication, the deviation data may be separated into two components: a phase component (I component) signal, which may correspond to a phase of photoconductor 3; and a quadrature component (Q component) signal, which may not correspond to the phase of photoconductor 3.

The first multiplier 161 may output the I component, and the second multiplier 163 may output the Q component.

The first LPF 164 passes through only a signal having low frequency band pass.

The image forming apparatus 1000 may employ a low-pass filter (e.g., first LPF 164), which smoothes data for the speed-variation detection image having the length PL.

With such configuration, the first LPF 164 may only pass data having a cycle, which is obtained by multiplying a rotating cycle (or oscillating cycle) $\omega 0$ with an integral number (e.g., one, two, three).

The second LPF 165 may have a similar function as in the first LPF 164.

By smoothing data having the length PL, a cyclical rotational component of the drive roller 47 or the like may be removed from the deviation data.

The amplitude computing unit 166 may compute an amplitude a(t), which corresponds to two inputs (i.e., I component and Q component).

Furthermore, the phase computing unit 167 may compute a phase b(t), which corresponds to two inputs (i.e., I component and Q component).

Such amplitude a(t) and phase b(t) may correspond to an amplitude of one cycle of the photoconductor 3 and a phase which is angled from a given reference timing of the photoconductor 3.

Furthermore, when to detect amplitude and phase of cyclical rotational component of the drive gear 121, the above-described signal processing may be similarly conducted by setting a rotation cycle of the drive gear 121 to the oscillating cycle of ω0.

By conducting such quadrature detection method, amplitude and phase can be computed with a smaller amount of deviation data, which may be difficult by a zero crossing method or a method for detecting a pulse with a threshold value, for example.

Specifically, with respect to one rotational cycle of the photoconductor 3, a number of toner images in a detection image may be set to "4N" (N is a natural number) by adjusting the pitch PI of toner images.

With such adjustment and setting, amplitude and phase can be computed with higher precision with a smaller number of toner images.

Such computation of the amplitude and phase with higher precision using a smaller number of toner images may become possible because a positional relationship of toner images having a number of 4N may be less affected by a deviation component, and thereby an image detection sensitivity become higher.

For example, in case of four toner images, each of toner images may correspond to a zero cross position and peak position of deviation component, by which detection sensitivity may become higher.

Accordingly, even if a phase of each toner image may have a deviation with each other, such toner images may have a positional relationship having higher detection sensitivity.

Based on such analysis on speed-variation detection control, the CPU 146 may compute drive-control correction data for the photoconductors 3Y, 3C, 3M and 3K 3, and transmit the drive-control correction data to the drive controller 150.

Based on the drive-control correction data, the drive controller 150 may adjust a rotational phase of the photoconductors 3Y, 3C, 3M and 3K to reduce a phase difference among the photoconductors 3Y, 3C, 3M and 3K.

Based on the speed-variation detection control, which detects a speed variation of the photoconductors 3Y, 3C, 3M and 3K, the CPU 146 may compute the above-explained drive-control correction data corresponding to the speed variation of the photoconductors 3Y, 3C, 3M and 3K.

Such drive-control correction data may be used for a phase adjustment control, in which a phase of the photoconductors 3Y, 3C, 3M and 3K may be adjusted.

With such phase adjustment control of the photoconductors 3Y, 3C, 3M and 3K, toner images that may not be normally transferred as shown in FIGS. 16*b* and 16*c* may be formed on the surface of intermediate transfer belt 41 in a normal manner by synchronizing a feed timing of toner image on the photoconductor 3 to a transfer nip, in which the feed timing may be adjusted to an earlier or later timing.

In the image forming apparatus 1000, a pitch between adjacent photoconductors 3Y, 3C, 3M and 3K may be set to one times of the circumference length of the photoconductor 3, by which a phase of the photoconductors 3Y, 3C, 3M and 3K may be synchronized each other.

In other words, a driving time of each of the process drive motor 120Y, 120C, 120M, and 120K may be temporarily changed so that a surface speed of the photoconductors 3Y, 3C, 3M and 3K may become a faster speed at a substantially similar timing and or become a lower speed at a substantially similar timing.

With such configuration, toner images that may not be normally transferred as shown in FIGS. 16*b* and 16*c* may be formed on the surface of intermediate transfer belt 41 in a normal manner by synchronizing a feed timing of toner image on the photoconductor 3 to a transfer nip, in which the feed timing may be adjusted to an earlier or later timing.

In the image forming apparatus 1000, such phase adjustment control may be conducted when a given job is completed. The given job may include a printing job, for example.

The phase adjustment control can be conducted before starting such given job (e.g., printing job). However, such control process may delay a start of first printing because a phase adjustment control is conducted between a job-activation and a printing operation for a first sheet.

Accordingly, the phase adjustment control may be conducted after completing a job (e.g., printing job).

Such configuration may reduce a first printing time, and may set a desired phase relationship among the photoconductors 3Y, 3C, 3M and 3K for a next printing job.

Therefore, each of the photoconductors 3Y, 3C, 3M and 3K may be driven under a desired phase relationship for a next job (e.g., printing job).

As such, in the image forming apparatus 1000, a superimposing-deviation of less than ½ dot in image may be reduced by setting a linear velocity (or line speed) difference among the photoconductors 3.

However, in case of conducting a speed-variation detection control, each of the photoconductors 3Y, 3M, 3C, and 3K may be driven with one similar speed without setting a linear velocity difference among the photoconductors 3 (i.e., difference between the linear velocity of the photoconductors 3Y, 3M, 3C, and 3K may be set to substantially zero).

With such configuration, a speed-variation detection image for each of the photoconductors 3Y, 3M, 3C, and 3K may be detected with a similar precision level because the photoconductors 3Y, 3M, 3C, and 3K may not have a different linear velocity.

If the photoconductors 3Y, 3M, 3C, and 3K may have different linear velocity each other, a one cycle rotation for each of the photoconductors 3Y, 3M, 3C, and 3K may deviate each other, by which a speed-variation detection may not be conducted with a higher precision.

In general, a speed variation of photoconductor 3 per one revolution may receive a lesser effect of temperature change or external force.

Therefore, the speed-variation detection control for photoconductor 3 may be conducted with less frequency (e.g. longer time interval between checking operations) compared to the timing adjustment control.

However, if the process unit 1 is replaced for the image forming apparatus 1000, a speed variation of the photoconductor 3 may be changed at a relatively greater level.

In such a situation, a speed-variation detection control may be conducted when any one of the process units 1Y, 1C, 1M, and 1*k* is replaced for the image forming apparatus 1000, for example.

For example, a replacement detector 80 (see FIG. 1) or a unit sensor may be provided to the each of the process units 1Y, 1C, 1M, and 1*k* to detect a replacement of the process unit 1.

The unit sensor (not shown) may transmit a signal to the replacement detector 80 that the process unit 1 is replaced with a new one by changing the signal from "OFF" to "ON" when the process unit 1 is replaced.

The replacement detector 80 may judge that the process unit 1 is replaced when the replacement detector 80 receives such signal from the unit sensor.

Furthermore, the process unit 1 may include an electric circuit board having an IC (integrated circuit), which may store a unit ID (identification) number. The electric circuit board may be coupled to the CPU 146.

When the process unit 1 is replaced with new one, a unit ID number may also be changed because each process unit 1 may have unique unit ID number. The replacement detector 80 may detect a change of unit ID number to recognize a replacement of the process unit 1 for the image forming apparatus 1000.

In the image forming apparatus 1000, a speed-variation detection control and phase adjustment control may be conducted with a timing adjustment control as one set.

Specifically, when a replacement of process unit 1 is detected, various control systems can be re-calibrated. For example, a timing adjustment control may be conducted, and then a speed-variation detection control and a phase adjustment control may be conducted, and then another timing adjustment control may be conducted again. During such control process, a printing job may not be conducted.

Hereinafter, such a control process to be conducted after replacing the process unit 1 may be referred to as after-replacement control, as required.

In the image forming apparatus 1000, the after-replacement control may be conducted as below.

At first, a first timing adjustment control may be conducted. Then, each of the photoconductors 3Y, 3M, 3C, and 3K may be stopped before conducting a speed-variation detection control.

In this case, each of the photoconductors 3Y, 3M, 3C, and 3K may not be stopped by a phase relationship that the photoconductors 3Y, 3M, 3C, and 3K may have before the replacement of the process unit 1.

Instead, each of the photoconductors 3Y, 3M, 3C, and 3K may be stopped at a reference phase position, which is set for the image forming apparatus 1000.

Specifically, each of process drive motors 120 may be stopped at a reference timing, which comes in at a given time period after the photosensor 135 detects the marking 134 on the photoconductor gear 133.

With such controlling, each of the photoconductors 3Y, 3M, 3C, and 3K may be stopped under a condition that the marking 134 on each photoconductor gear 133 may be positioned to a similar rotational angle position.

With such stopping of photoconductors 3Y, 3M, 3C, and 3K, the CPU 146 may conduct a speed-variation detection control by rotating each of the photoconductors 3Y, 3M, 3C, and 3K from a similar rotational angle position.

In case of speed-variation detection control, speed-variation detection images of Y, C, and M may be formed with speed-variation detection image of K.

Each of the speed-variation detection images of Y, C, and M and speed-variation detection image of K may be concurrently detected with the optical sensor unit 136.

The photoconductor 3K may be used as reference image carrier for adjusting speed variation of the photoconductors 3Y, 3M, 3C, and 3K.

In such configuration, a phase of the photoconductors 3Y, 3C, and 3M may be matched to a phase of the photoconductor 3K. With such configuration, a speed variation component of the intermediate transfer belt 41 may less likely to affect the phase of the photoconductors 3Y, 3M, 3C, and 3K.

Specifically, a speed variation may include a speed variation of the intermediate transfer belt 41 at a position facing the optical sensor unit 136 in addition to the speed variation of the photoconductors 3Y, 3M, 3C, and 3K.

Because of such speed variation of the intermediate transfer belt 41 at a position facing the optical sensor unit 136, even if speed-variation detection images are formed on the intermediate transfer belt 41 with an equal pitch each other, a time-pitch error may occur to the speed-variation detection images.

To reduce such time-pitch error, a speed-variation detection image of K (i.e., reference image) and a speed-variation detection image of Y, M, and C may need to be detected concurrently.

Accordingly, in the image forming apparatus 1000, a speed-variation detection image of one of Y, C, or M, and a speed-variation detection image of K may be formed on the intermediate transfer belt 41 as one set.

In the image forming apparatus 1000, the speed-variation detection image of K may be formed on the first lateral side of the intermediate transfer belt 41, and the speed-variation detection image of one of Y, C, or M may be formed on the second lateral side of the intermediate transfer belt 41, for example.

The speed-variation detection image of K may be formed based on a timing when the marking 134K is detected by the photosensor 135K.

Furthermore, the speed-variation detection images of Y, C, and M may be formed based on a timing when the photosensor 135K detects the marking 134K instead of a timing when the photosensor 135Y, 135C, and 135M detect the markings 134Y, 134C, and 134M, respectively.

With such controlling, a front edge of the speed-variation detection images of Y, C, or M and a front edge of the speed-variation detection image of K may be aligned in a width direction of the intermediate transfer belt 41.

Then, a phase difference between the image of K and the image of other one of Y, C, or M may be detected.

Accordingly, a phase alignment of speed-variation detection images of K and one of Y, M, C may be conducted by shifting a position of marking 134K with respect to the markings 134Y, 134C, 134M based on the phase difference obtained by the above-described process.

As above explained, after synchronizing a rotational phase of the markings 134K, 134Y, 134C, and 134M, the CPU 146 may conduct a speed-variation detection control. Accordingly, a phase deviation among speed variation patterns computed in the speed-variation detection control may indicate a desired phase deviation among the markings 134K, 134Y, 134C, and 134M.

Such speed-variation detection control may be conducted without using a detection timing that the position sensors 135Y, 135C, and 135M detects the markings 134Y, 134C, and 134M.

Specifically, a phase deviation between the speed-variation detection image of one of Y, C, and M and speed-variation detection image of K may be detected.

However, if the process unit 1 is replaced with a new one, a superimposing-deviation of toner images may become larger compared to before replacing the process unit 1. In such a case, a detection result of the phase deviation may shift with an amount of such superimposing-deviation.

Therefore, in the image forming apparatus 1000, a timing adjustment control may be conducted before a speed-variation detection control to reduce a superimposing-deviation of toner images.

If the above-explained time-pitch error may be allowed for some level, speed-variation detection images for each color may be formed as an independent image to reduce a number of photosensors; here, an which independent image should be understood as the speed-variation detection images for each color not being aligned with each other in a main scanning direction.

On one hand, if a number of photosensors is set to four photosensors, speed-variation detection images for each color, aligned each other in a main scanning direction, may be concurrently detected by the four photosensors, by which a speed-variation detection control operation can be conducted with a shorter period of time.

Such speed-variation detection control operation may be conducted with selecting a number of speed-variation detection images formed on a image carrier depending on a requirement for an apparatus and cost factor.

The speed-variation detection images may includes: 1) one set of reference color and other color image; 2) independently formed color image; or 3) all color images aligned each other in a main scanning direction, for example.

Hereinafter, a process for the above-described after-replacement control is explained with reference to FIG. 18.

Figure 18A:
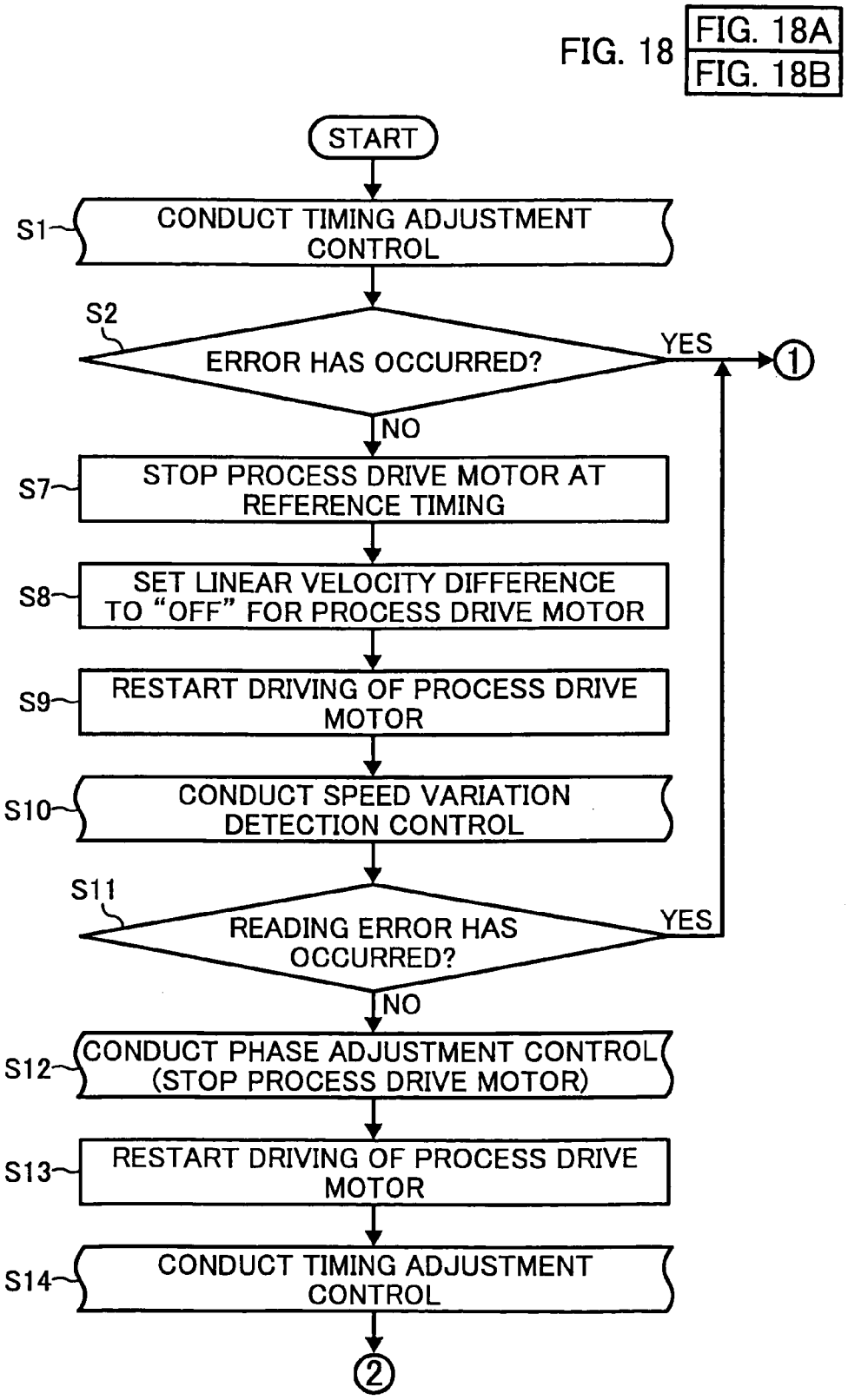
FIG. 18 is a flow chart (according to an example embodiment of the present invention) for explaining a process to be conducted after detecting a replacement of a process unit and before conducting a printing job.
Figure 18B:
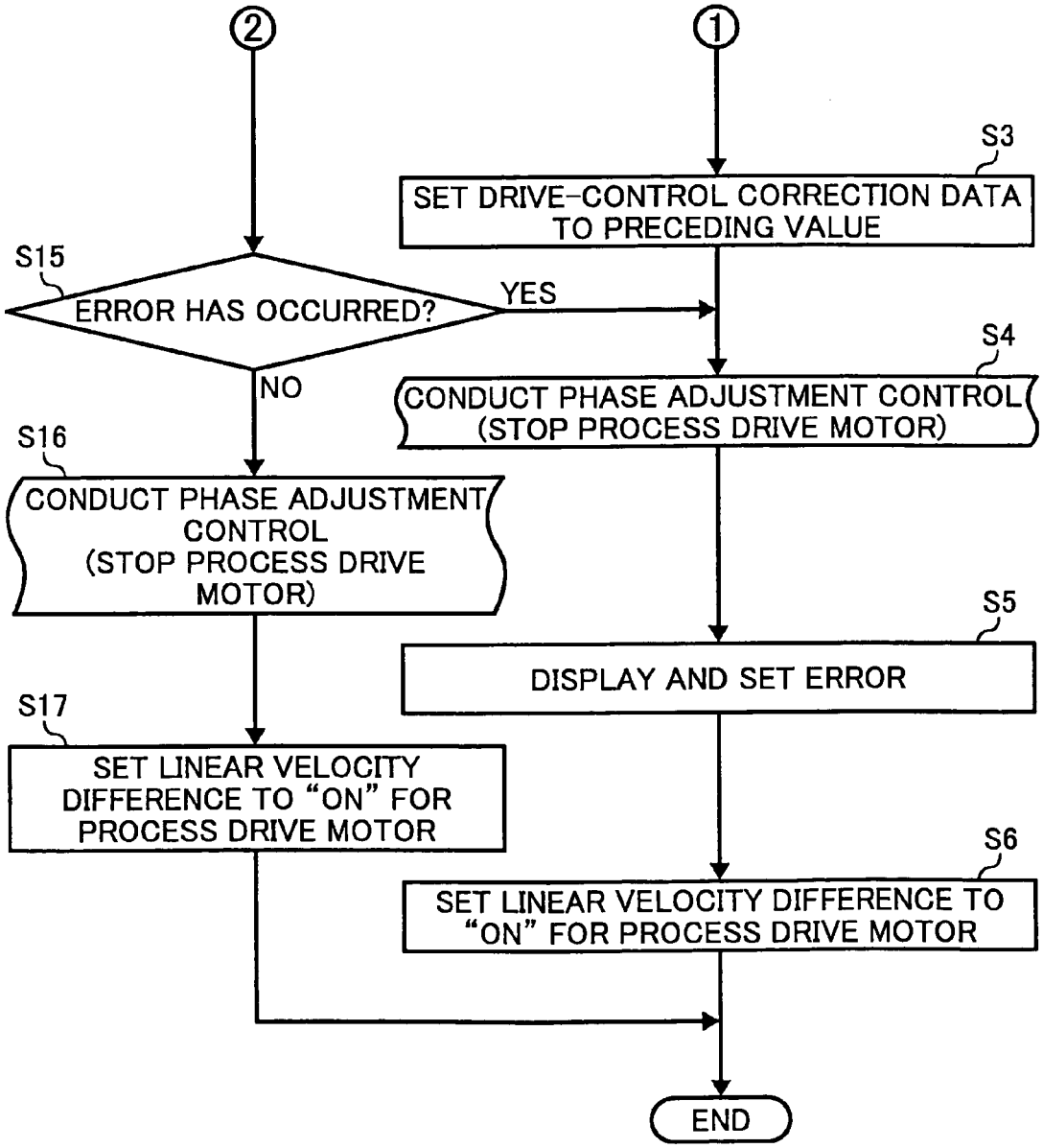

FIG. 18 is a flow chart for explaining a re-calibrating type of control process to be conducted after detecting a replacement of the process unit 1 and before conducting a printing job.

A replacement of the process units 1 may be detected when one of the process units 1 is replaced from the image forming apparatus 1000.

At step S1, the CPU 146 may conduct a timing adjustment control by checking an image-to-image positional deviation between toner images.

At step S2, the CPU 146 may check whether an error has occurred. If the CPU 146 confirms the error has occurred at step S2, the process goes to step S3. Such error may include that an image reading is impossible, an abnormal value is read, and a correction is failed, for example.

At step S3, the CPU 146 may set an original or preceding drive-control correction data for adjusting a phase of each of the photoconductors 3Y, 3C, 3M, and 3K. In this case, the original or preceding drive-control correction data may mean an immediately preceding value used by the process unit 1 before the replacement.

At step S4, the CPU 146 may conduct a phase adjustment control. In the phase adjustment control, each of the photoconductors 3Y, 3C, 3M, and 3K may be stopped while synchronizing phases of the photoconductors 3Y, 3C, 3M, and 3K based on the original or preceding drive-control correction data.

At step S5, the CPU 146 may display an error status on an operating panel (not shown).

At step S6, the CPU 146 may set different linear velocities to each of the process drive motors 120Y, 120M, 120C, and 120K (i.e., setting of different linear velocities is set to ON), and ends the control process.

Because the CPU 146 may set the different linear velocities to each of the process drive motors 120Y, 120M, 120C, and 120K at step S6, each of the photoconductors 3Y, 3C, 3M, and 3K may be set with different linear velocities to reduce a superimposing-deviation of less than ½ dot for a printing job. The printing job will be conducted after completing the process shown in FIG. 18.

If the CPU 146 may confirm that the error has not occurred at step S2, the process goes to step S7.

At step 57, the CPU 146 may stop each of the process drive motors 120Y, 120C, 120M, and 120K at a given reference timing, in which each of the photoconductor gears 133Y, 133C, 133M, and 133K may be stopped while positioning the respective markings 134Y, 134C, 134M, and 134K at a substantially similar rotational angle.

At step S8, the CPU 146 may cancel the setting of the different linear velocities to each of the process drive motors 120Y, 120M, 120C, and 120K (i.e., setting of different linear velocities is set to OFF).

At step S9, the CPU 146 may restart a driving of process drive motors 120Y, 120C, 120M, and 120K.

At step S10, the CPU 146 may conduct a speed-variation detection control.

Because the CPU 146 may cancel the setting of the different linear velocities to each of the process drive motors 120Y, 120M, 120C, and 120K at step S8, each of the photoconductors 3Y, 3C, 3M, and 3K may be driven with a similar speed during the speed-variation detection control.

Accordingly, a speed-variation detection control of the photoconductors 3Y, 3C, 3M, and 3K may be conducted at a higher precision because each of the photoconductors 3Y, 3C, 3M, and 3K may be driven with the similar speed during the speed-variation detection control.

If the speed-variation detection control of the photoconductors 3Y, 3C, 3M, and 3K may be conducted under a condition that each of the photoconductors 3Y, 3C, 3M, and 3K may be driven with different speeds, speed variation pattern of the photoconductors 3 may not be detected precisely.

When the speed-variation detection control has completed, the CPU 146 checks whether a reading error has occurred at step S11.

For example, the reading error may include that a number of read image patters are not matched to a number of actually formed latent image, wherein such phenomenon may be caused when a scratch on the belt is read, or when a toner image formed on the belt has a concentration too faint for image reading.

If the CPU 146 may confirm that the reading error has occurred at step S11, the above-explained steps S2 to S6 are conducted, and ends the control process.

If the CPU 146 confirms that the reading error has not occurred at step S11, the process goes to step S12.

At step S12, the CPU 146 may conduct a phase adjustment control, and set new drive-control correction data.

At step S12, the CPU 146 may stop each of the photoconductors 3Y, 3C, 3M, and 3K while synchronizing a phase of the photoconductors 3Y, 3C, 3M, and 3K using the new drive-control correction data.

At step S13, the CPU 146 may restart a driving of process drive motors 120Y, 120C, 120M, and 120K.

At step S14, the CPU 146 may conduct a second timing adjustment control. The CPU 146 may conduct such second timing adjustment control to correct an optical-writing starting timing for each of the photoconductors 3Y, 3C, 3M, and 3K because the optical-writing starting timing may have become distorted due to the replacement of the process unit 1 and subsequent speed-variation detection control.

At step S15, the CPU 146 may check whether an error has occurred. If the CPU 146 may confirm that the error has occurred at step S15, the process goes to the above-mentioned steps S4 to S6, and the control process ends.

If the CPU 146 may confirm that the error has not occurred at step S15, the process goes to step S16.

At step S16, the CPU 146 may conduct a phase adjustment control and stop each of the process drive motors 120Y, 120C, 120M, and 120K.

At step S17, the CPU 146 may set different linear velocities to each of the process drive motors 120Y, 120M, 120C, and 120K (i.e., setting of different linear velocities is set to ON), and ends the control process.

Hereinafter, another example configuration for the image forming apparatus 1000 according to example embodiment is explained.

Figure 19:
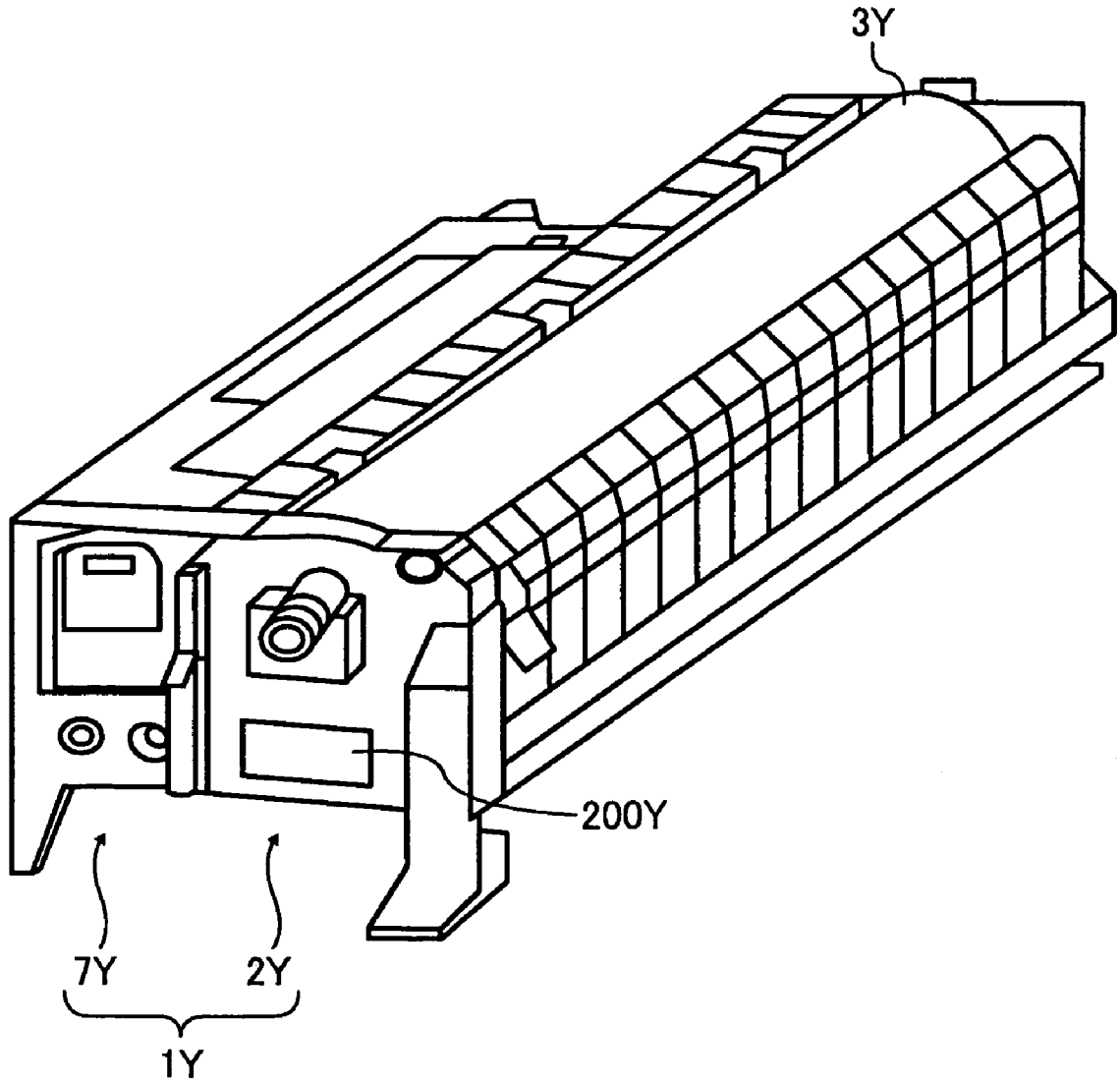
FIG. 19 is a perspective view (according to an example embodiment of the present invention) of a process unit for an image forming apparatus according to an example embodiment.

FIG. 19 is a perspective view of the process unit 1Y of the image forming apparatus 1000.

As shown in FIG. 19, the photoconductor unit 2Y of the process unit 1Y may have an identification device 200Y, which may include an integrated circuit chip (IC chip).

The IC chip of identification device 200Y may store a one-and-only identification number for each product (i.e., process unit 1Y), for example.

When the process unit 1Y is installed in the image forming apparatus 1000, the identification device 200Y and a contact device (not shown) may contact each other, by which the controller in the image forming apparatus 1000 is connected to the identification device 200Y. Then, the controller and identification device 200Y may communicate information each other. In such condition, the controller may read identification number stored in IC chip of the identification device 200Y.

The identification device 200Y may transmit a given signal to the controller under the above-mentioned connected condition, wherein the given signal may indicate an installed condition of the process unit 1Y.

The controller may sense a detachment and attachment of the process unit 1Y using the given signal. Specifically, when the controller may loose such given signal temporarily and then receive such given signal again, the controller may sense a detachment and attachment of the process unit 1Y.

Accordingly, the image forming apparatus 1000 may include a detachment/attachment detection system composed of identification device 200Y, controller, and contact device to detect detachment/attachment of the process unit 1Y in the image forming apparatus 1000.

When the controller may detect an attachment or installment of the process unit 1Y, the controller may read a unit ID (identification) number stored in the IC chip.

The controller may update a unit ID number, stored in the RAM 147, with the unit ID number read from the IC chip for the installed process unit 1Y.

Before updating ID number data stored in the RAM 147, the controller may compare the just read ID number and an ID number, stored in the RAM 147.

Specifically, the controller may judge whether such two ID numbers are identical number.

If the controller may judge that such two ID numbers are not identical, the controller may judge that the process unit 1Y is replaced with a new one.

Accordingly, in the image forming apparatus 1000, the controller can determine whether the process unit 1Y is temporarily detached and reattached later or whether the process unit 1Y is replaced with new one during a detachment/attachment operation for the process unit 1Y.

Furthermore, in the image forming apparatus 1000, the controller can determine whether the process units 1C, 1M, and 1K are temporarily detached and reattached later or replaced with new one during a detachment/attachment operation for the process units 1C, 1M, and 1K as similar to the process unit 1Y.

Accordingly, the controller can determine whether any one of the process units 1 is temporarily detached and reattached later or replaced with new one during a detachment/attachment operation for the process unit 1.

If such detachment/attachment operation is conducted for the process unit 1, the image forming apparatus 1000 may have imaging conditions or settings (e.g., developing bias voltage), which may be deviated from a desired level. Hereinafter, such imaging conditions or settings may be termed "imaging condition," as required.

Such inconvenient conditions may occur when the detachment/attachment operation for the process unit 1 is conducted, wherein the detachment/attachment operation includes a replacement of process unit 1 with new one, a replacement of process unit 1 with a used one, diverted from another image forming apparatus, or a re-attachment of process unit 1 used in a same image forming apparatus.

If a timing adjustment control or speed-variation detection control may be conducted under an imaging condition, used before conducting a detachment/attachment operation, the above-explained test image TV or speed-variation detection image may not be formed with a desired concentration because the image forming apparatus 1000 may have such inconvenient imaging condition. Such situation may unfavorably cause image detection error or erroneous adjustment.

In view of such situation, in the image forming apparatus 1000, if the controller may judge a detachment/attachment work of the process unit 1 as a replacement work of the process unit 1 with new one, the controller may conduct an adjustment control for imaging condition for the newly installed process unit 1 and set a desired imaging condition for the newly installed process unit 1, and then conduct a timing adjustment control or speed-variation detection control.

If the controller may judge that the process unit 1 is temporarily detached and reattached later, the controller may conduct a timing adjustment control or speed-variation detection control without conducting an adjustment control for imaging condition for such process unit 1 because imaging condition may not be changed or deviated from a desired level when the process unit 1 is temporarily detached and reattached later.

Figure 20A:
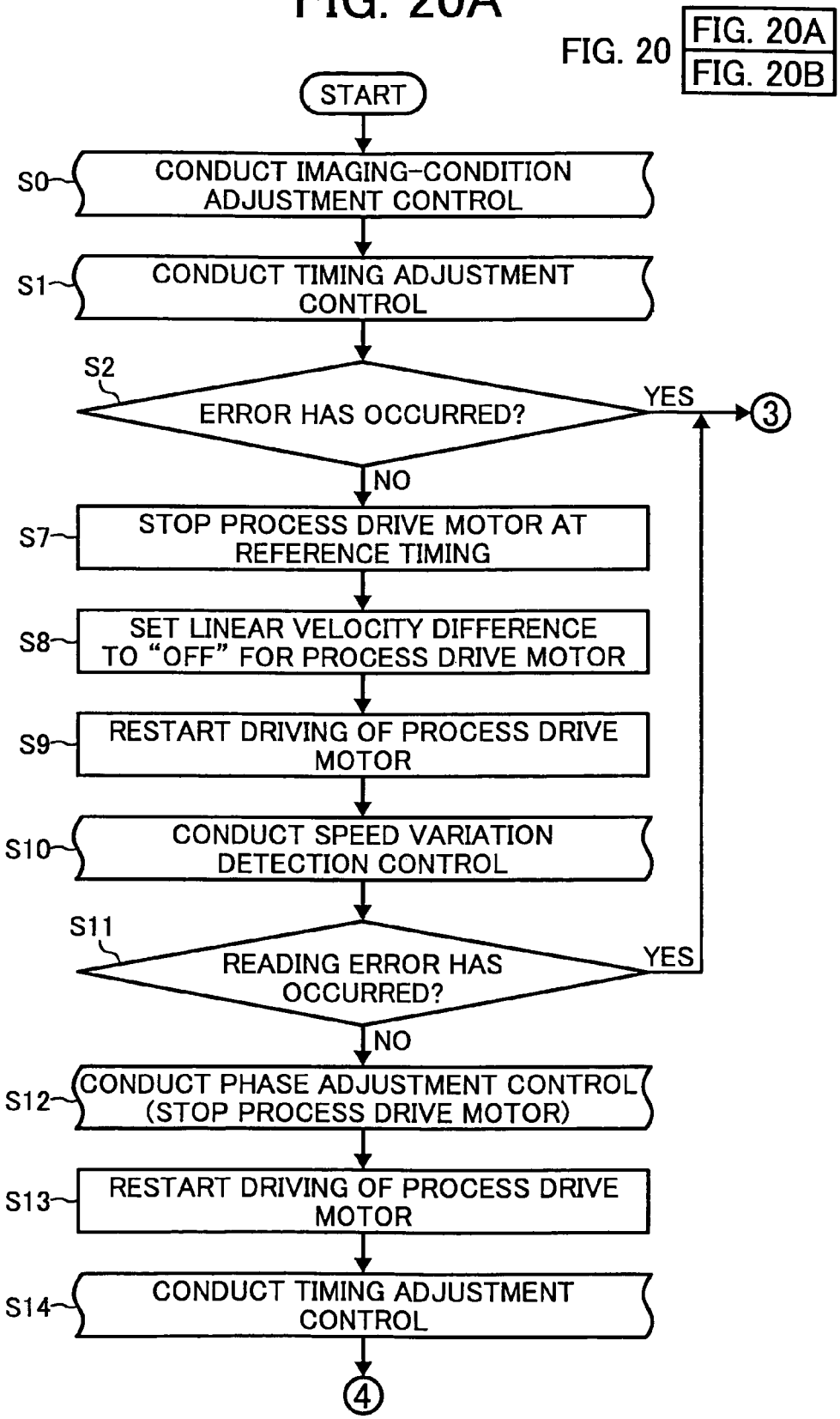
FIG. 20 is an example flowchart (according to an example embodiment of the present invention) explaining a control process flow to be conducted after a process unit is detached and reattached to an image forming apparatus.
Figure 20B:
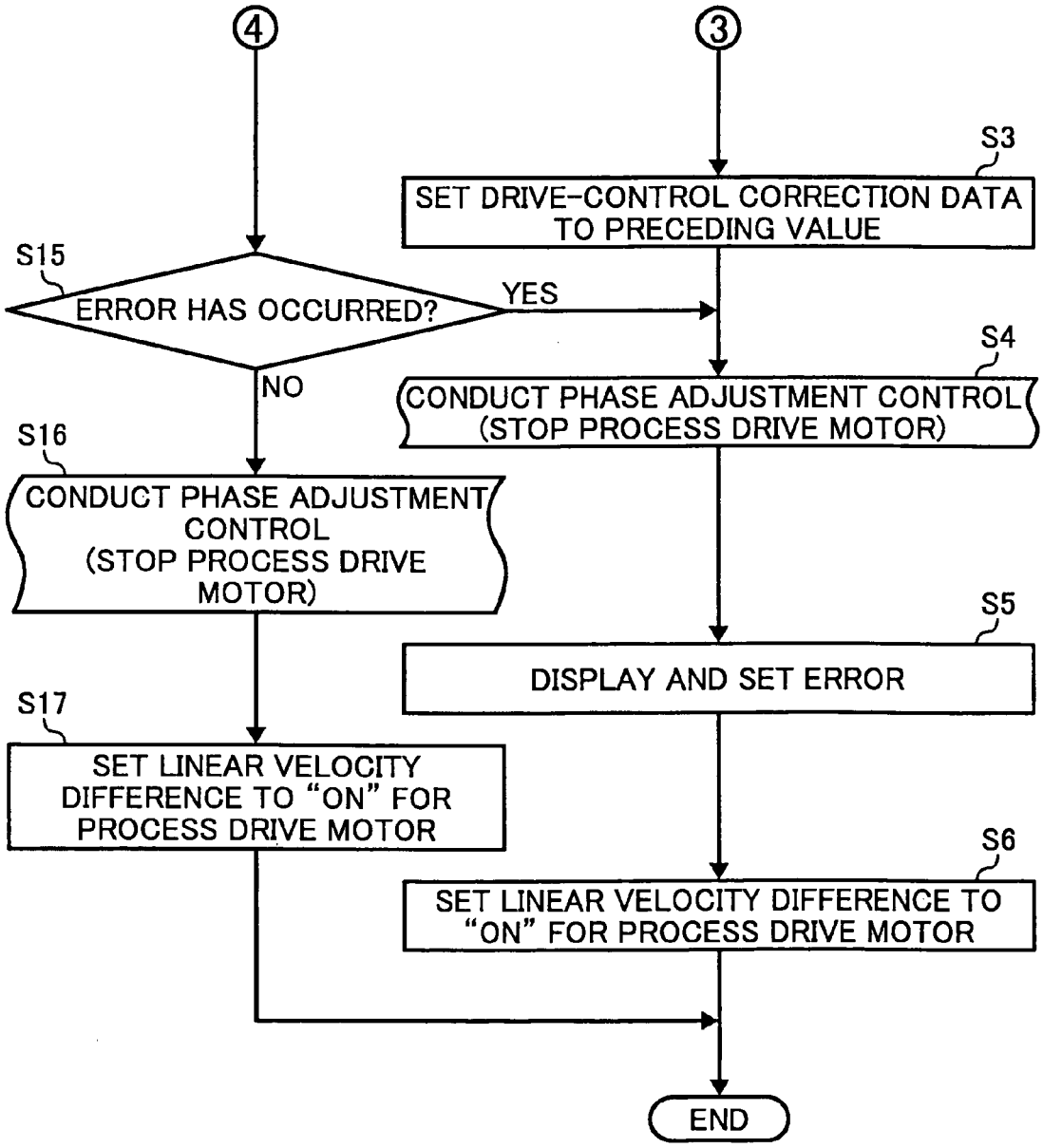

FIG. 20 is a flowchart explaining a control process flow to be conducted after the process unit 1 is detached and reattached to the image forming apparatus 1000.

Different from a flowchart shown in FIG. 18, the controller may adjustment an imaging condition before conducting speed-variation detection control or timing adjustment control at step S0.

If the controller may not conduct such adjustment for imaging condition, an imaging condition of a replaced process unit may not be adjusted to a desirable level.

When a timing adjustment control or speed-variation detection control may be conducted under such condition, a detection error of images (e.g., test image PV, speed-variation detection image), an erroneous adjustment may occur.

When adjusting the imaging condition, a gradation pattern image may be formed on a surface of photoconductors 3Y, 3M, 3C, and 3K of the process units 1Y, 1M, 1C, and 1K, and such gradation pattern image may be transferred onto the intermediate transfer belt 41.

The gradation pattern image for Y, M, C, and K may include a plurality of reference patch images (or reference toner images), in which a toner amount adhered on per unit area of an image may be differentiated for each of reference patch images for one color.

Specifically, an M gradation pattern image having a plurality of M reference patch images, a C gradation pattern image having a plurality of C reference patch images, and a Y gradation pattern image having a plurality of Y reference patch images may be formed on the intermediate transfer belt 41. Such gradation pattern images may be aligned in a row in a belt moving direction.

In the imaging condition adjustment control, the controller may adjust imaging condition (e.g., developing bias voltage) based on a detection result of such gradation pattern images detected by the optical sensor unit 136.

The controller may conduct a Vsg adjustment processing, a potential setting adjustment processing, and a halftone gamma correction processing in the imaging condition adjustment control, for example.

In case of Vsg adjustment processing, the controller may adjust a light intensity of a light emitting element for the optical sensor unit 136 such that an output voltage signal from the optical sensor unit 136, which may detect a non-toner adhered surface of the intermediate transfer belt 41, becomes a given value (for example, 4.0±0.2V).

In case of potential setting adjustment processing, the optical sensor unit 136 may detect the reference patch image of gradation pattern image (e.g., ten gradation patterns for each color) formed on the intermediate transfer belt 41, and may output a voltage signal for corresponding reference patch image. The controller may compute a developing indicator y based on such voltage signal received from the optical sensor unit 136.

Based on such computed developing indicator y, the controller may set imaging condition such as charging voltage for charging photoconductor uniformly, developing bias voltage, and light intensity for writing, which may be used for realizing a target image concentration, for example.

In case of halftone gamma correction processing, the controller may check a deviation between a voltage signal for reference patch image, received from the optical sensor unit 136, and a target gradation property. Based on such checking, the controller may correct a writing gamma, which is related to a light intensity for writing, corresponding to each gradation, such that a target gradation property may be realized.

The developing indicator y may indicate a relationship between a developing potential and an amount of toner adhered on a unit area on an image carrier such as transfer belt. Specifically, the developing indicator y may mean a slope when the developing potential and toner adhered amount are plotted in a graph.

The developing potential may mean a potential difference between an electrostatic latent image, formed on a photoconductor, and developing sleeve, applied with a developing bias voltage.

FIGS. 21A to 21E show another flowchart explaining a control process flow to be conducted after a process unit is detached and reattached to the image forming apparatus 1000.

In the control process flow shown in FIGS. 21A to 21E, the controller may conduct a speed-variation detection control for Y, M, and C separately.

For each time the controller may conduct a timing adjustment control or a speed-variation detection control for Y, M, and C, the controller may stop and re-start each of the process drive motors 120Y, 120C, 120M, and 120K.

The controller may set an OFF-condition for a line velocity difference for the process drive motors 120Y, 120C, 120M, and 120K. In other words, the controller may drive all of the process drive motors 120 at a substantially same speed.

Furthermore, the controller may detect a deviation between a speed variation pattern for K color and a speed variation pattern for Y, M, C color in a similar manner as explained in the above.

The controller may detect a replacement of process unit 1 based on a signal transmitted from the identification device of the process unit 1 in a similar manner as explained in the above.

When the controller detects a detachment and attachment of process unit 1, the controller may reset drive-stop delay time T1 to "0" at step S1.

Such drive-stop delay time T1 may mean that the process drive motor 120 is driven or stopped at a reference timing or the process drive motor 120 is driven or stopped at a timing, which is delayed from the reference timing when a phase adjustment control is conducted.

By resetting the drive-stop delay time T1 to "0," the controller may stop the process drive motor 120 at the reference timing.

At step S2, the controller may conduct a timing adjustment control with the drive-stop delay time T1 of "0".

At step S3, the controller may judge whether an error has occurred.

If the controller may judge that an error has occurred at step S3, the controller may stop a driving of the process drive motor 120 and display an error status on an operation panel at step S4.

At step S5, the controller may set the drive-stop delay time T1 to an immediately preceding value, and ends a control process flow.

If the controller may judge that an error has not occurred at step S3, the controller may stop each of the process drive motors 120 at the reference timing at step S6, and then conduct a flow process shown in step S7 and subsequent steps.

When the controller stops each of the process drive motors 120 at the reference timing at step S6, the controller may set a OFF-condition for a line velocity difference of process drive motors 120 at step S7.

At step S8, the controller may start a driving of each of the process drive motors 120.

As such, the controller may start a driving of each of the process drive motors 120 while the line velocity difference is set to OFF condition.

Accordingly, a phase deviation determined based on speed variation patterns among the process drive motors 120, rotated at a substantially similar speed, may be determined as a reference phase deviation amount when the controller drives or stops each of the process drive motors 120 at reference timing.

On one hand, if the controller may set a line velocity difference among the process drive motors 120 and start a driving of each of the process drive motors 120, and then set a OFF-condition for the line velocity difference, a phase deviation of speed variation patterns among the process drive motors 120 may be deviated from a reference phase deviation amount during a time period starting from a driving of the process drive motors 120 to setting of the OFF-condition for the line velocity difference.

In such a condition, the controller may not correct positional displacement precisely and may not detect a speed variation pattern precisely.

When the process drive motors 120 is driven at step S8 without setting a line velocity difference, the controller may conduct a speed-variation detection control for Y color at steps S9 and S10 by forming and reading K-Y (black and yellow) speed-variation detection images.

At step S1, the controller may judge whether a reading error has occurred.

If the controller may judge that a reading error has occurred at step 511, the controller may stop a driving of the process drive motors 120, and display an error status on an operation panel at step 512.

At step 513, the controller may set the drive-stop delay time T1 to an immediately preceding value and an ON-condition for the line velocity difference, and ends a control process flow.

If the controller may judge that a reading error has not occurred at step S11, the controller may stop the process drive motors 120 at a the reference timing at step S15.

At step S16, the controller may set an ON-condition for the line velocity difference, and then conduct a flow process shown in step S17 and subsequent steps.

Figure 21A:
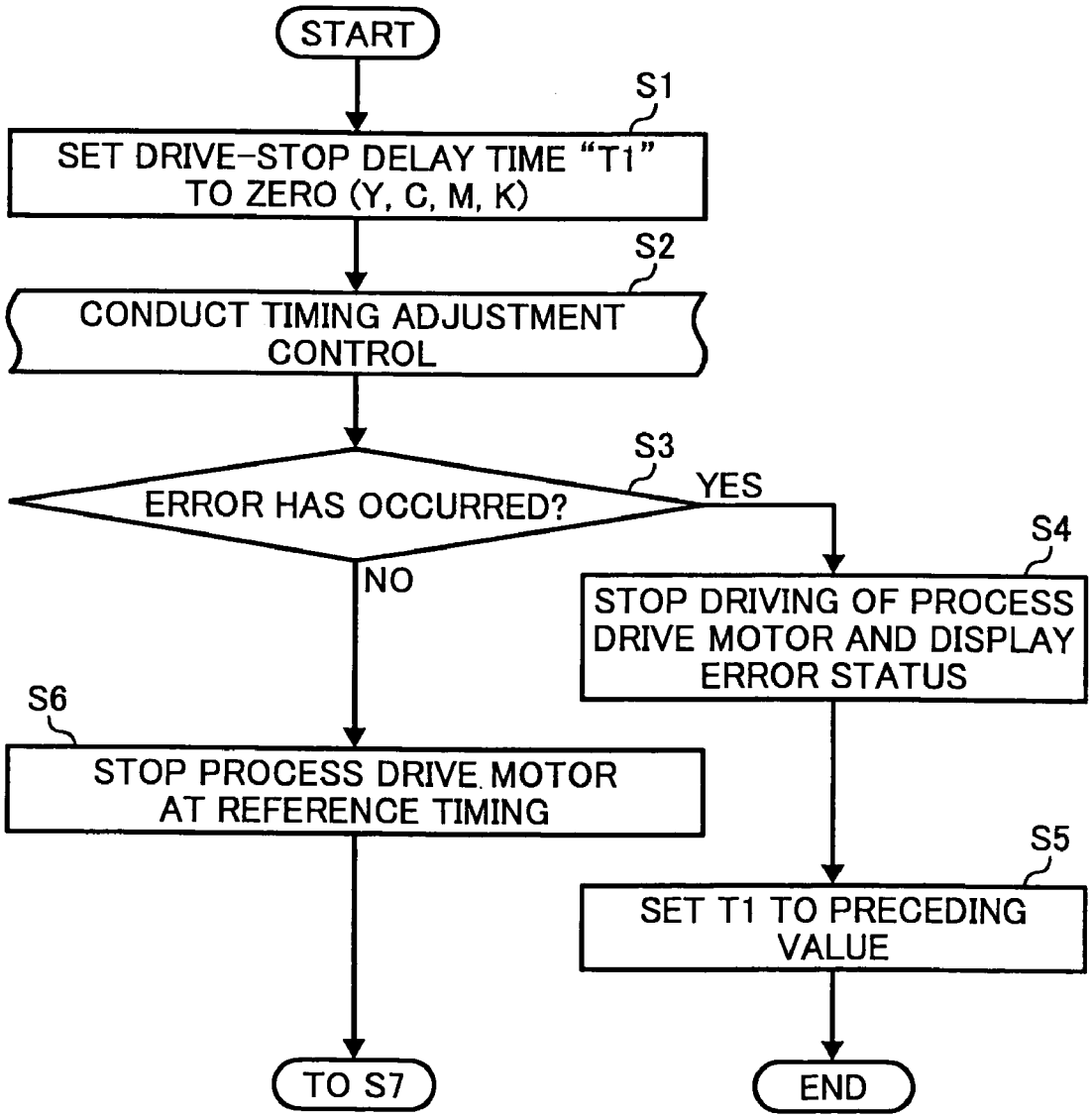
FIG. 21A to FIG. 21E is another example flowchart (according to an example embodiment of the present invention) explaining a control process flow to be conducted after a process unit is detached and reattached to an image forming apparatus.
Figure 21B:
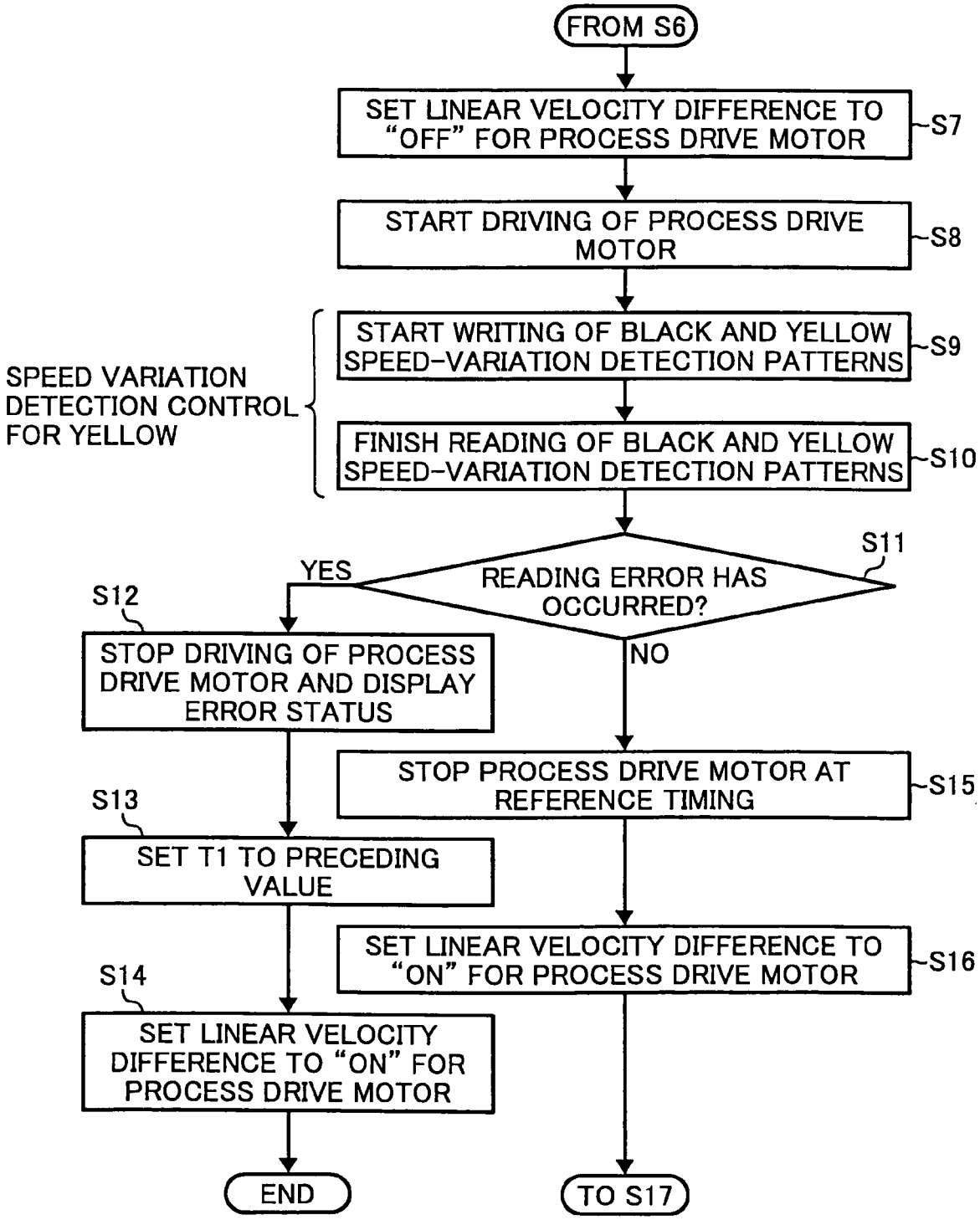
Figure 21C:
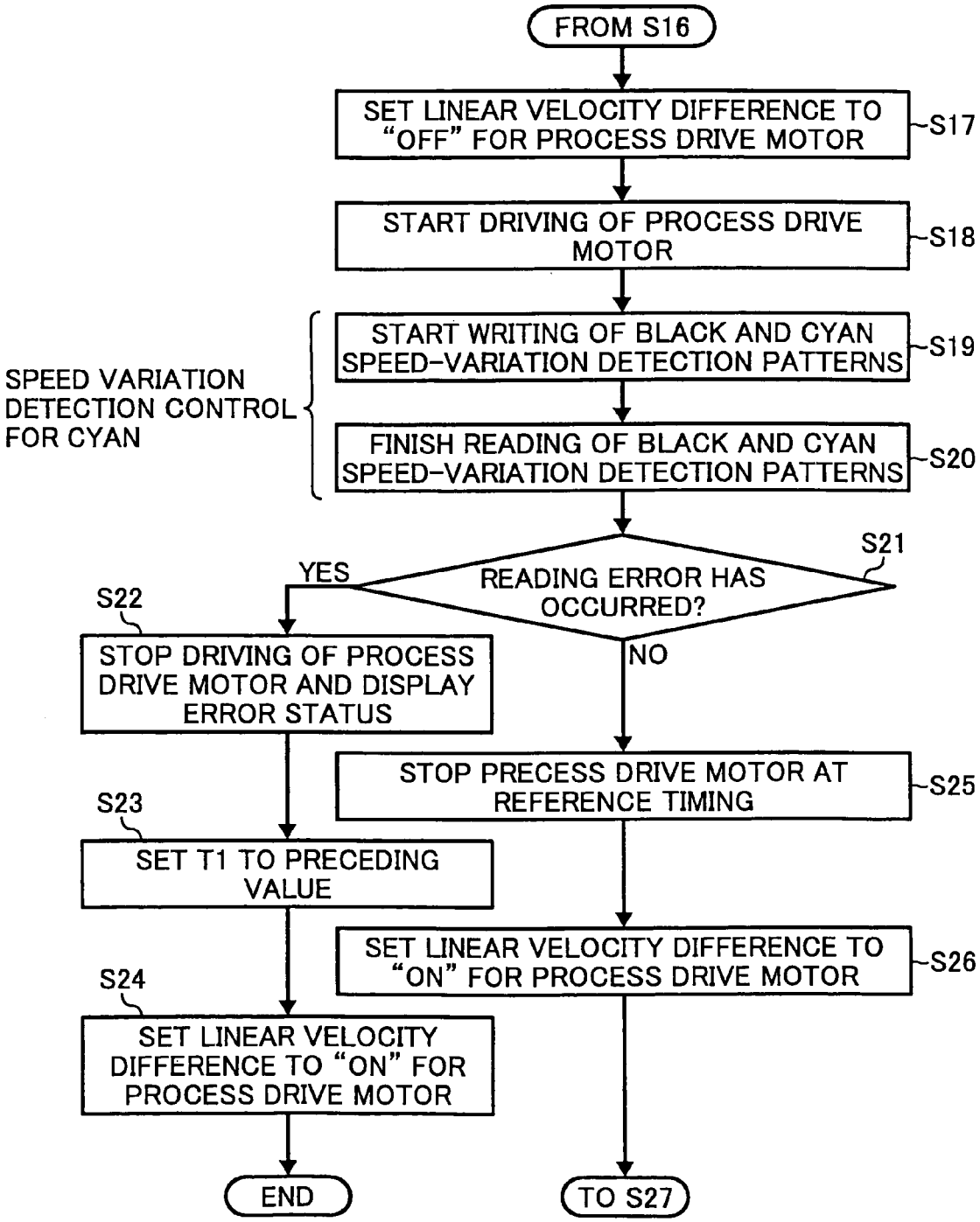

As shown in FIG. 21C, a process flow from steps 517 to S26 may be used for speed-variation detection control for C color.

Accordingly, a process flow from steps S17 to S26 may be similar to the process flow from steps S7 to S16 for speed-variation detection control for Y color shown in FIG. 21B except steps 519 and 520.

Figure 21D:
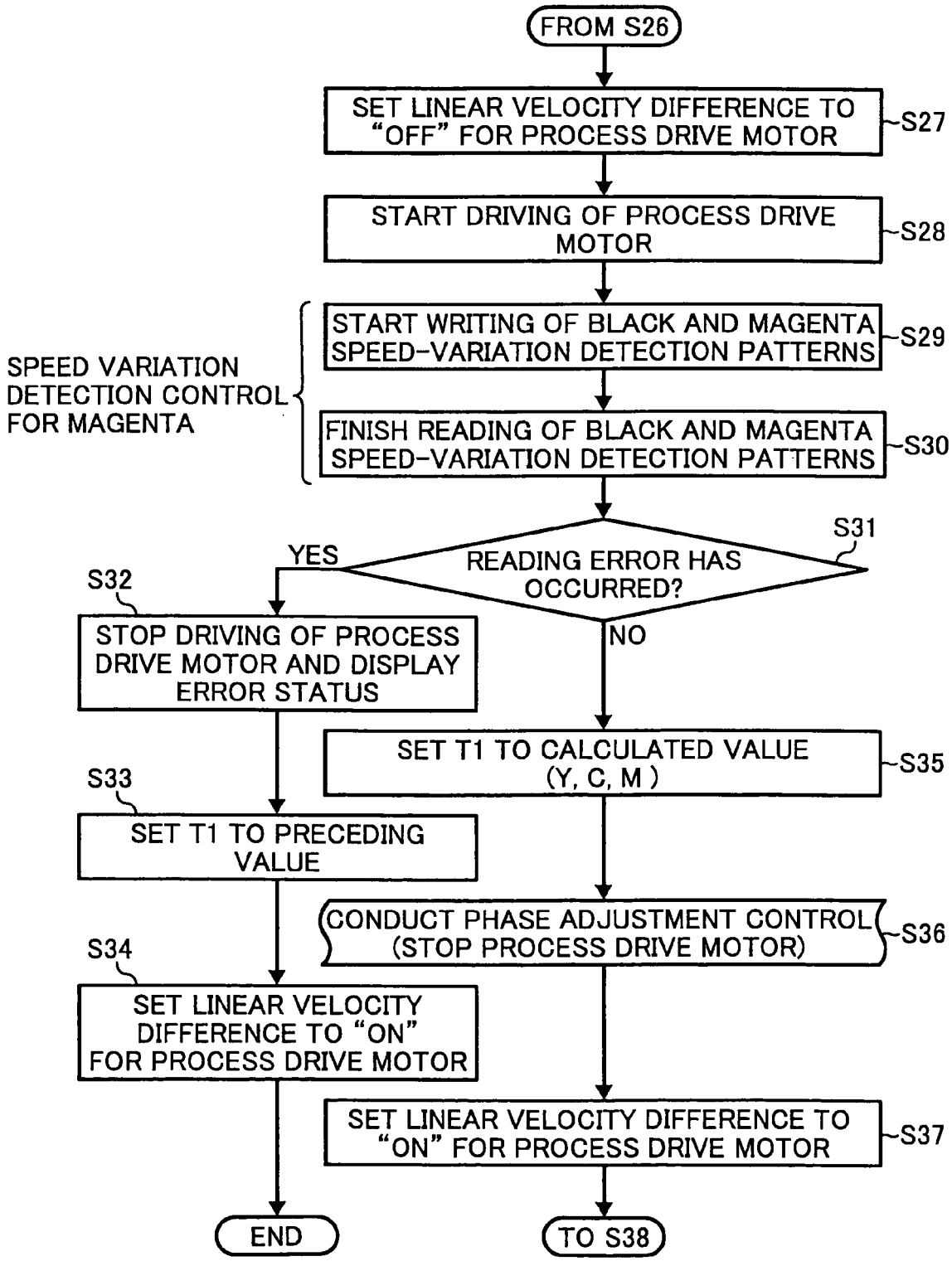

As also shown in FIG. 21D, a process flow from steps S27 to S37 may be used for speed-variation detection control for M color.

As shown in FIG. 21D, a process flow from steps S27 to S34 may be similar to the process flow from steps S17 to S14 for speed-variation detection control for Y color shown in FIG. 21B except steps S29 and S30.

If the controller may judge that a reading error has not occurred after conducting a speed-variation detection control for M color at step S31, the controller may set the drive-stop delay time T1 for Y, M, and C to a value computed based on speed-variation detection control for Y, M, C at step S35.

At step S36, the controller may conduct a phase adjustment control to adjust a phase of speed variation pattern of the process drive motors 120, and then stop the process drive motors 120.

At step S37, the controller may set an ON-condition to the line velocity difference, and then conduct a flow process shown in step S38 and subsequent steps.

Figure 21E:
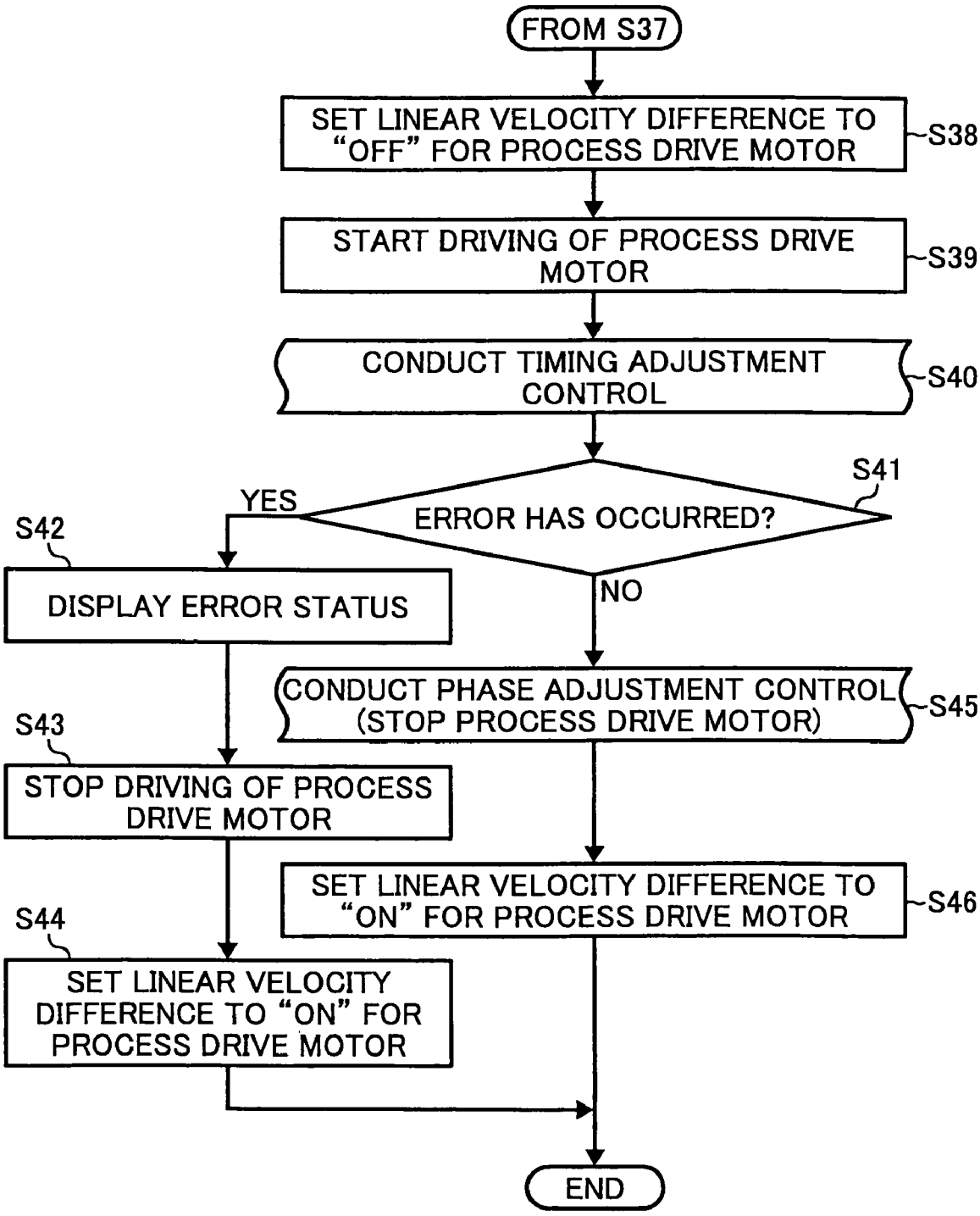

As shown in FIG. 21E, at step S38, the controller may set an OFF-condition to the line velocity difference.

At step S39, the controller may drive the process drive motors 120.

At step S40, the controller may conduct a timing adjustment control.

At step S41, the controller may judge whether an error has occurred.

If the controller may judge that an error has occurred at step S41, the controller may display an error status on an operation panel at step S42, and stop the process drive motors 120 at step S43.

At step S44, the controller may set an ON-condition to the line velocity difference, and end the process flow.

If the controller may judge that an error has not occurred at step S41, the controller may stop the process drive motors 120 under a condition that a phase of the process drive motors 120 is adjusted by a phase adjustment control at step S45.

At step S46, the controller may set an ON-condition to the line velocity difference, and end the process flow.

In the above-described image forming apparatus 1000 explained with reference to FIGS. 21A to 21E, the controller may set an OFF-condition to the line velocity difference, and drive the process drive motors 120 with a substantially similar speed for conducting a timing adjustment control or speed-variation detection control.

Accordingly, the controller may correct positional displacement precisely and detect a speed variation pattern precisely.

If the controller may set a line velocity difference among the process drive motors 120 and start to drive the process drive motors 120, and then set a OFF-condition for the line velocity difference, a phase relationship among the process drive motors 120 may be deviated from a reference phase deviation amount during a time period starting from a driving of the process drive motors 120 to a setting the OFF-condition for the line velocity difference.

In such a condition, the controller may not correct positional displacement precisely and may not detect a speed variation pattern precisely.

Figure 22:
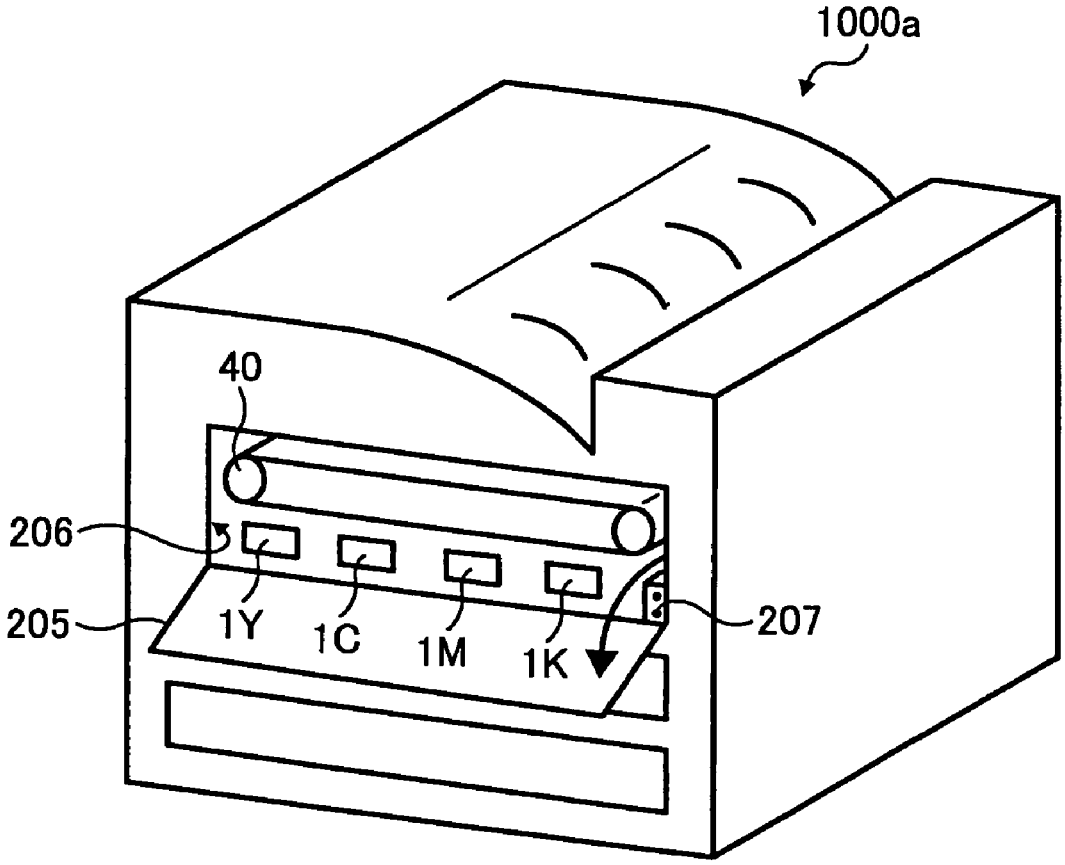
FIG. 22 is a perspective view (according to an example embodiment of the present invention) of another example configuration for an image forming apparatus according to an example embodiment.

FIG. 22 is a perspective view of another example configuration for an image forming apparatus according to an example embodiment.

As shown in FIG. 22, an image forming apparatus 1000*a* may have a cover 205 on one side (e.g., front side). The cover 205 may be pivotably opened or closed.

When an operator opens the cover 205, the operator can see an access area 206, provided on one side of the image forming apparatus 1000*a*.

As shown in FIG. 22, the operator can access to the transfer unit 40 or process units 1Y, 1M, 1C, and 1K through the access area 206.

The operator can slidably move the transfer unit 40 or process units 1Y, M, 1C, and 1K in a front/rear direction of the image forming apparatus 1000*a*, by which the operator can withdraw or install the transfer unit 40 or process units 1Y, 1M, 1C, and 1K to the image forming apparatus 1000*a*.

As shown in FIG. 22, the image forming apparatus 1000*a* may have a cover sensor 207 for detecting an opening and closing of the cover 205. The cover sensor 207 may be disposed on a given position of the image forming apparatus 1000*a*.

The image forming apparatus 1000*a* may need the cover sensor 207 for a safety reason. For example, the image forming apparatus 1000*a* may forcibly stop an image forming operation when the cover sensor 207 may detect an opened condition of the cover 205.

The controller of the image forming apparatus 1000*a* may indirectly detect a detachment and attachment of the process units 1Y, 1M, 1C, and 1K by using a detection signal of the cover sensor 207. In other words, the controller of the image forming apparatus 1000*a* may not directly detect a detachment and attachment of the process units 1Y, 1M, 1C, and 1K.

Specifically, when the cover sensor 207 may detect an opening and a subsequent closing of the cover 205, a controller may judge that any one of the process units 1 is detached and attached for the image forming apparatus 1000*a*.

Such a configuration may not need a specific sensor for detecting detachment and attachment of the process units 1, but may detect detachment and attachment of the process units 1 with one detector (e.g., cover sensor 207), which may be provided for image forming apparatus.

Accordingly, a detachment and attachment of the process units 1 may be detected without providing a special device, by which an image forming apparatus may be manufactured with reduced cost.

Hereinafter, another example controlling configuration using the image forming apparatus 1000 or 1000*a* is explained.

In another example controlling configuration, instead of conducting the above-described phase adjustment control, a controller may control a driving speed of the process drive motor 120 by changing a speed variation pattern of the process drive motor 120 with a speed pattern having a opposite phase.

In general, a speed variation pattern of photoconductor 3 may have one cycle of sine wave pattern with respect to one rotation of photoconductor 3.

If two sine waves having a same cycle, same amplitude, and opposite phase patterns are combined together, a mountain pattern of one sine wave may be cancelled with a valley pattern of another sine wave, and thereby one sine wave may be substantially cancelled by another sine wave.

Accordingly, in another example controlling configuration for the image forming apparatus 1000 or 1000*a*, the controller may analyze a driving speed pattern of photoconductor 3 based on a speed variation pattern detected by a speed-variation detection control.

Specifically, the controller may analyze such speed variation pattern and determine a corresponding first sine wave for the process drive motors 120Y, 120C, 120M, and 120K.

Then, the controller may determine a second sine wave having a same cycle, same amplitude, and opposite phase with respect to the first sine wave to determine a driving speed pattern for the process drive motors 120Y, 120C, 120M, and 120K.

The controller may drive the process drive motors 120Y, 120C, 120M, and 120K with a driving speed pattern having the second sine wave to conduct a timing adjustment control.

After such timing adjustment control, the controller may instruct a printing operation.

Although a speed variation pattern for each of the photoconductors 3Y, 3C, 3M, and 3K may have a similar cycle, but each of the photoconductors 3Y, 3C, 3M, and 3K may have different amplitudes because eccentricity of gears for each of the photoconductors 3Y, 3C, 3M, and 3K may have differences even though such differences may be small.

Therefore, even if a phase adjustment control may be conducted to match a phase of photoconductors 3Y, 3C, 3M, and 3K, such photoconductors 3Y, 3C, 3M, and 3K may still have phase differences due to different amplitudes of photoconductors 3Y, 3C, 3M, and 3K even though such differences may be small.

Accordingly, in an example controlling configuration according to an example embodiment, explained in the above, such phase differences may still remain in the image forming apparatus 1000.

On one hand, in another example controlling configuration, a speed variation of the photoconductor 3 may be substantially cancelled, by which a superimposing deviation of images due to speed variation of the photoconductors 3 may be suppressed or reduced compared to an example controlling configuration.

Figure 23A:
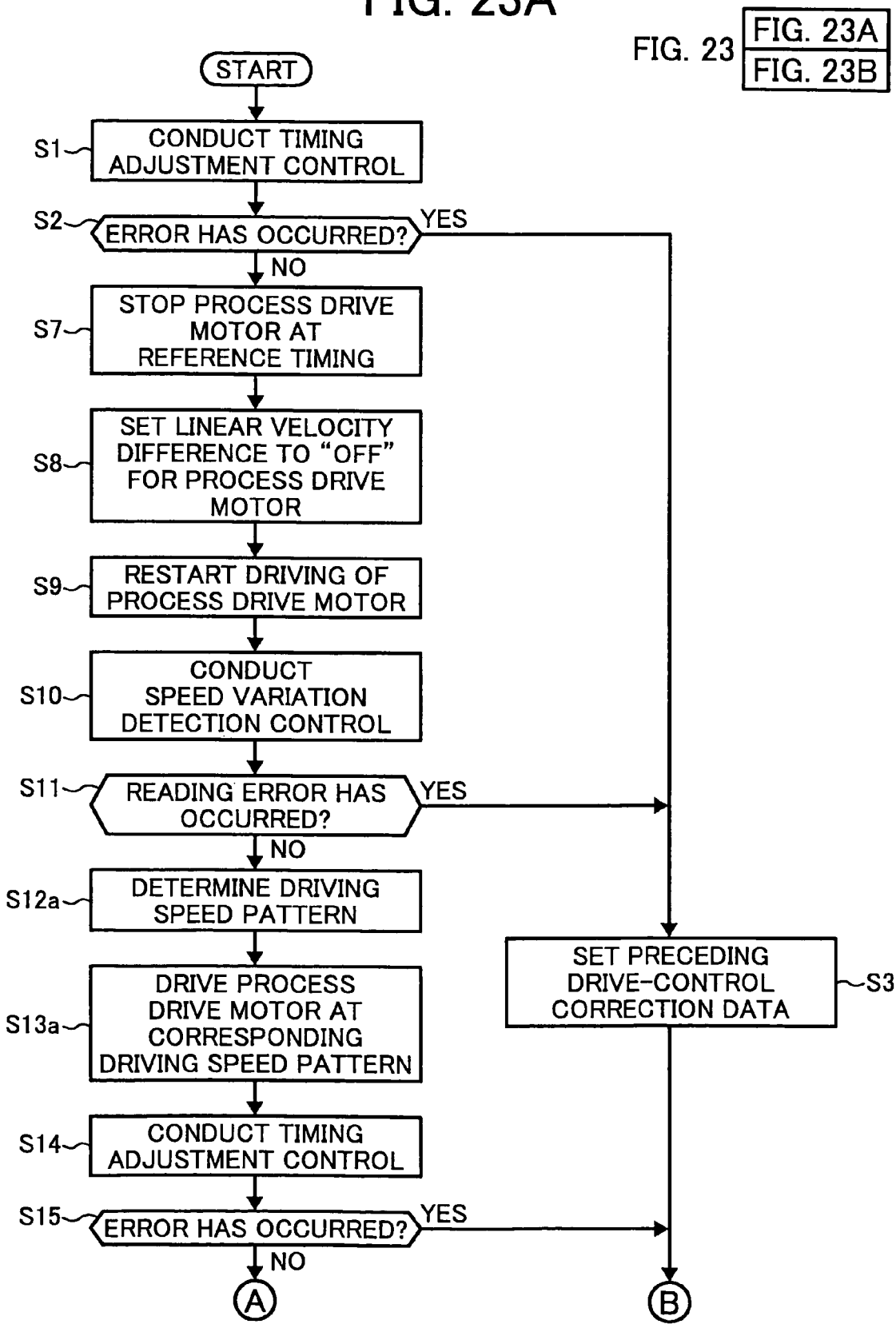
FIG. 23 is a flowchart (according to an example embodiment of the present invention) explaining a process flow conducted by a controller of an image forming apparatus after detecting a replacement of a process unit.
Figure 23B:
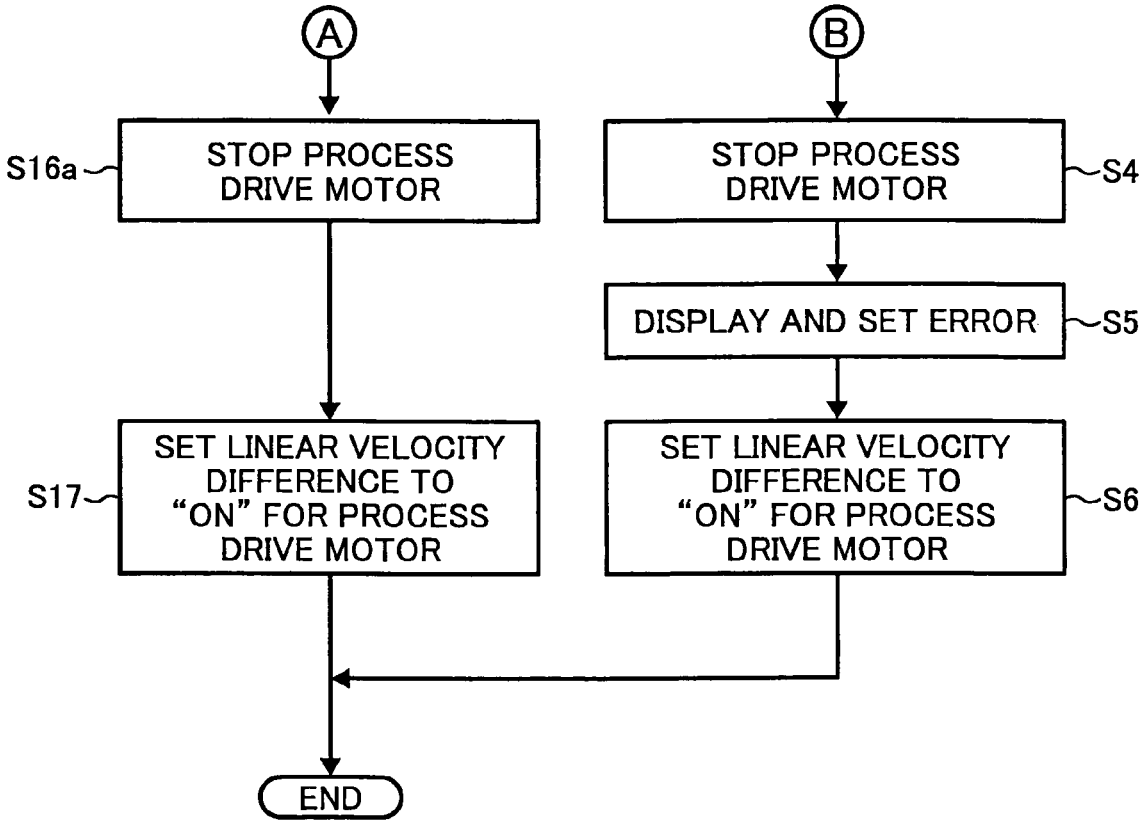

FIG. 23 is a flowchart explaining a process flow conducted by the controller of the image forming apparatus 1000 after detecting a replacement of the process unit 1 and before conducting a printing job.

A replacement of the process units 1 may be detected when one of the process units 1 is replaced for the image forming apparatus 1000.

The process flow of FIG. 23 may have steps as similar to the process flow of FIG. 18 with some different steps as below.

At step S11, the CPU 146 may check whether a reading error has occurred. For example, the reading error may include that a number of read image patters are not matched to a number of actually formed latent image, wherein such phenomenon may be caused when a scratch on the belt is read, or when a toner image formed on the belt has a very faint concentration which may be too faint for reading.

If the CPU 146 may confirm that the reading error has occurred at step S11, the above-explained steps S2 to S6 are conducted, and the control process ends.

If the CPU 146 may confirm that the reading error has not occurred at step S11, the process goes to step S12*a*.

At step S12*a*, the CPU 146 may determine a driving speed pattern instead of phase adjustment control, conducted at step 12 in the process flow of FIG. 18.

At step 13*a*, the CPU 146 may drive the process drive motor 120 with a driving speed pattern, which may cancel an effect of speed variation of the process drive motor 120.

At step 514, the CPU 146 may conduct a timing adjustment control without temporarily stopping the process drive motor 120, which may be different from the process flow of FIG. 18.

Furthermore, at step S16*a*, the CPU 146 may stop the process drive motor 120 without conducting a phase adjustment control, conducted at step 516 in the process flow of FIG. 18.

As shown in FIG. 23, the CPU 146 may drive the process drive motor 120 with the above-determined driving speed pattern, which may cancel an effect of speed variation of the process drive motor 120 at step 13*a* before conducting a timing adjustment control at step 514.

Accordingly, the CPU 146 may conduct a timing adjustment control substantially without a speed variation of photoconductors 3.

Furthermore, the CPU 146 may drive the process drive motor 120 with the above-determined driving speed pattern, which may cancel an effect of speed variation of the process drive motor 120 during a normal printing operation in addition to after detecting a replacement of the process unit I.

In the above described an example controlling configuration for an image forming apparatus according to an example embodiment, a superimposing deviation of images due to speed variation of photoconductors 3 may be suppressed by synchronizing speed variation pattern of the photoconductors 3 per one revolution, and a superimposing deviation of images of less than ½ dot in a sub-scanning direction may be suppressed by setting a different line velocity to the photoconductors 3 at a tiny level.

In such configuration, if a continuous printing mode is conducted for a longer period of time, a phase relationship among the photoconductors 3 may be deviated from an optimal value because a line velocity difference among the photoconductors 3 may become greater when the continuous printing may be continued for a longer period of time.

Accordingly, as above explained, a phase adjustment control may be needed when the image forming apparatus has produced a given number of printed sheets during a continuous printing operation.

Specifically, such phase adjustment control may be conducted by temporarily suspending or stopping the continuous printing operation.

On one hand, in another example controlling configuration, a speed variation of each of the photoconductors 3 itself may be suppressed instead of adjusting a phase relationship among the photoconductors 3.

Accordingly, even if a line velocity difference may be set among the photoconductors 3 in another example controlling configuration, a superimposing deviation of images may not be increased even if a continuous printing operation is conducted.

Therefore, in another example controlling configuration, an operator may not feel inconvenience of a waiting time, which may occur due to a temporarily suspended continuous printing operation.

Hereinafter, still another example control configuration according to an example embodiment is explained.

The inventors of this disclosure assumed that if the process drive motor 120 may be driven by a driving speed pattern having a same cycle and same amplitude in opposite phase with respect to a speed variation pattern of the process drive motor 120, a superimposing deviation of images may be substantially eliminated.

Although such superimposing deviation of images was eliminated significantly, which was confirmed by an experiment, such superimposing deviation was not completely eliminated because of detection error of speed variation pattern, rotational speed error of process drive motor 120, controlling error of motor rotation, or the like.

In still another example control configuration, the process drive motor 120 may be driven by combining the above-described driving speed pattern control and phase adjustment control so that a superimposing deviation of images, remaining in tiny scale, may be suppressed.

With such combination of driving speed pattern control and phase adjustments control, a superimposing deviation of images caused by speed variation of photoconductors 3 may be substantially eliminated (e.g., substantially zero level).

Figures 24, 24A:
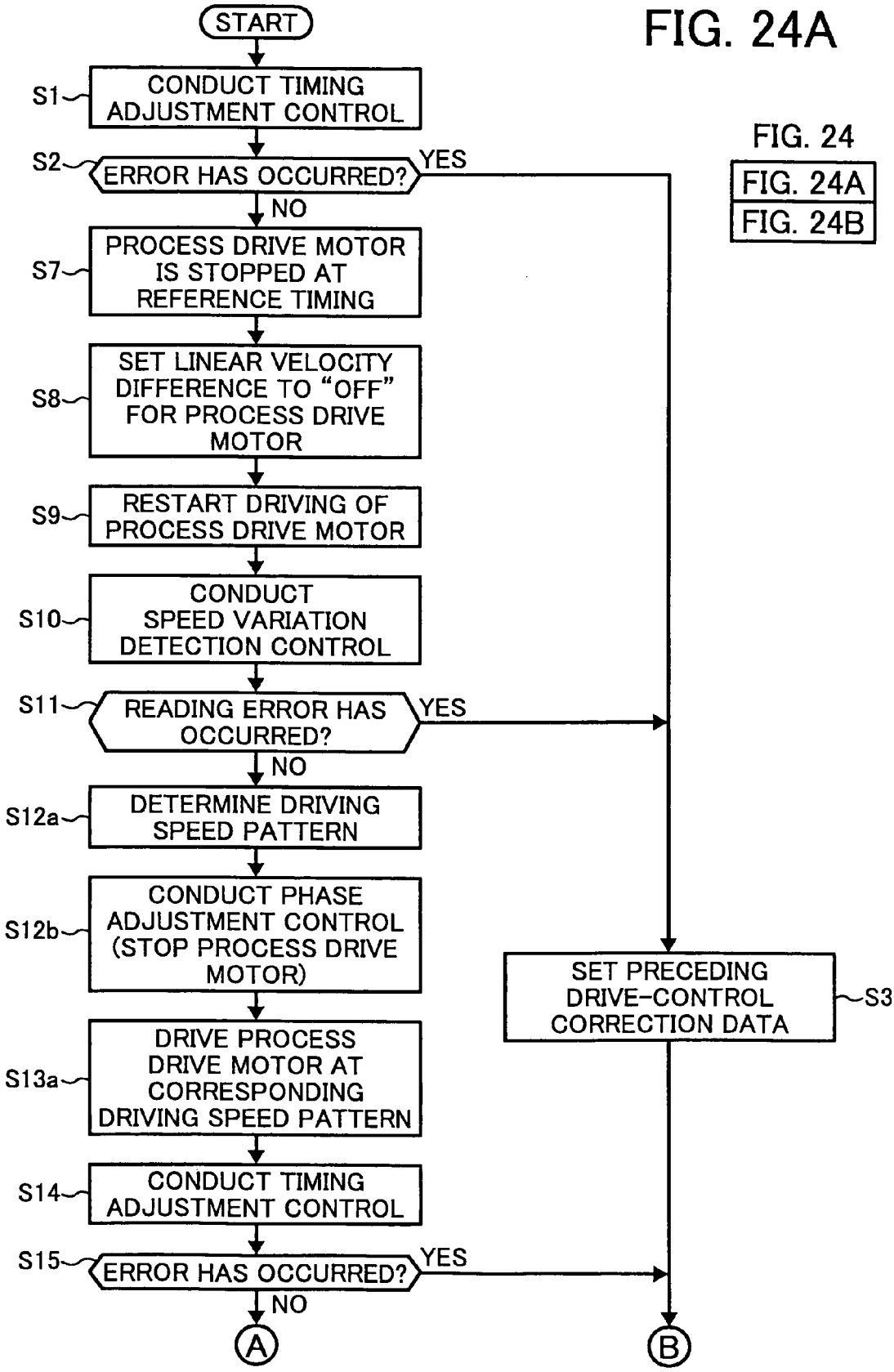
FIG. 24 is another flowchart (according to an example embodiment of the present invention) explaining a process flow conducted by a controller an image forming apparatus after detecting a replacement of the process unit.
Figure 24B:
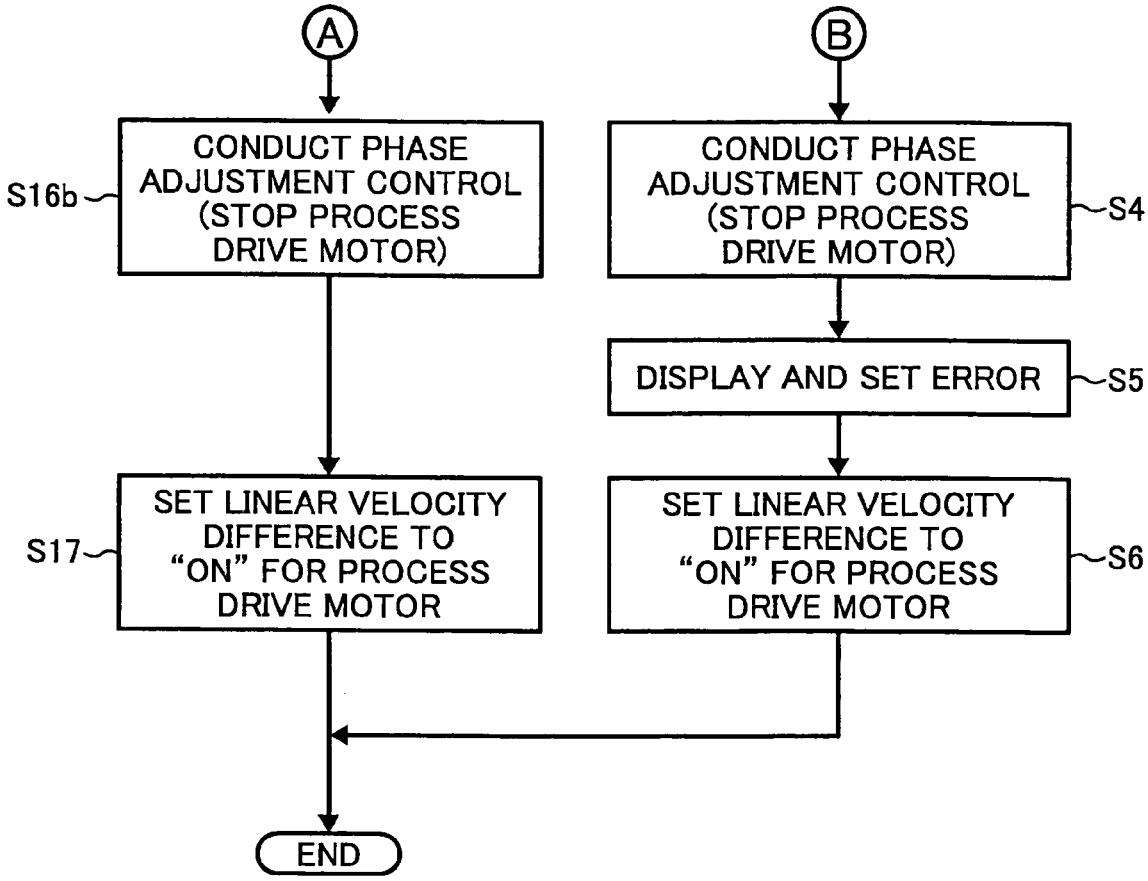

FIG. 24 is another flowchart explaining a process flow conducted by the controller of the image forming apparatus 1000 after detecting a replacement of the process unit 1.

The process flow of FIG. 24 may have steps as similar to the process flow of FIGS. 18 and 23 with some different steps as below.

At step S11, the CPU 146 checks whether a reading error has occurred. For example, the reading error may include that a number of read image patters are not matched to a number of actually formed latent image, wherein such phenomenon may be caused when a scratch on the belt is read, or when a toner image formed on the belt has a very faint concentration which may be too faint for reading.

If the CPU 146 may confirm that the reading error has occurred at step S11, the above-explained steps S2 to S6 are conducted, and the control process ends.

If the CPU 146 may confirm that the reading error has not occurred at step S11, the process goes to step S12*a*, as similar to a process flow of FIG. 23. At step S12*a*, the CPU 146 may determine a driving speed pattern.

At step S12*b*, the CPU 146 may conduct a phase adjustment control and stop the process drive motor 120, which is not included in the process flow of FIG. 23.

At step S13*a*, the CPU 146 may again drive the process drive motor 120 with a corresponding driving speed pattern, which may cancel an effect of speed variation of the process drive motor 120.

At step S14, the CPU 146 may conduct a timing adjustment control.

At step S16*b*, the CPU 146 may stop the process drive motor 120 with conducting a phase adjustment control.

The process flow shown in FIG. 24 may add a step of driving the process drive motor 120 with a corresponding driving speed pattern of the process drive motor 120 to the process flow shown in FIG. 18.

Furthermore, such step of driving the process drive motor 120 with a corresponding driving speed pattern of the process drive motor 120 may also be added to the process flow shown in FIG. 21A to FIG. 21E.

In such a case, the controller may detect a speed variation for each of the photoconductors 3, and determine a driving speed pattern for each of the photoconductors 3.

Then, the controller may conduct a timing adjustment control while driving the process drive motor with the determined driving speed pattern.

In the above-discussion, the image forming apparatus 1000 may employ an intermediate transfer method to transfer toner images to a recording medium (e.g., sheet), in which toner images on the photoconductors 3Y, 3C, 3M, and 3K are primary transferred onto the intermediate transfer belt 41, and then secondary transferred onto the recording medium.

However, the image forming apparatus 1000 may employ a direct transfer method to transfer toner images to a recording medium, in which toner images on photoconductors 3Y, 3C, 3M, and 3K are directly and superimposingly transferred onto the recording medium transported on a transport belt, which travels in a endless manner.

In such a configuration, a timing adjustment control and speed-variation detection control may be conducted with transferring each toner image on the transport belt and detecting such toner image with the optical sensor unit 136.

Figure 25:
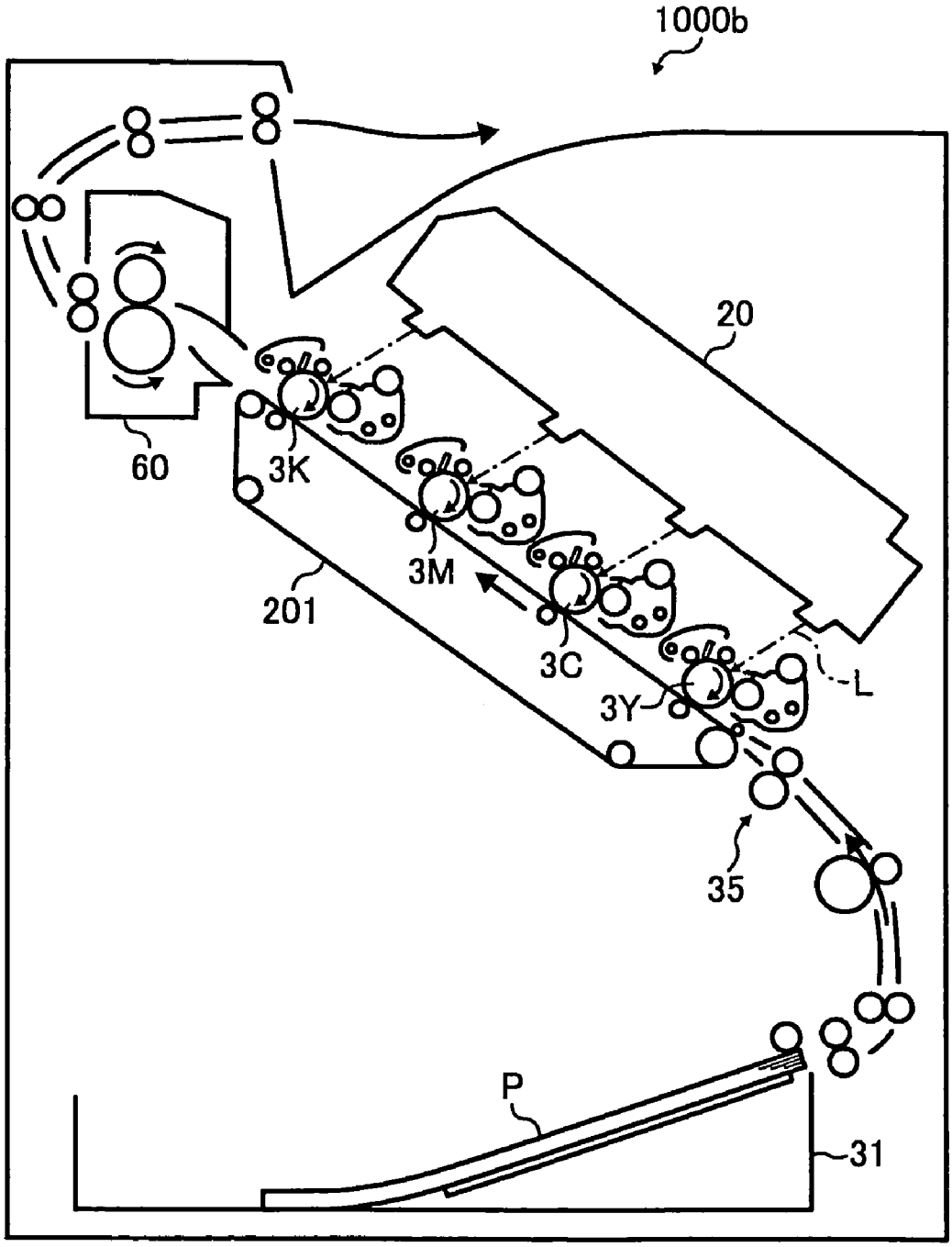
FIG. 25 is a schematic view (according to an example embodiment of the present invention) of an image forming apparatus, in which toner images are superimposingly transferred from a photoconductor to a recording medium directly.

For example, as shown in FIG. 25, the image forming apparatus 1000 may employ a direct transfer method using photoconductors 3Y, 3C, 3M, and 3K and a recording medium P transported on a sheet transport belt 201 to directly and superimposingly transfer toner images onto the recording medium P.

In such configuration, a timing adjustment control and speed-variation detection control may be conducted with transferring each toner image on the sheet transport belt 201 and detecting each toner image with the optical sensor unit 136.

In the above-described example embodiment, an image forming apparatus may include a plurality of image carriers such as photoconductor for forming a latent image thereon.

Such image forming apparatus may also include a plurality of charging units for charging corresponding photoconductor uniformly, an optical writing unit for writing a latent image on the uniformly charged photoconductor, a plurality of developing units for developing a latent image formed on the photoconductor as toner image, and a plurality of cleaning units for cleaning a surface of the photoconductor after transferring the toner image to a transfer member.

In such image forming apparatus, the photoconductor may be integrated with at least one of the charging unit, developing unit, and cleaning unit on a common support member or casing as one process unit. Accordingly, such process unit may be detachably installed in such image forming apparatus.

Therefore, an operator having little knowledge for apparatus can easily replace a photoconductor and its surrounding devices or the like by conducting a detaching or attaching operation for such process unit for an image forming apparatus.

Numerous additional modifications and variations are possible in light of the above teachings. It is therefore to be understood that within the scope of the appended claims, the disclosure of the present invention may be practiced otherwise than as specifically described herein.

What is claimed is:

1. An image forming apparatus comprising:

latent image carriers;

a transfer member to receive sequentially developed images from the image carriers while moving in a given direction there past;

image detectors to detect conditions of images, respectively, formed on the transfer member;

sensors to detect rotational displacements of the image carriers, respectively; and a controller to do at least the following, perform image-to-image displacement control by doing at least the following, forming a detection image on the transfer member, the detection image including images transferred from the image carriers, and detecting a condition of the detection image via the image detectors, and adjusting image forming timing on the image carriers, respectively;

perform speed-variation detection control by doing at least the following, forming a speed-variation detection image on the transfer member, the speed-variation detection image including an image transferred from each of image carriers, detecting a condition of the speed-variation detection image via the image detectors, and determining speed variation of the image carriers, respectively, per one revolution based upon outputs of the image detectors and the sensors;

perform phase adjustment control by at least determining phase adjustments for the image carriers, respectively, based on the corresponding speed-variations; and the controller further being operable to perform at least the phase adjustment control and the image-to-image displacement control before performing image forming operations on the image carriers, respectively.

2. The image forming apparatus according to claim 1, wherein, after completing an image forming operation, the controller is further operable to adjust phases of speed variation patterns for the image carriers and then stops rotation of the image carriers, respectively, and to subsequently rotate the image carriers according to the adjusted speed variation patterns for a next image forming operation.

3. The image forming apparatus according to claim 2, wherein, in the speed-variation detection control, the controller selects one of the image carriers as a reference image carrier and treats a speed-variation detection image for the reference image carrier as a first image, and treats a speed-variation detection image for one of the remaining image carriers as a second image, the first image and second image being formed in alignment on a surface of the transfer member in a direction substantially perpendicular to a surface moving direction of the transfer member, the controller further being operable to start forming the first image according to a detection signal detected by the corresponding sensor, and the controller further being operable to start forming the second image based on the detection signal, and the controller determines a stop timing for rotational control of one of the remaining image carriers, based on a phase difference between the first image and second image determined by the speed-variation detection control.

4. The image forming apparatus according to claim 3, wherein the controller sequentially conducts a first image-to-image displacement control, the speed-variation detection control, and the phase adjustment control, and stops rotation of the image carriers, and subsequently, conducts a second image-to-image displacement control again by rotating the image carriers.

5. The image forming apparatus according to claim 3, wherein the controller rotates the image carriers and stops the rotation at a given reference timing instead of at image-carrier-specific stop timings, and subsequently the controller again rotates the image carriers to conduct the speed-variation detection control.

6. The image forming apparatus according to claim 1, wherein the controller sets a driving speed for each of the image carriers separately for an image forming operation based on a detection timing for the image in the detection image.

7. The image forming apparatus according to claim 6, wherein the controller rotates the image carriers at a substantially similar driving speed when conducting the speed-variation detection control.

8. The image forming apparatus according to claim 1, further comprising detachment sensors to detect detached conditions of respective objects including any one of the plurality of image carriers, respectively, and when a given one of the detachment sensors detects a detached condition of a corresponding object, the controller conducts any one of a first control process and a second control process, the first control process including the speed-variation detection control, the phase adjustment control, and the image-to-image displacement control, and the second control process including the speed-variation detection control, the speed-pattern determining control, and the image-to-image displacement control.

9. The image forming apparatus according to claim 8, wherein the controller judges whether a newly-installed object, installed in the image forming apparatus, is not the same object as a previously-installed object that had been installed in the image forming apparatus before a corresponding detached condition was detected.

10. The image forming apparatus according to claim 9, wherein, when the controller judges that the newly-installed object is not the same as the previously-installed object, the controller forms given images on the image carriers and transfers the given images on a surface of the transfer member as an imaging evaluation image, and subsequently, the controller adjusts imaging conditions for developing units associated with the image carriers based on detection signals derived from the imaging evaluation image detected by the image detectors, respectively.

11. The image forming apparatus according to claim 1, further comprising:

a casing configured to encase the image carriers and the associated drive-force transmitting members to transmit driving forces to the image carriers, respectively;

an openable cover configured to be opened and closed when detaching and attaching at least any one of image carriers and the drive-force transmitting members with respect to the casing; and a cover sensor to detect any one of an opening and closing operation of the openable cover, the controller further being operable, responsive to the cover sensor detecting any one of the opening and closing operation of the openable cover, to conduct any one of a first control process and a second control process, the first control process including the speed-variation detection control, the phase adjustment control, and the image-to-image displacement control, and the second control process including the speed-variation detection control, the speed-pattern determining control, and the image-to-image displacement.

12. The image forming apparatus according to claim 1, further comprising:

writing units configured to write latent images on the image carriers, respectively;

charging units configured to uniformly charge the image carriers, respectively; and cleaning units configured to clean surfaces of the image carriers after transferring the developed images, respectively; and support members configured to support and integrate the image carriers and at least one of the charging units, the developing units, and the cleaning units as process units, respectively, installed detachably in the image forming apparatus.

13. A process unit detachably installed in an image forming apparatus according to claim 1, the process unit comprising:

a support member configured to support and integrate a given one of the image carriers and at least one of a charging unit, a developing unit and a cleaning unit, wherein the charging unit being used for charging the given image carrier uniformly, the developing unit being used for developing a latent image on the given image carrier, and the cleaning unit being used for cleaning a surface of the given image carrier.

14. An image forming apparatus comprising:

latent image carriers;

drivers to rotate the image carriers, respectively;

a transfer member to receive sequentially developed images from the image carriers while moving in a given direction there past;

image detectors to detect conditions of images, respectively, formed on the transfer member;

sensors to detect rotational displacements of the image carriers, respectively; and a controller to do at least the following, perform image-to-image displacement control by doing at least the following, forming a detection image on the transfer member, the detection image including images transferred from the image carriers, and detecting a condition of the detection image via the image detectors, and adjusting image forming timing on the image carriers, respectively;

perform speed-variation detection control by doing at least the following, forming a speed-variation detection image on the transfer member, the speed-variation detection image including an image transferred from each of image carriers, detecting a condition of the speed-variation detection image via the image detectors, and determining speed variation of the image carriers, respectively, per one revolution based upon outputs of the image detectors and the sensors;

perform image-to-image displacement control by doing at least the following, determining first driving speed patterns for the drivers based on speed variation patterns, respectively, detected by the speed-variation detection control, determining second driving speed patterns based upon the first driving speed patterns and having reduced variation of surface speeds of the image carriers, respectively, the controller further being operable to do at least the following, perform the image-to-image displacement control while driving the image carriers with the second driving speed patterns, respectively, and perform an image forming operation via the image carriers.

15. The image forming apparatus according to claim 14, wherein the controller conducts the phase adjustment control and the driving speed pattern control for each of the image carriers before conducting the image-to-image displacement control for each of the image carriers.

16. The image forming apparatus according to claim 14, wherein the controller performs quadrature detection processing upon signals transmitted from the image detectors, respectively, to analyze speed variation patterns for the speed-variation detection image.

* * * * *